US006793575B2

(12) United States Patent
Brown et al.

(10) Patent No.: US 6,793,575 B2
(45) Date of Patent: Sep. 21, 2004

(54) RACING GAME

(75) Inventors: Duncan F. Brown, Grayslake, IL (US); Scott D. Slomiany, Streamwood, IL (US); Lawrence E. DeMar, Winnetka, IL (US)

(73) Assignee: Case Venture Management, LLC, Wheeling, IL (US)

( * ) Notice: Subject to any disclaimer, the term of this patent is extended or adjusted under 35 U.S.C. 154(b) by 60 days.

(21) Appl. No.: 10/092,119

(22) Filed: Mar. 6, 2002

(65) Prior Publication Data

US 2002/0132658 A1 Sep. 19, 2002

Related U.S. Application Data

(63) Continuation-in-part of application No. 09/709,922, filed on Nov. 10, 2000.
(60) Provisional application No. 60/291,080, filed on May 15, 2001.

(51) Int. Cl.[7] ..... A63F 9/24
(52) U.S. Cl. ..... 463/6; 463/16
(58) Field of Search ..... 463/6, 16, 58, 463/59, 60

(56) References Cited

U.S. PATENT DOCUMENTS

| | | | | |
|---|---|---|---|---|
| 3,628,259 | A | 12/1971 | Kahn | 35/9 E |
| 3,940,138 | A | 2/1976 | Ochi | 273/86 B |
| 3,999,760 | A | 12/1976 | Wilson | 273/133 |
| D251,395 | S | 3/1979 | Kula | D21/37 |

(List continued on next page.)

FOREIGN PATENT DOCUMENTS

| | | | |
|---|---|---|---|
| EP | 753 331 A2 | 1/1997 | A63F/3/06 |
| EP | 874 337 A1 | 10/1998 | G07F/17/32 |
| EP | 945 837 A2 | 9/1999 | G07F/17/32 |
| EP | 981 119 A2 | 2/2000 | G07F/17/32 |
| EP | 984 407 A2 | 3/2000 | G07F/17/32 |
| EP | 989 531 A2 | 3/2000 | G07F/17/32 |

OTHER PUBLICATIONS

"Pole Position", Atari. Manual [online]. 2003. [retrieved on Sep. 10, 1993]. Retrieved from the Internet: <URL:www.atariage.com/manual_html_page.html?SoftwareID=2091>.*

(List continued on next page.)

*Primary Examiner*—Teresa Walberg
*Assistant Examiner*—Julie Brocketti
(74) *Attorney, Agent, or Firm*—Baniak Pine & Gannon

(57) ABSTRACT

In an embodiment as a video gaming machine, a racetrack and a plurality of racers in the form of racecars are generated. The program driving the game includes a function for randomly assigning a finishing position for racers at the end of a race. A racecar is selected, as by player input, as the player's racer. The player inputs a wager, with the wager further preferably requiring an input by the player as to a number of races desired to be completed up to a preset maximum number for the game. The player can thus choose to bet upon all stages (races or laps) potentially available, or some lesser consecutive number of races. The first race is initiated, with the racecars being randomly assigned finishing positions. In this embodiment, there is the elimination of at least one racer as a result of a predetermined threshold finishing position required at the end of a race; that position could be anything other than last, for instance. Play continues with another race provided the player's racer has not been eliminated, and the next lap has been enabled; that can include an initial input by the player of a wager on the next stage (race, lap). This repeats until a game-ending event; such as the player's racer has been eliminated; or a predetermined number of races have been completed; or the player's racer is the last one not eliminated. A payout is awarded based upon the number of races completed by the player's racer and the finishing position of the player's racer in each race.

143 Claims, 40 Drawing Sheets

U.S. PATENT DOCUMENTS

| | | | | | |
|---|---|---|---|---|---|
| 4,156,976 | A | | 6/1979 | Mikun | 35/8 R |
| 4,448,419 | A | | 5/1984 | Telnaes | 273/143 R |
| 4,614,342 | A | | 9/1986 | Takashima | 273/85 CP |
| 4,710,873 | A | * | 12/1987 | Breslow et al. | 463/31 |
| 4,805,907 | A | | 2/1989 | Hagiwara | 273/138 A |
| 5,011,159 | A | | 4/1991 | Fortunato et al. | 273/260 |
| 5,100,137 | A | | 3/1992 | Fulton | 273/85 CP |
| 5,167,413 | A | | 12/1992 | Fulton | 273/85 CP |
| 5,221,083 | A | | 6/1993 | Dote | 273/85 CP |
| 5,224,706 | A | | 7/1993 | Bridgeman et al. | 273/85 CP |
| 5,294,120 | A | | 3/1994 | Schultz | 273/85 CP |
| 5,294,128 | A | | 3/1994 | Marquez | 273/292 |
| 5,401,023 | A | | 3/1995 | Wood | 273/85 CP |
| D364,650 | S | | 11/1995 | Hanscom | D21/37 |
| 5,489,101 | A | | 2/1996 | Moody | 273/292 |
| 5,511,781 | A | | 4/1996 | Wood et al. | 273/85 CP |
| D371,579 | S | | 7/1996 | Hanscom | D21/37 |
| 5,531,448 | A | | 7/1996 | Moody | 273/292 |
| 5,560,603 | A | | 10/1996 | Seelig et al. | 463/6 |
| 5,570,885 | A | | 11/1996 | Ornstein | 463/27 |
| D376,825 | S | | 12/1996 | Hanscom | D21/37 |
| 5,584,486 | A | | 12/1996 | Franklin | 273/292 |
| D377,670 | S | | 1/1997 | Means et al. | D21/37 |
| 5,593,161 | A | | 1/1997 | Boylan et al. | 273/274 |
| D378,930 | S | | 4/1997 | Nobata et al. | D21/37 |
| 5,664,998 | A | | 9/1997 | Seelig et al. | 463/20 |
| 5,678,001 | A | | 10/1997 | Nagel et al. | 395/173 |
| 5,707,285 | A | | 1/1998 | Place et al. | 463/12 |
| 5,711,715 | A | | 1/1998 | Ringo et al. | 473/9 |
| 5,718,431 | A | | 2/1998 | Ornstein | 273/292 |
| 5,722,891 | A | | 3/1998 | Inoue | 463/20 |
| 5,732,950 | A | | 3/1998 | Moody | 273/292 |
| 5,775,692 | A | | 7/1998 | Watts et al. | 273/143 R |
| 5,779,544 | A | | 7/1998 | Seelig et al. | 463/6 |
| 5,779,549 | A | * | 7/1998 | Walker et al. | 463/42 |
| D397,161 | S | | 8/1998 | Hanscom et al. | D21/37 |
| 5,791,987 | A | | 8/1998 | Chen et al. | 463/9 |
| 5,816,916 | A | | 10/1998 | Moody | 463/13 |
| 5,823,872 | A | * | 10/1998 | Prather et al. | 463/6 |
| 5,823,873 | A | | 10/1998 | Moody | 463/13 |
| 5,823,874 | A | | 10/1998 | Adams | 463/17 |
| 5,848,932 | A | | 12/1998 | Adams | 463/20 |
| 5,868,619 | A | | 2/1999 | Wood et al. | 463/13 |
| 5,882,258 | A | | 3/1999 | Kelly et al. | 463/11 |
| 5,938,200 | A | * | 8/1999 | Markowicz et al. | 273/246 |
| 5,954,335 | A | | 9/1999 | Moody | 273/292 |
| 5,971,849 | A | * | 10/1999 | Falciglia | 463/16 |
| 5,976,015 | A | | 11/1999 | Seelig et al. | 463/6 |
| 5,976,016 | A | | 11/1999 | Moody et al. | 463/13 |
| 5,997,400 | A | | 12/1999 | Seelig et al. | 463/6 |
| 5,999,808 | A | | 12/1999 | LaDue | 455/412 |
| 6,007,066 | A | | 12/1999 | Moody | 273/292 |
| 6,007,424 | A | | 12/1999 | Evers et al. | 463/13 |
| 6,012,720 | A | | 1/2000 | Webb | 273/292 |
| 6,012,981 | A | | 1/2000 | Fujioka et al. | 463/11 |
| 6,062,980 | A | | 5/2000 | Luciano | 463/20 |
| 6,098,985 | A | | 8/2000 | Moody | 273/292 |
| 6,120,378 | A | | 9/2000 | Moody et al. | 463/20 |
| 6,126,541 | A | | 10/2000 | Fuchs | 463/13 |
| 6,126,542 | A | | 10/2000 | Fier | 463/16 |
| 6,149,521 | A | | 11/2000 | Sanduski | 463/13 |
| 6,190,255 | B1 | | 2/2001 | Thomas et al. | 463/20 |
| 6,196,547 | B1 | | 3/2001 | Pascal et al. | 273/292 |
| 6,203,429 | B1 | | 3/2001 | Demar et al. | 463/20 |
| 6,210,275 | B1 | * | 4/2001 | Olsen | 463/16 |
| 6,217,448 | B1 | | 4/2001 | Olsen | 463/25 |
| 6,309,300 | B1 | * | 10/2001 | Glavich | 463/26 |
| 6,312,334 | B1 | | 11/2001 | Yoseloff | 463/25 |
| 6,612,927 | B1 | * | 9/2003 | Slomiany et al. | 463/16 |

OTHER PUBLICATIONS

"Pole Position", [online]. 1982. [retrieved on Sep. 10, 2003]. Retrieved from the Internet: <URL:www.standord.edu/~mk-tong/polepos/>.*

Sellers, John. Arcade Fever. Running Press Book Publishers, Philadelphia: 2001, pp. 89–99, 104–105.*

Play It Again Poker, Brochure, IGT, 1999.

Bunco Dice History and Rules, website article, http://world-bunco.com/history.html, May 22, 2000.

Super Bonus Poker by Bally Gaming, described in Strictly Slots, Apr. 2000, p. 51.

Multi–Play Poker by Bally Gaming, described in Strictly Slots, Dec. 2000, p. 62.

Multi–Play Poker by Bally Gaming, website article,. http://ballygaming.com/products/multi–play–poker.html, Apr. 25, 2001.

Wheel of Madness Game, described in AC Coin & Slot brochure,2000, p. 9.

Steemroller Dice Game, described in brochure of Steehn Gaming Systems, Inc., date unknown.

Monopoly Blackjack Edition Game, described in Mikohn brochure, 2000.

Multi–Action Blackjack, website article, http://conjelco.com/faq/bj.html, Apr. 25, 2001, printed on Jul. 30, 2001.

Card/brochure: Las Vegas Hilton, Fortune, Pai Gow Poker, date unknown.

Java Chess Tutor, www.octopull.demon.co.uk/chess–tutor/JCT–run.html website, copyright 1997.

Various live and electronic poker–style slot machines as seen and played, dates and places unknown, no document submitted.

* cited by examiner

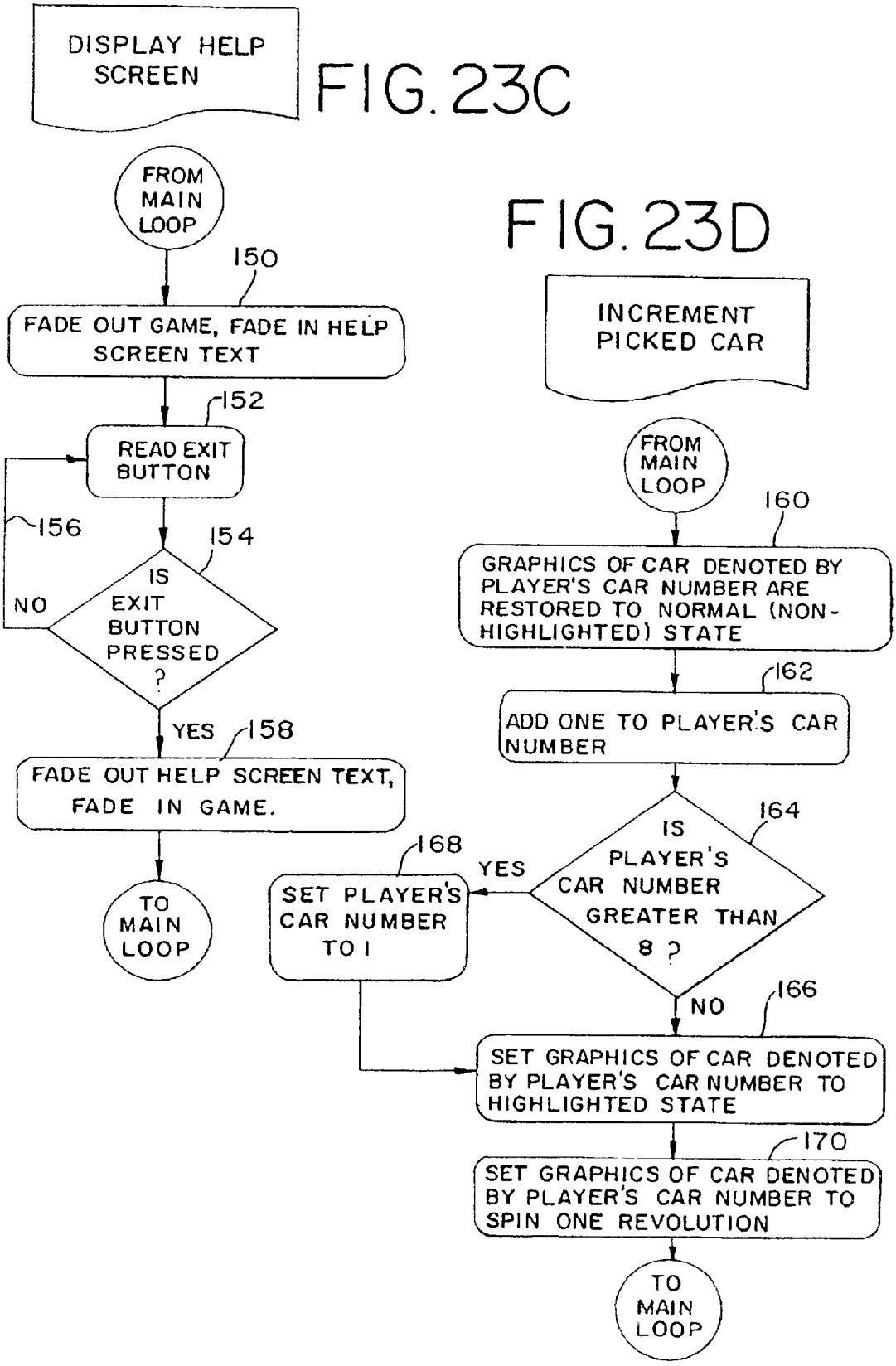
DISPLAY HELP SCREEN
FIG. 23C
FROM MAIN LOOP
150
FADE OUT GAME, FADE IN HELP SCREEN TEXT
152
READ EXIT BUTTON
156
154
IS EXIT BUTTON PRESSED ?
NO
YES
158
FADE OUT HELP SCREEN TEXT, FADE IN GAME.
TO MAIN LOOP
FIG. 23D
INCREMENT PICKED CAR
FROM MAIN LOOP
160
GRAPHICS OF CAR DENOTED BY PLAYER'S CAR NUMBER ARE RESTORED TO NORMAL (NON-HIGHLIGHTED) STATE
162
ADD ONE TO PLAYER'S CAR NUMBER
164
IS PLAYER'S CAR NUMBER GREATER THAN 8 ?
YES
168
SET PLAYER'S CAR NUMBER TO 1
NO
166
SET GRAPHICS OF CAR DENOTED BY PLAYER'S CAR NUMBER TO HIGHLIGHTED STATE
170
SET GRAPHICS OF CAR DENOTED BY PLAYER'S CAR NUMBER TO SPIN ONE REVOLUTION
TO MAIN LOOP

RUN A LAP

FROM MAIN LOOP
186
GENERATE, ADD IN CAR MOVE VALUES
188
CALCULATE NEW RELATIVE POSITIONS
190
DISPLAY CARS MOVING AROUND TRACK
192
EXPLODE LAST-PLACE CARS
194
AWARD PAY FOR THIS LAP
TO MAIN LOOP

GAME CYCLE (SERVER)

PROCESS CLIENT MESSAGES (SERVER)

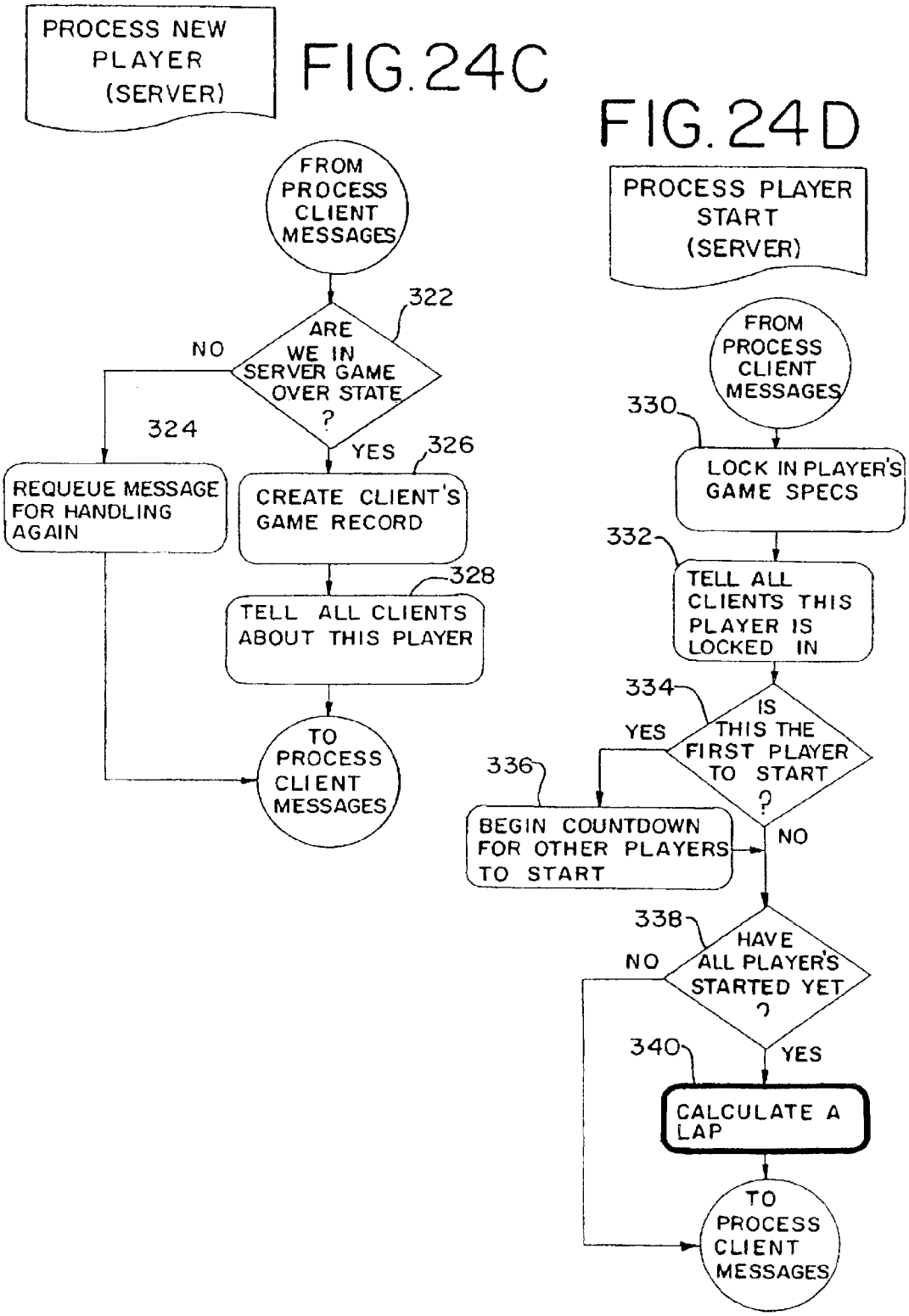
PROCESS NEW PLAYER (SERVER)
FIG. 24C
FROM PROCESS CLIENT MESSAGES
322
ARE WE IN SERVER GAME OVER STATE ?
NO
YES
324
326
REQUEUE MESSAGE FOR HANDLING AGAIN
CREATE CLIENT'S GAME RECORD
328
TELL ALL CLIENTS ABOUT THIS PLAYER
TO PROCESS CLIENT MESSAGES
FIG. 24D
PROCESS PLAYER START (SERVER)
FROM PROCESS CLIENT MESSAGES
330
LOCK IN PLAYER'S GAME SPECS
332
TELL ALL CLIENTS THIS PLAYER IS LOCKED IN
334
IS THIS THE FIRST PLAYER TO START ?
YES
NO
336
BEGIN COUNTDOWN FOR OTHER PLAYERS TO START
338
HAVE ALL PLAYER'S STARTED YET ?
NO
YES
340
CALCULATE A LAP
TO PROCESS CLIENT MESSAGES

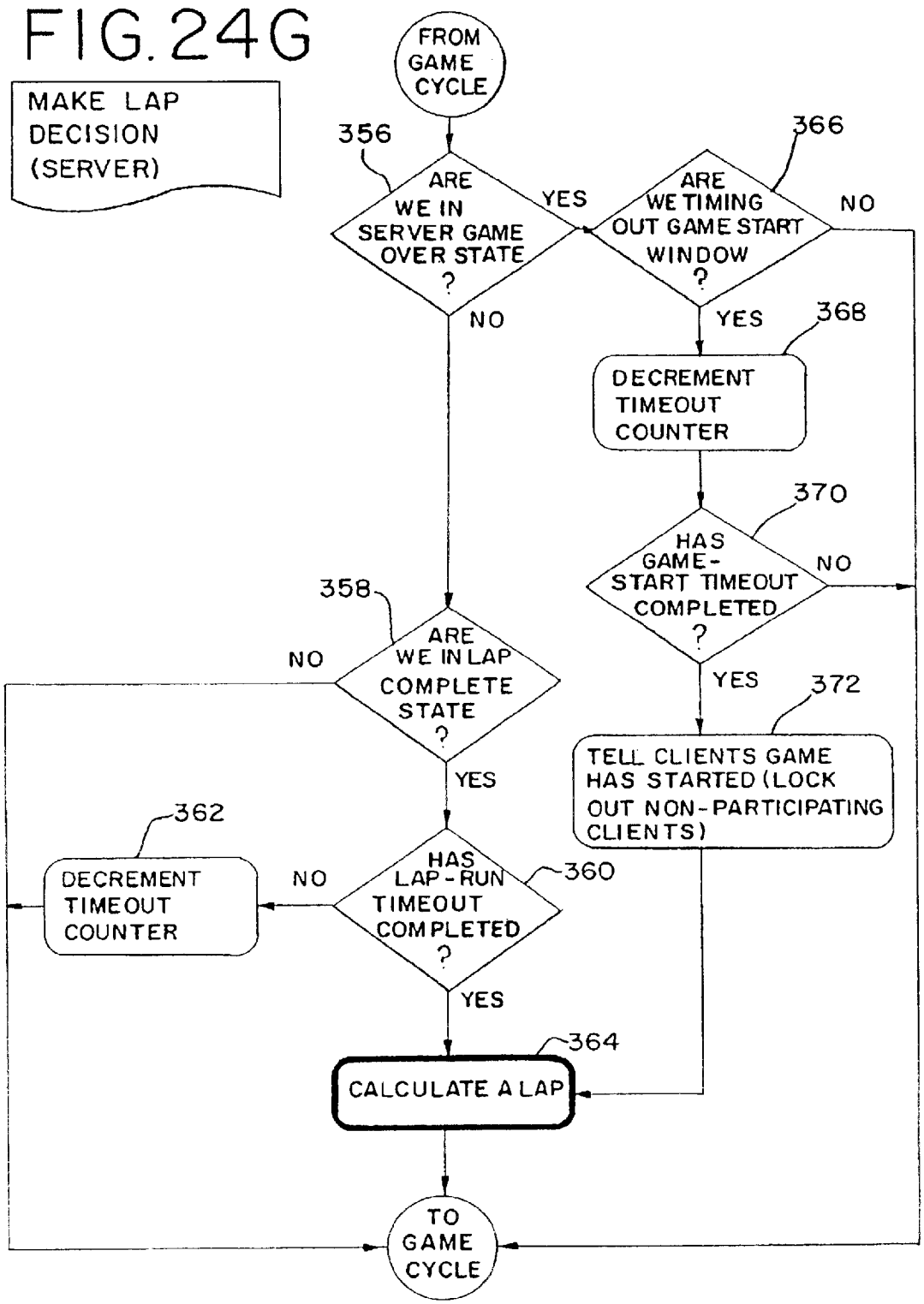
FIG. 24G
MAKE LAP DECISION (SERVER)
FROM GAME CYCLE
356
ARE WE IN SERVER GAME OVER STATE ?
YES
NO
366
ARE WE TIMING OUT GAME START WINDOW ?
NO
YES
368
DECREMENT TIMEOUT COUNTER
370
HAS GAME-START TIMEOUT COMPLETED ?
NO
YES
372
TELL CLIENTS GAME HAS STARTED (LOCK OUT NON-PARTICIPATING CLIENTS)
358
ARE WE IN LAP COMPLETE STATE ?
NO
YES
362
DECREMENT TIMEOUT COUNTER
NO
HAS LAP-RUN TIMEOUT COMPLETED ?
360
YES
364
CALCULATE A LAP
TO GAME CYCLE

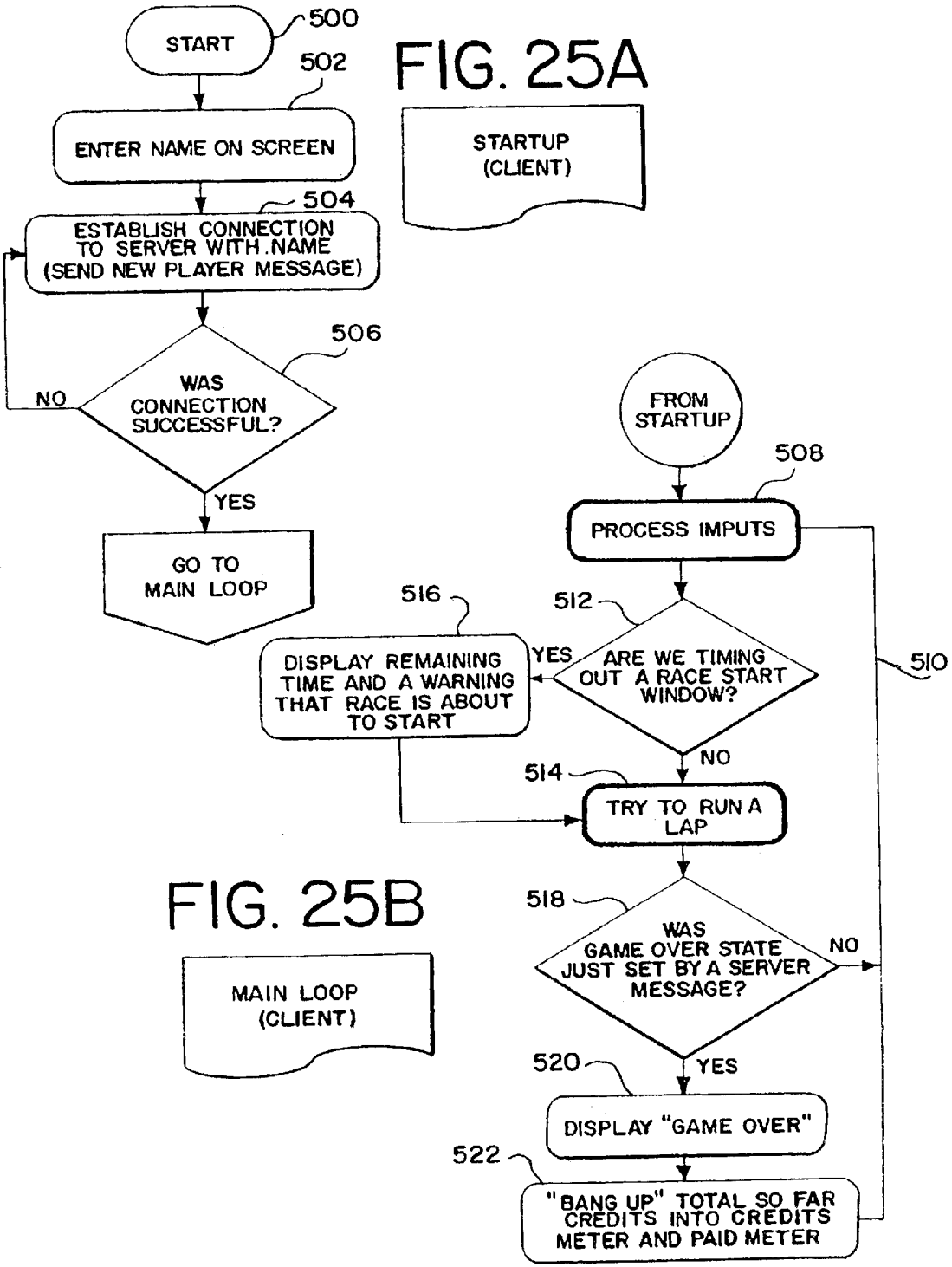
START
500
502
ENTER NAME ON SCREEN
504
ESTABLISH CONNECTION TO SERVER WITH NAME (SEND NEW PLAYER MESSAGE)
506
WAS CONNECTION SUCCESSFUL?
NO
YES
GO TO MAIN LOOP
FIG. 25A
STARTUP (CLIENT)
FROM STARTUP
508
PROCESS IMPUTS
510
512
ARE WE TIMING OUT A RACE START WINDOW?
YES
NO
516
DISPLAY REMAINING TIME AND A WARNING THAT RACE IS ABOUT TO START
514
TRY TO RUN A LAP
518
WAS GAME OVER STATE JUST SET BY A SERVER MESSAGE?
NO
YES
520
DISPLAY "GAME OVER"
522
"BANG UP" TOTAL SO FAR CREDITS INTO CREDITS METER AND PAID METER
FIG. 25B
MAIN LOOP (CLIENT)

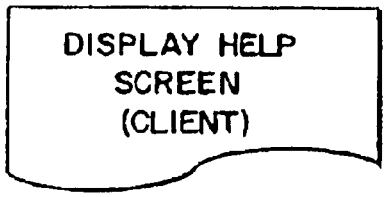
FIG. 25E
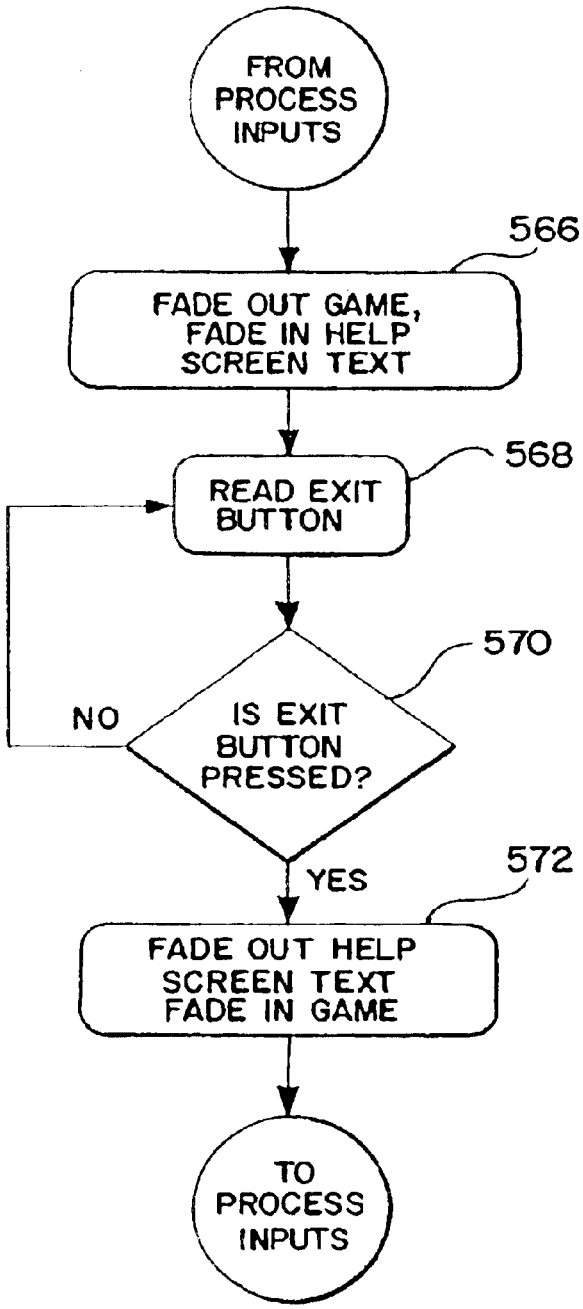

INCREMENT COINS PER LAP (CLIENT)

INCREMENT SELECTED LAPS (CLIENT)

RACING GAME

This application is a continuation-in-part of pending U.S. Ser. No. 09/709,922 filed on Nov. 10, 2000 and a provisional application of pending U.S. Ser. No. 60/291,080 filed on May 15, 2001.

FIELD OF THE INVENTION

This invention relates to a game, and one particularly adapted for a video display, and even more particularly to a gaming machine or other gaming environment (e.g., Internet) that allows the player to wager on the results of the game.

BACKGROUND OF THE INVENTION

Slot machines, poker machines, blackjack machines and similar gaming machines are abundant. Some, such as slot machines, may be mechanical devices without any video component. Machines to play card games, as well as slot machines, are more and more based upon a video monitor as the display mechanism for the game, however, with the game itself governed by a microprocessor-based system. These machines are also not necessarily simply isolated mechanisms, but in certain desired instances they can be interconnected, such as through a LAN in a local environment or the Internet in a more global application, so that multiple players can participate at the same time.

The popularity of the games, and these gaming machines, derive from a number of factors, some of which are the apparent likelihood of winning (typically money in a wagering environment), the attractiveness of the gaming machine, and the basic level of entertainment provided by the game/machine itself. It is therefore one general driving force in the gaming industry to come up with new and exciting games and gaming machines which will attract players, entertain them, and promote repeated play.

Most games of chance are of a short generation, with an eye toward a quick end result. For example, a slot machine generates symbols for one or more paylines by spinning reels and then paying based on the result. In most such slot machines, the game is then over. Games like Video Poker or BlackJack give the player an initial hand, and then may allow for further play of that hand depending upon the rules of the card game; but again, the game itself is relatively short-lived toward a single result. Games like Baccarat play with an initial hand and then apply rules for subsequent play, but once again yields a single result to the hand. Unlike BlackJack or Video Poker, however, the player does not make strategic decisions toward the end result.

There are some wagering games which can continue for a somewhat longer play. Many bets in craps have multiple events before the single decision for the bet is resolved. Decision-making is of a go/no-go variety, however.

As will become evident hereinafter with respect to the present invention, one innovative and exciting new approach to gaming has been the development of a multi-stage game concept by the same inventors herein, as disclosed in pending U.S. application Ser. No. 09/709,922, of which this application is a continuation in part. That disclosure shows games that allow for bets on different stages of a multiple stage game, such that lower stages are actually played more often than higher stages, with higher stages offering a greater return when they are played. Potentially extended gameplay is another attraction of the foregoing multi-stage games, with mounting excitement as each stage is achieved.

Switching gears, but for reasons that will soon be clear, there are mechanical racing games which have horses or chariots racing around a track, allowing the players to wager on entries coming in first, second, third or other winning combinations. One race and the game is over, however. There has also been a slot machine that offered a bonus game upon a combination of symbols, where the bonus game was a simulation of a multi-lap car race. In this bonus game, bonus coins are awarded for each car passed in a multiple lap race.

Now, with the foregoing in mind, the current invention builds upon the original concept of the inventors for a game that allows for multi-stage wagering on the continuing progress of a game, but this time, and in the case of the preferred embodiment, a multi-stage car race is presented.

SUMMARY OF THE INVENTION

The present invention, in perhaps one of its broadest expressions, comprises a race game having a raceway and a plurality of racers which traverse that raceway. A wager is placed by a player, with the wager including player selection of a consecutive number of races desired to be run up to a preset maximum number of races (laps) to the game. The player selects a racer as the player's racer.

A race is initiated, and there is a random assignment of finishing positions for racers at the end of a race. Play continues with another race, provided the player's racer has not met a predetermined game-ending criterion, and the player has previously placed a wager on the next race (also referred to as a lap).

In one preferred form, the race game is played in a video format, such as on a video game, a video gaming machine, an Internet arrangement, or the like. In such an environment, the game therefore further includes a video display (e.g., monitor or screen), a cpu including a program for driving the display and operating the game, and a player input mechanism interfacing with the cpu. The raceway is formed on the display, as by generation of a racetrack depiction. The plurality of racers is likewise generated by the program and depicted on the display.

It will be noted that the use of the term "racer" is meant to be inclusive of any kind of object or indicium useful for depicting something which appears to move or otherwise change position in a race format. It need not be a racecar, for instance, as is used in the most preferred embodiment of the invention discussed hereinafter. Likewise, use of the term "cpu" is not meant to be exclusive of other means whereby a computer program is caused to be run or the operation of that program is effectuated.

Turning back now to the invention at hand, the race game preferably includes a payout for each race based upon the finishing position of the player's racer in a respective race. That wager placed upon a race which is not run because of a game-ending criterion is lost in the preferred embodiment disclosed herein. That embodiment also has a paytable for the payout, with the paytable providing increasingly higher payouts for at least some races completed after a first race.

One form of the invention has the starting position for a player's racer in a subsequent race established by the finishing position of the player's racer in the race just completed. That is, if the player finished third, the player then starts the next lap from the third position. An embodiment of the invention also has at least one racer eliminated as a result of a predetermined threshold finishing position required at the end of a race. For instance, that predetermined position can be anything other than last place. If a racer finishes in last place, it is eliminated from further competition. Play continues with another race until one of the following occurs constituting a game-ending criterion: the player's racer has been eliminated; a predetermined number of racers remains, such as a minimum number; or a predetermined number of races have been completed.

The race game of the present invention contemplates that more than one player can participate at a time. Each player would place a respective wager and select a racer as that player's respective racer. The operation of the game would otherwise progress as described above.

In an embodiment such as a video gaming machine, the gaming machine includes a video display, a cpu including a program for driving the display and operating the game, and a player input mechanism interfacing with the cpu. A racetrack and a plurality of racers in the form of racecars, for instance, are generated. The program includes a function for randomly assigning a finishing position for racers at the end of a race.

A racecar is selected, as by player input, as the player's racer. The player inputs a wager, with the wager further requiring an input by the player as to a number of races desired to be completed up to a preset maximum number for the game in this embodiment of the invention. The player can thus choose to bet upon all stages (races/laps) potentially available, or some lesser consecutive number of stages.

The first race is initiated, with the racecars being randomly assigned finishing positions. In this embodiment, there is the elimination of at least one racer as a result of a predetermined threshold finishing position required at the end of a race; that position being anything other than last place, for instance. The last place racecar(s) is eliminated through an explosive destruction sequence executed at the end of a race in one preferred form.

Play continues with another race, provided the player's racer has not been eliminated, and the player has wagered on the next stage (race/lap). This repeats until one of the following occurs constituting a game-ending event: the player's racer has been eliminated; a predetermined number of racers remains; or a predetermined number of races have been completed. A payout based upon the number of races completed by the player's racer and the finishing position of the player's racer in each race is most preferably provided. This payout can be registered on every race/lap successfully completed (assuming that the finishing position of the player's racer merits a payout based upon the paytable being used), or at the conclusion of the game. Of course, the game could alternatively be designed such that any or all payout(s) are lost if the player does not successfully complete the number of races wagered upon.

As described above, this particular embodiment has any wager placed upon a race which is not run because of a game-ending criterion as lost. As an enticement to play higher levels (races), however, a paytable provides increasingly higher payouts for at least some races completed after a first race. In this gaming machine embodiment, the starting position for a player's racer in the next race is the finishing position of the player's racer in the race just completed. Also, a preset game-ending criterion for this embodiment is when the player's car is eliminated, or it survives all levels. Alternatively, a predetermined minimum number of racers equals a predetermined number of finishing places for which a payout is provided. For instance, if payouts are provided for any of first through third place finishes, this form of the invention ends the game if only three racers are left.

Another embodiment of the invention includes the capacity for a plurality of players to participate in the same game. Each player will have his/her own racer, and places a wager. Races/laps will then be run, which are displayed substantially simultaneously to each player. This can be done through a single display visible to all players, or on displays of respective gaming machines that are linked to a master program, just to name two alternatives. Play of the game proceeds in substantially the same manner as in the single-player version.

There is also disclosed herein a bonus round which is entered if a player's racer is the last remaining racer at the end of a race. This "Trophy Bonus" round comprises selection by the player of at least one of a plurality of bonus items, each bonus item having a bonus value associated therewith revealed upon selection of the bonus item. Of course, some other goal attained in the game could lead to the bonus round, such as finishing the maximum number of laps in first place, for instance.

Thus, in a preferred embodiment, the invention takes the form of a lap by lap car race, where each lap is a betting stage of a multi-stage game. This continuing game generates multiple betting results, as the result of the lap by lap standing of cars in the race, and in particular, the finishing position of the player's car. Again in this preferred form, each lap of the race continues (assuming an advancement to the next lap has been achieved) with each car starting the subsequent lap from its position at the end of the preceding lap. Therefore, unlike most other gaming experiences, this multi-stage game creates a result at each stage, with the progress of each stage carrying on to the next stage.

The present invention will be further appreciated, and its attributes and advantages further understood, upon consideration of the following detailed description of an embodiment of the invention, taken in conjunction with the accompanying drawings, in which:

BRIEF DESCRIPTION OF THE DRAWINGS

FIGS. 23A through 23L are flow charts for a program operating an embodiment in a single player format;

FIGS. 24A through 24K are flow charts for a server program operating a multiplayer networked embodiment; and FIGS. 25A through 25K are flow charts of a client (player machine) program used with the foregoing server program.

DETAILED DESCRIPTION OF EMBODIMENTS OF THE INVENTION

The embodiments of the invention described hereinafter have been particularly adapted for play on a video display, and even more particularly, for play upon a video gaming machine. The game could easily be adapted for play on a mechanical racing machine without departing from the invention, of course, or adapted to any other conceivable environment where games are played.

Figure 1:
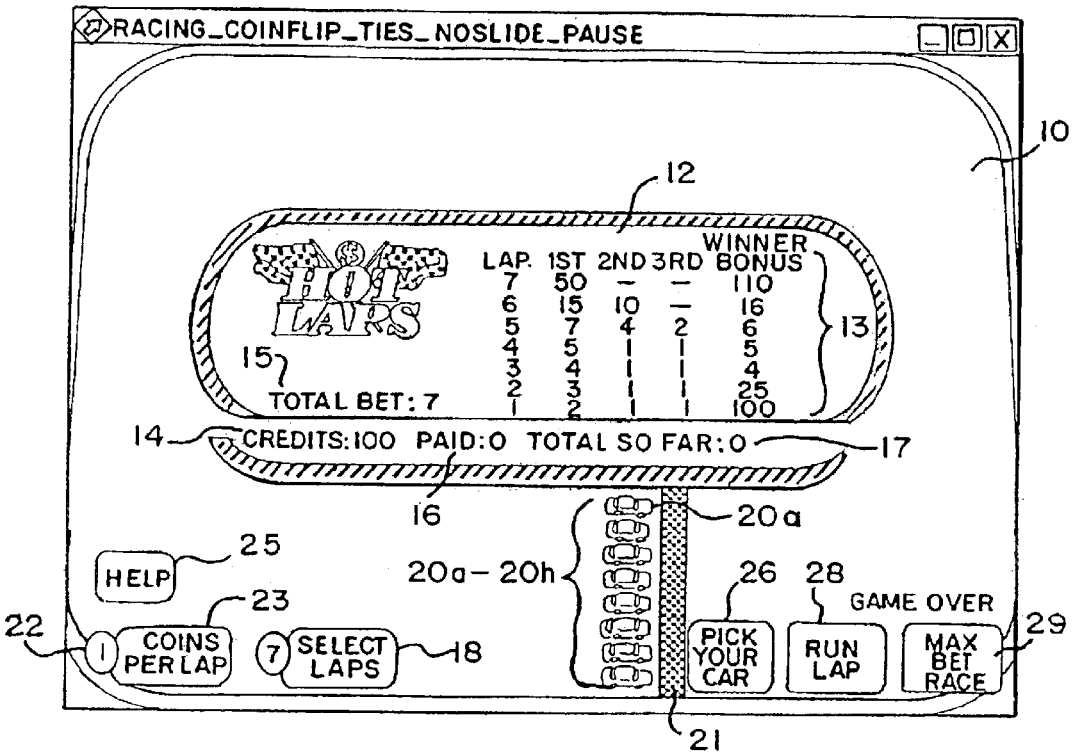
FIG. 1 is an illustrative screen from a video display showing an embodiment of the invention.

Turning now to FIG. 1, what is depicted is a typical display at the start of a race. The game will be run in a predetermined number of laps or races for a multi-stage game, but as also will be revealed hereinafter, events may transpire by which fewer than the maximum laps/races will be achieved before a given game ends. Laps, races and stages are used synonymously herein.

What is shown in FIG. 1, and in similar Figures throughout this disclosure, is a representation of a display or screen of the video display of the game at a moment in time. The screen of FIG. 1 is monopolized by a circular race track 10, also referred to as a race course, raceway, etc. In the infield 12 (center of screen) is a paytable 13 as well as various meters (displays) for "Credits" 14, "Total Bet" 15, win ("Paid") 16 and current partial win ("Total So Far") 17.

There are also several video buttons on the screen, which will hereafter be variously described. A touchscreen, well known in the art, is used. The functions of these buttons may also be accomplished through mechanical buttons, as well as a pointing device or the like, in addition to or instead of the video buttons.

Eight different colored race cars 20*a* through 20*h* are displayed with their noses on a vertically oriented start/finish line 21. One of the cars (the highest car 20*a* in FIG. 1, i.e., closest to the infield 12) has a stripe along the length of its body as well as a racing number displayed on the hood and the top of the car.

The player uses the "Select Laps" button 18 to select the number of laps (races or stages) for which the player wants to place a wager. This may range from one to seven laps in this particular embodiment, with a one coin bet required for each lap that is wagered upon. The game may be constructed with more or fewer laps without departing from the invention.

Figure 2:
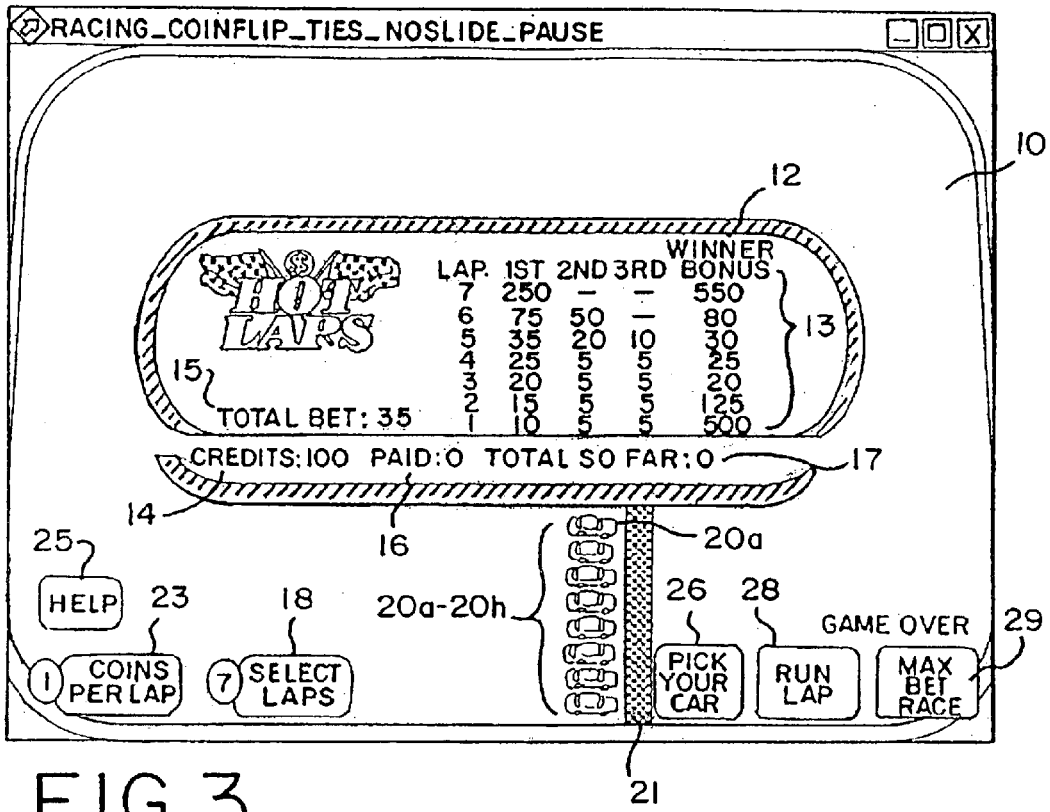
FIG. 2 is another illustrative screen from a video display showing an embodiment of the invention.

The player may use the "Coins Per Lap" button 23 to select the number of coins per lap bet, and correspondingly scale the paytable 13 as shown in FIG. 2, where the "Coins Per Lap" is set to its maximum of "5". Of course those skilled in the art understand how to allow the "Coins Per Lap" to go to any arbitrary level, and also how to award bonuses at particular levels as may be desired.

Figure 3:
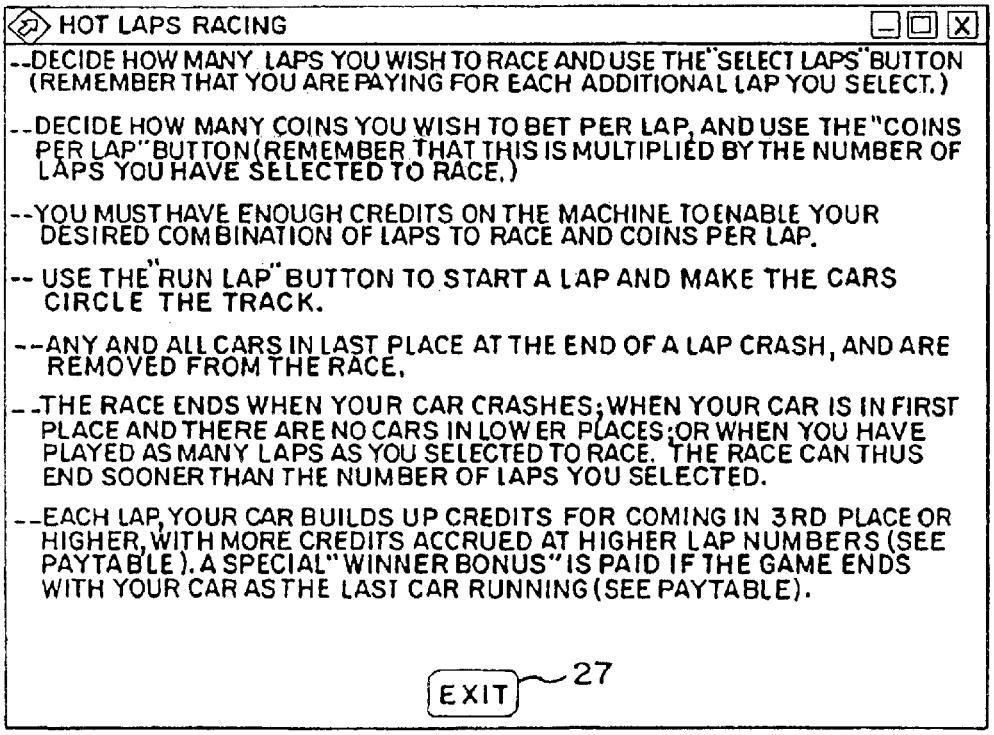
FIG. 3 is a "Help" screen from a video display of an embodiment of the invention.

The general rules of the game may be displayed by pressing the "Help" button 25. Pressing the "Help" button 25 will show the screen display in FIG. 3. The "Exit" button 27 returns the player to the game.

The player's bet is on a particular one of the cars 20*a–h* that begin the race. In FIGS. 1 and 2, this bet is on the car 20*a* at the top of the group. The player's car contains the racing stripe and number identification to help identify it to the player.

The player may press the "Pick Your Car" button 26 to move the car selection to a different car. Each time this button 26 is pressed, this embodiment has the selection process progressing going downwardly, placing the racing stripe on the newly selected car.

Figure 4:
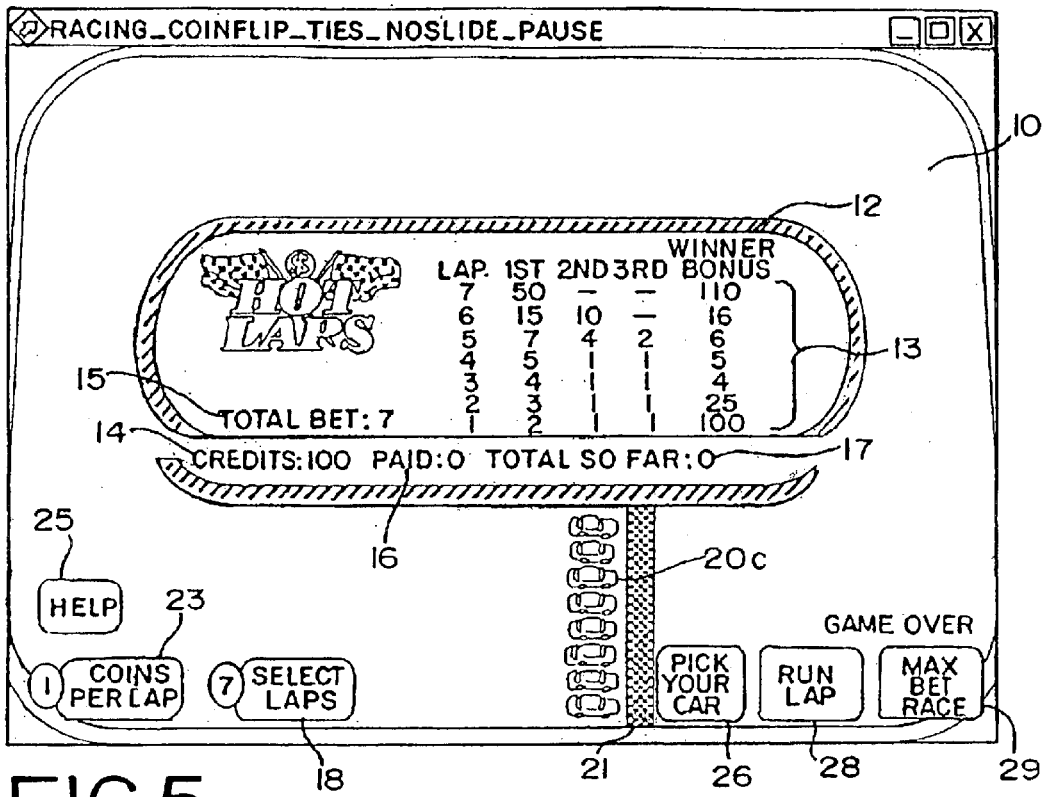
FIGS. 4 through 12 are other screens from a video display showing an embodiment of the invention.

FIG. 4 shows the video screen after the third car from top 20*c* has now been selected, instead of car 20*a*. The "Coins Per Lap", "Select Laps" and "Pick Your Car" buttons 23, 18, and 26 are displayed and available only between multi-stage games in this version.

To start the race, the player presses the "Run Lap" button 28. The "Max Bet Race" button 29 is provided as a single button solution to setting "Select Laps" 18 to "7", setting "Coins Per Lap" 23 to "5" and pressing the "Run Lap" button 28.

Figure 5:
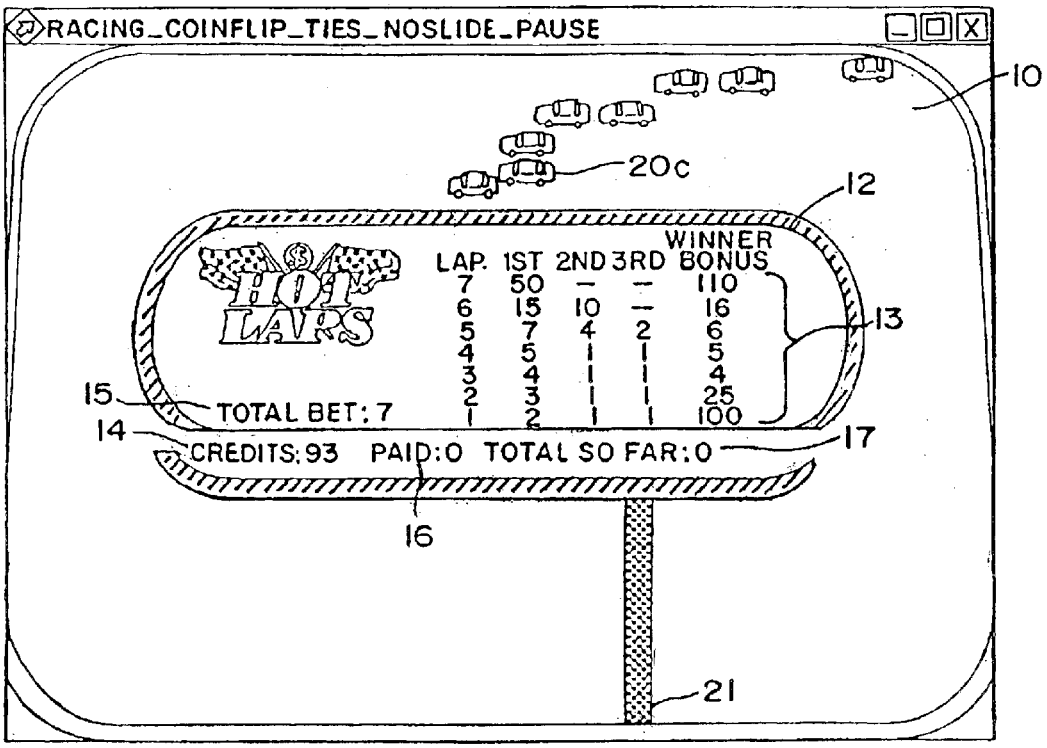

Once the "Run Lap" or "Max Bet Race" buttons 28, 29 have been pressed, an animated sequence shows the cars 20*a–h* racing counter-clockwise around the track 10 for the first lap of the game. FIG. 5 shows the first lap of the game in progress, with the player's selected car (with stripe and number) in second position at this time. The programming for the animated movement of the cars is well within the skill of those who design these types of games.

Figure 6:
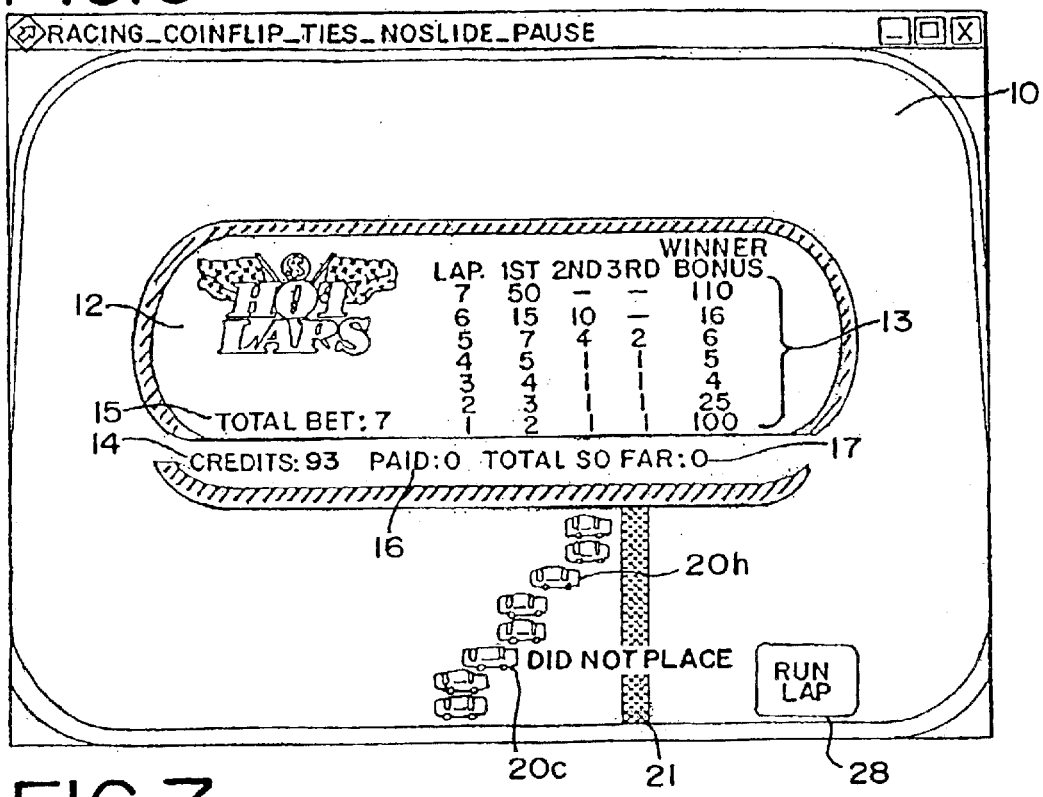

FIG. 6 shows the finish of the first lap. The top two cars (i.e., closest to the infield 12) shown in FIG. 6 tied for first place. In many sports type of rankings, after a two-way tie for 1st, the next finisher would be considered third place. In this particular embodiment, ties are not handled in this manner. Any number of cars may tie for a finishing rank, and cars that finish in the next closest position are given the next lower finishing rank. Using this methodology, FIG. 6 has one car in second place (20*h*) and a two-way tie for third place. The player's car 20*c* is alone in fourth place, and there is a two-way tie for fifth place, which in this case is last place.

Looking at the paytable 13 shown on the infield 12 of the track 10 (FIG. 6), it can be seen that on each lap only the first three places are paid; there is no award for the player's fourth place finish (causing the legend "Did not place" to be shown on the screen in FIG. 6). Therefore, the "Total So Far" meter 17 still shows "0" at the end of the first lap.

Figure 7:
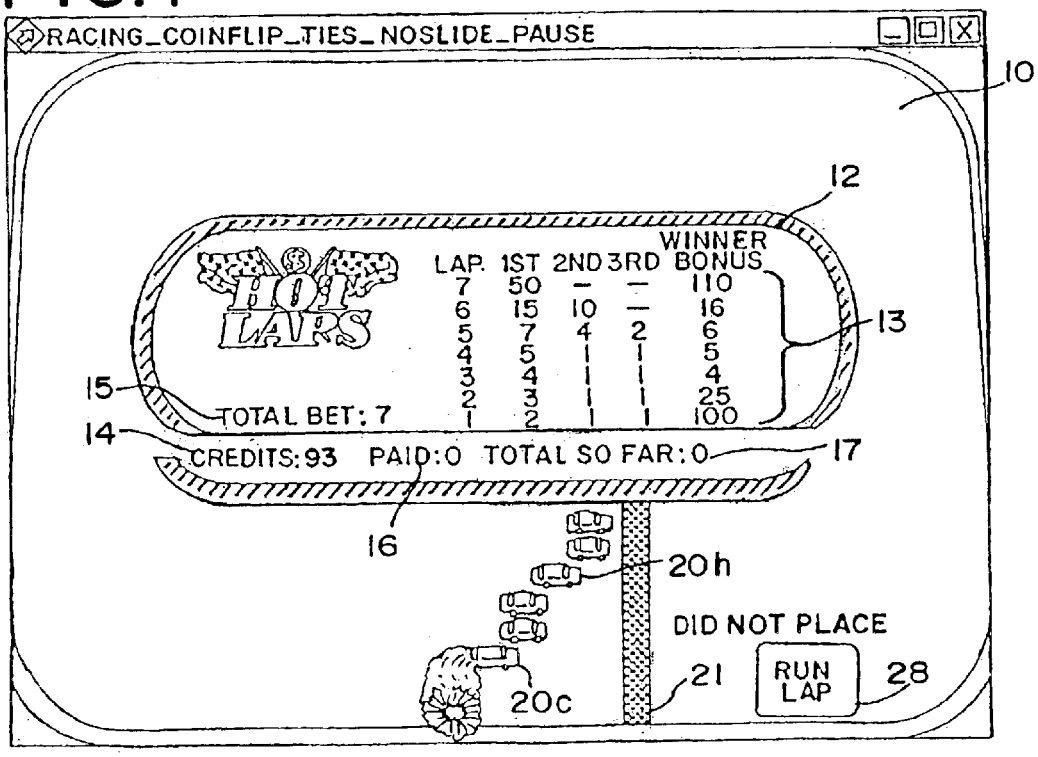

At the end of every lap, one or more cars will "crash", blow up or otherwise be eliminated from the race in this version. Any car that is in the horizontally furthest position from the finish line (going right to left in FIG. 6, the two cars that finished in fifth place) will explode and be eliminated from the race, as shown in FIG. 7. This mechanism of exploding one or more cars in last place at the end of each lap causes many games to end before all stages are played (sometimes because the player's car blows up, and sometimes because a sufficient plurality of cars blow up on a single lap, for reasons to be revealed below). Of course, other protocols could be used to end the game before all stages are played without departing from the invention. An example of such a protocol would be the random elimination of a car or cars through a staged crash, perhaps not on every lap, but with the game ending when only three cars remained, for instance. Alternatively, rather than eliminating cars, the multistage racing game could be constructed in a manner where every stage was always played, such as a multi-lap game where the player was only paid for each lap that he or she finished in first place. The present embodiment is built upon the destruction of cars as the laps progress, however, since this adds an interesting and exciting dimension to the play of the game, along with the loss of wagers on stages which are not played.

As can be seen on the paytable 13, at each stage the player is paid for a first, second or third place standing. The fourth place finish on the first lap for the player's car does not result in a payout for that lap as noted above, but in this case since the player's car did not finish in the last position (and was therefore not blown up), the player may continue to play subsequent lap(s) for which a wager was placed. Had the player finished in last place, the game would have been over and the wagers made on laps two through seven would have been lost without those laps having been played.

It is worth digressing at this point to make it clear that the game could be constructed in a manner to pay for more or fewer finishing places, as well as for a different number of finishing places on different laps, without departing from the invention. It should also be understood that other awards could be offered based on the outcome of the different laps, or combination of laps. For example, a bonus for a four-way tie on a lap or a bonus for completing each lap in first position could be provided. In this embodiment there is a bonus for being in first position at the very end of the race (i.e., the final surviving car), which is shown in the fifth column of the paytable under the heading of "Winner Bonus". Note that this bonus is a different amount on different laps of the game based on the likelihood (or lack thereof) of winning on that lap. So too, it should be noted that while this embodiment has an initial wager placed by the player as to a selected number of laps the player hopes to play, which is in keeping with the multi-stage game concept noted in the co-pending application of the inventors herein, the race game described and claimed herein is in and of itself considered to be novel. The manner of wagering upon the game therefore need not be restricted just to that described with this embodiment, just as there need not be any wagering attendant to the game at all in other environments.

Figure 8:
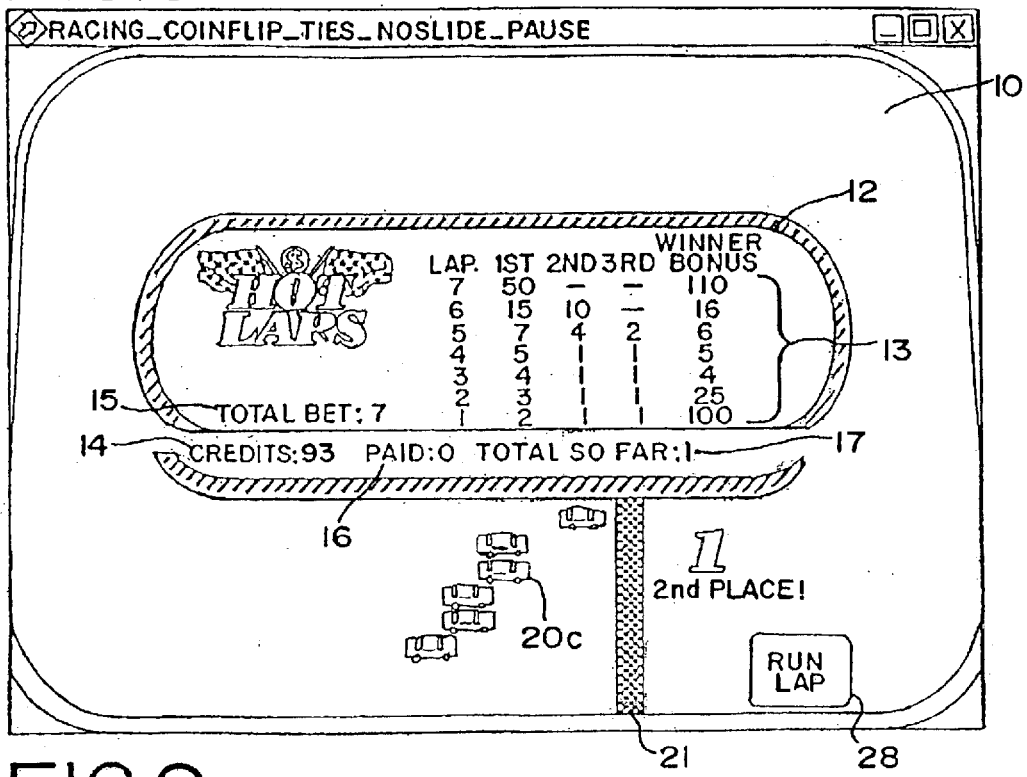

Returning now to the game at hand, the player presses the "Run Lap" button 28 to cause the next lap to operate (here, lap two), and one possible result is shown in FIG. 8. FIG. 8 shows a single car in first place, a two-way tie for second place (including the player's car 20*c*), a two-way tie for third place, and a single car in fourth place. As seen in the paytable 13 in FIG. 8, the player wins one coin for finishing in second place in the second lap. This value is highlighted in the paytable, and now the "Total So Far" meter 17 shows "1".

The fourth place car (in FIG. 8) will explode, leaving a field of five cars remaining (eight cars that started the race, less the two cars that were eliminated after the first lap, less the one car that was eliminated after the second lap). It should be noted that at this point the maximum number of laps that may occur on this particular multi-lap game is six. This is because if only a single car were eliminated in each of the third, fourth, fifth and sixth laps, then the remaining car would be the "winner" at the end of the sixth lap. If multiple cars were eliminated in any of these laps, then the game would end in less than six laps. It should be clear that the only way for the game to run the full seven laps is for exactly one car to be eliminated on each lap. Since in this embodiment the game ends once the player's car has been eliminated, then the race game will only run the full seven laps if the single car that is eliminated in each lap is not the player's car.

Figure 9:
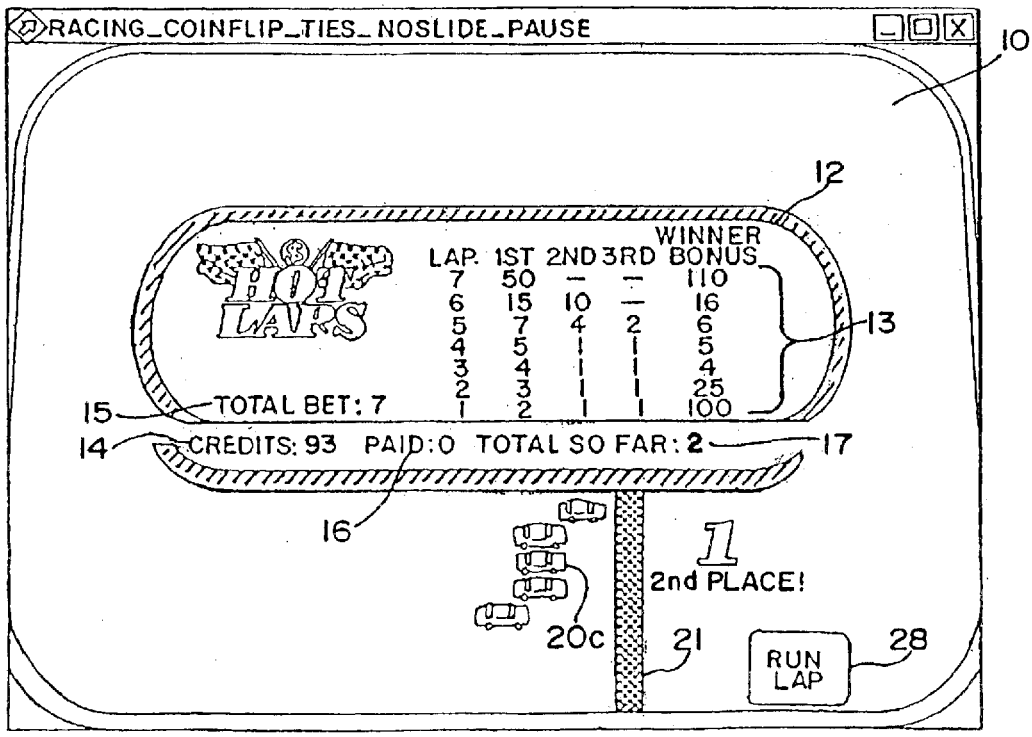

Once more returning to the game underway in this first illustrative embodiment, the player presses the "Run Lap" button 28 to send the cars around the track for the third lap. FIG. 9 shows a possible result of the third lap. FIG. 9 has one car in first place, a three-way tie for second place including the player's car 20*c*, and a single car in third place. The player wins one coin for finishing in second place on the third lap. The "Total So Far" meter 17 is updated to show the "2" credits that have been won to this point ("0" credits in lap 1, "1" credit in lap 2 and "1" credit in lap 3). The single car finished in third place explodes leaving a field of four cars for the fourth lap. If the player's car had finished in last place, the game would be over and the player's bets on laps four through seven would be lost without running those laps.

Figure 10:
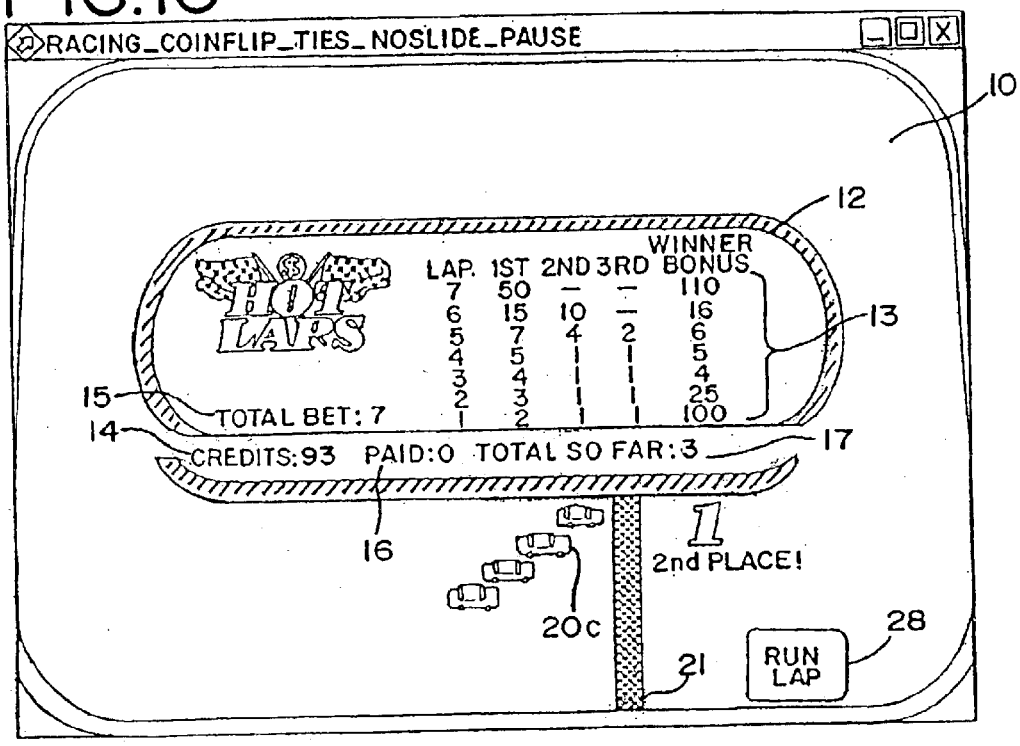

The player again presses the "Run Lap" button 28, and FIG. 10 shows a possible result at the end of the fourth lap. Each of the four cars finishes in its own position (no tie) with the player's car finishing in second place. The player receives one credit for finishing in second place in the fourth lap as can be seen on the paytable 13 in FIG. 10. The "Total So Far" meter 17 is updated to "3" credits to include the credit won in the fourth lap. The single last place car will explode, now leaving three cars remaining for the fifth lap.

Figure 11:
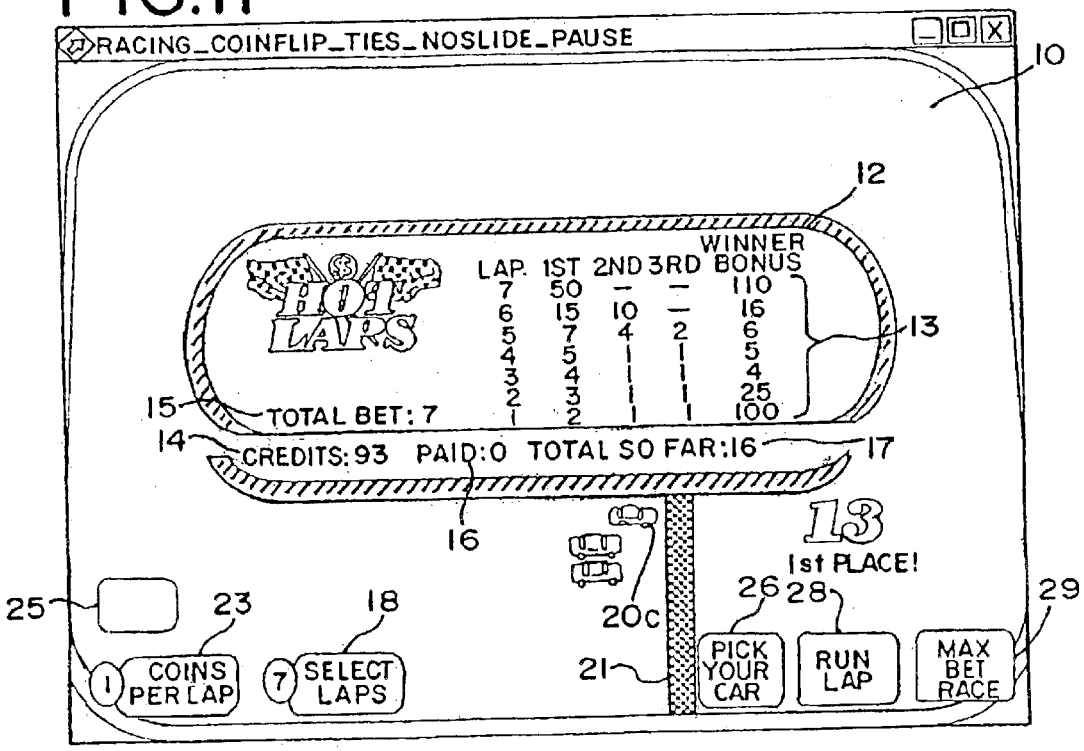

The "Run Lap" button 28 is again pressed, and FIG. 11 shows a possible result. The player's car 20*c* finishes alone in first place with a two-way tie for second place. The two last place cars will explode, and the player has won the race. As can be seen from the paytable in FIG. 11, the player receives seven credits for finishing the fifth lap in first place. The paytable also shows that the player receives an additional six credits for winning the race (being the last car left) in the fifth lap. This is a thirteen coin win on the fifth lap which is added to the three coin "Total So Far" meter 17 for a total win of "16" as seen in FIG. 11.

Figure 12:
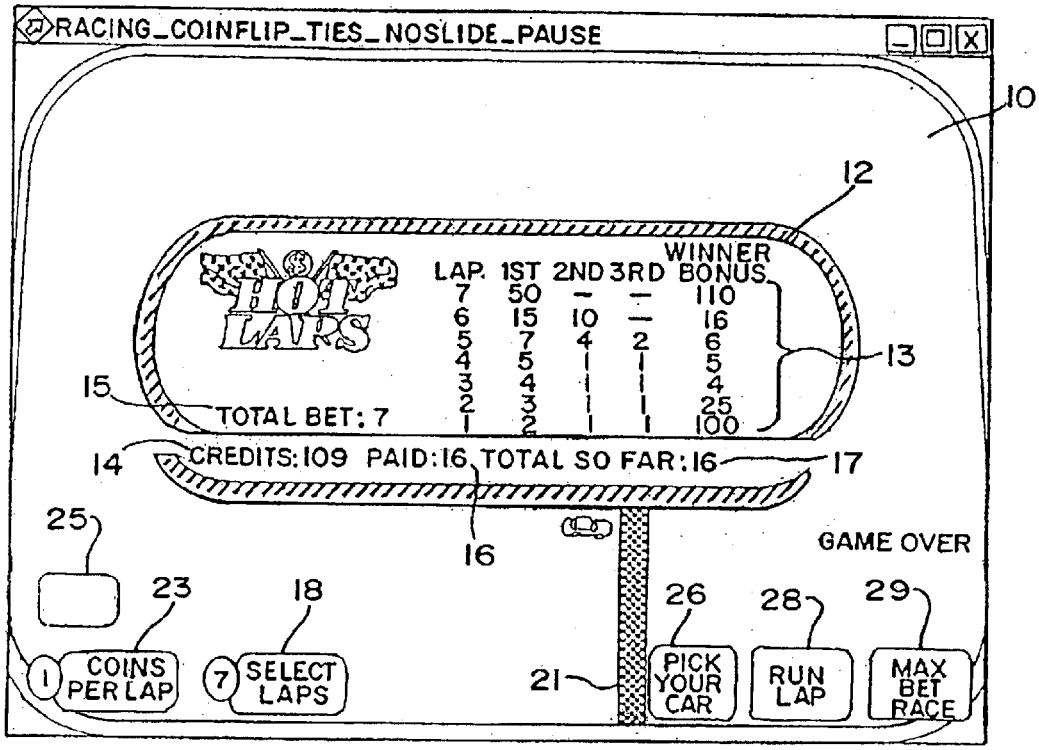

FIG. 12 shows the "Total So Far" meter 17 copied to the "Paid" meter 16 at the end of the game and then added to the "Credits" meter 14. By being the last racer remaining in the fifth lap, the game is over without the play of the sixth or seventh laps, which had received a wager. This early end was the result of losing two cars in both the first and fifth laps. The "Winner" column of the paytable reflects the fact that a player is more likely to "win" in the third, fourth or fifth lap and less likely to "win" in a higher or lower lap. It is harder to win in a higher lap because in addition to staying alive at every level, it is also required that fewer (or no) cars tie for last place. It is harder to "win" in the lower (early) laps because it is unlikely to lose that many extra cars in so few laps.

Had the player only bet on five laps on this game (five coins, at one coin per lap) the win would have been the same (sixteen credits). Had the player only bet on four laps, then only three coins would have been returned. In the unplayed stages, the player loses the bet for those stages when a stage is not played. The lower stages are played more often than the higher stages, which is offset by higher rewards on the higher levels when they are played.

Figure 17:
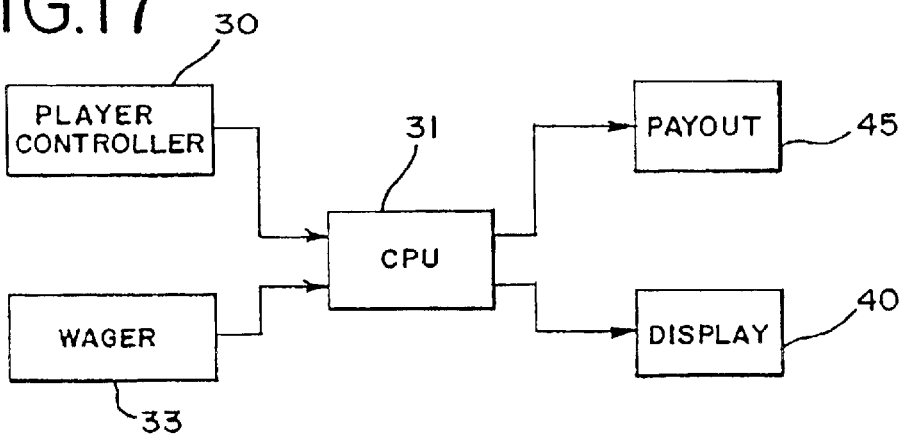
FIG. 17 is a schematic diagram of certain components of a system used in accordance with the invention.

FIG. 17 schematically shows the principal components of the system described above. These are the central processing unit (cpu) 31, which receives input from a player controller interface mechanism 30 (i.e., the various buttons, touchscreen, pointing device, etc., referenced herein), a separate wager input mechanism 33, such as a bill/coin receiver (not shown), a pay out mechanism 45, and a video display 40. The payout mechanism 45 is operated by the cpu 31 and yields the credits (coins) earned, with the payout mechanism 45 being any of a variety available in the art. The video display 40 provides the screens and other visual output generated by the cpu as herein described.

Figure 13:
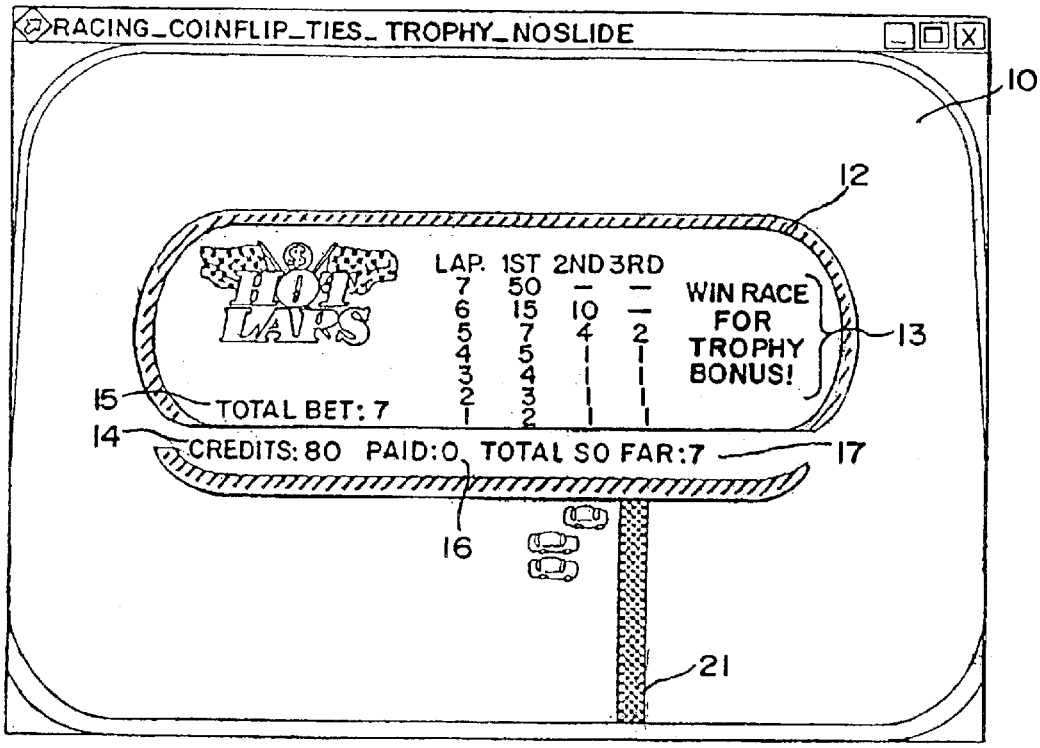
FIG. 13 is a screen from a video display showing a slightly modified embodiment of the invention.

FIG. 13 shows a game in progress in a variation of the foregoing embodiment. In this variation, instead of receiving a fixed award for winning a race (the fifth column (left to right) of the paytable 13 in FIG. 12) the player is shown another screen where a "Trophy Bonus" is selected. FIG. 13 shows the player winning the race in the sixth lap (having been preceded by a second, "didn't place," third, second and second on the first five laps). Looking at the lap six paytable 13 in FIG. 13, it is seen that first place awards fifteen coins. The paytable also shows that winning the "Race" awards the "Trophy Bonus".

Figure 14:
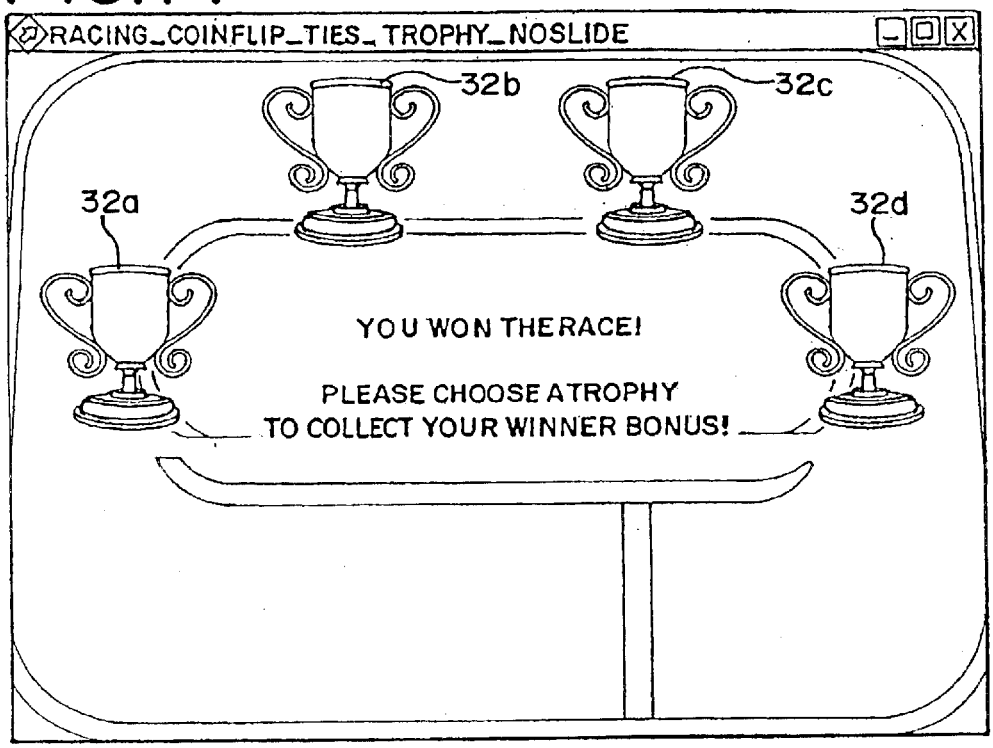
FIGS. 14 and 15 are screens for a "Trophy Bonus" aspect of the invention.

When the player is the last remaining car, the player is taken to the "Trophy Bonus" segment shown in FIG. 14. In the "Trophy Bonus" segment of this embodiment, there are different coin values associated with each of the four trophies 32*a* through 32*d* shown on the screen. The player selects one of the trophies (using a touchscreen, mouse or other pointing device, for instance), and wins that trophy's value, which is added to the "Total So Far" meter 17 (e.g., FIG. 13).

Figure 15:
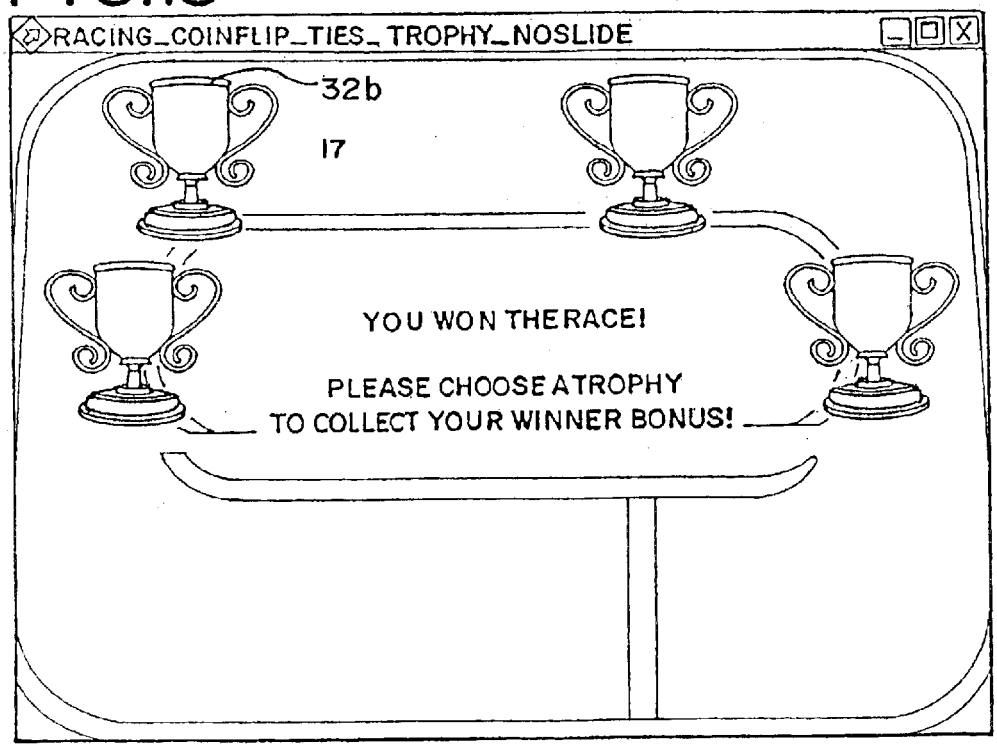

FIG. 15 shows the video display 40 after the second trophy 32*b* has been selected. The trophy is moved off to the side revealing a "17" coin award for winning the race. The values stored behind the other three trophies are revealed to the player (not shown in this screen), and the video display 40 is switched back to the race.

Figure 16:
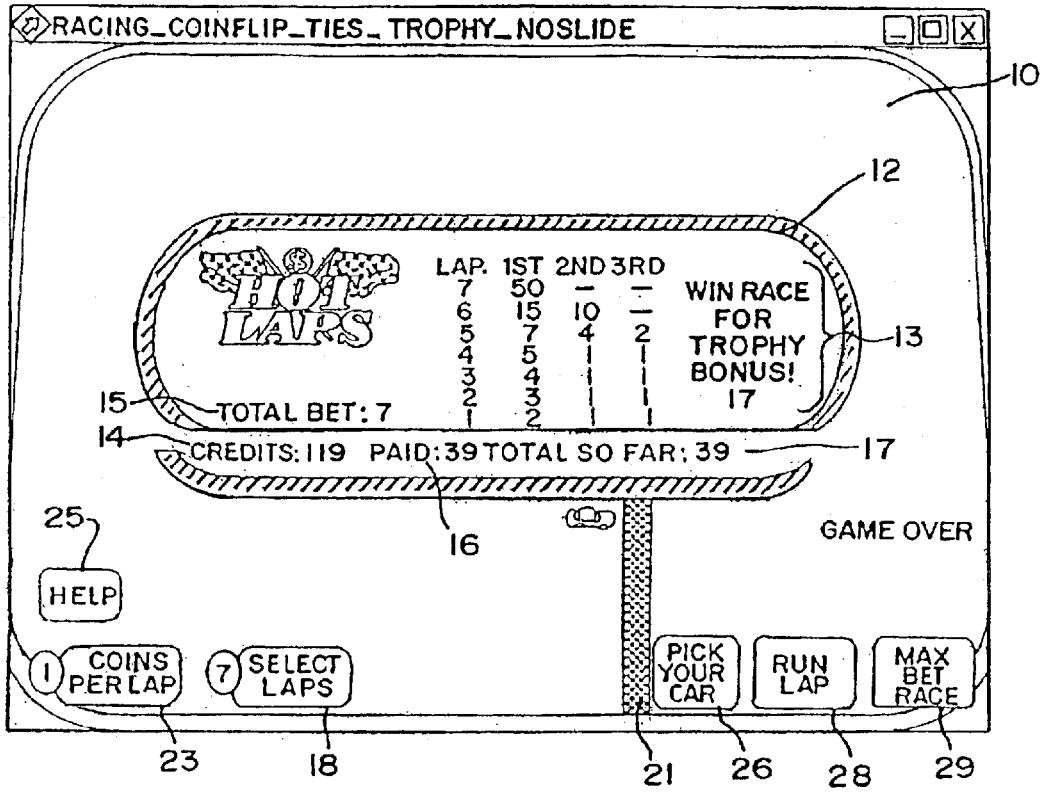
FIG. 16 is another screen from the embodiment of FIG. 13.

FIG. 16 shows the sixth lap total of thirty-two coins (fifteen for finishing the sixth lap in first place (see paytable 13) plus seventeen awarded as the trophy bonus) being added to the seven coins won in the previous laps. The total win for this game of "39" coins is registered in the "Total So Far" meter 17, and derived as shown below:

| Lap | Place | Coins This Lap | Accumulated Coins |
|---|---|---|---|
| 1 | 2nd | 1 | 1 |
| 2 | Did not Place | 0 | 1 |
| 3 | 3rd | 1 | 2 |
| 4 | 2nd | 1 | 3 |
| 5 | 2nd | 4 | 7 |
| 6 | 1st | 32 | 39 |

Mathematical Analysis of the Racing Game

There are many mathematical mechanisms that may be used to model the progress of the cars from lap to lap. In one of the preferred embodiments, the progress of each car is stategically determined from a weighted table as will be shown below. The lap to lap progress of each car is modeled in a linear form that could be most easily understood by thinking of an eight player Cribbage Board. That is, consider eight vertical lanes of peg-holes drilled in a wooden board, with a peg representing each car at the lowermost hole in each lane. On each lap, based on a weighted random table, each car will move up between one and six positions on the board. On each subsequent lap, the car will move from its position at the end of the previous lap. For each lap, once the new positions have been determined by the game (on the game's "internal Cribbage Board" for clarity and analogical continuity), the cars are made to race around the track with the lead car (or cars) stopping with its nose on the finish line and the other cars being placed behind the lead car in a position corresponding to its distance ("internal Cribbage Board") behind the lead car.

Table 1 shows the weighted values used for the cars in this illustrative embodiment to determine how far they will advance each lap. Each row of the table contains twenty-four entries which are selected by drawing a uniformly distributed random number from zero to twenty-three. On the first lap of a game, each car draws a random number from zero to twenty-three and looks up the corresponding value in Row 1 of the table. Row 1 provides an equal probability for any of the values one to six to be selected.

As described earlier, each car will move forward its selected number of positions on the analogous "Cribbage Board" with their final relative positions being shown in the finish of the animated lap of the race.

TABLE 1

| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | Random Index |
|---|---|---|---|---|---|---|---|---|---|---|---|---|---|---|---|---|---|---|---|---|---|---|---|---|---|
| Row 1 | 1 | 1 | 1 | 1 | 2 | 2 | 2 | 2 | 3 | 3 | 3 | 3 | 4 | 4 | 4 | 4 | 5 | 5 | 5 | 5 | 6 | 6 | 6 | 6 | |
| Row 2 | 1 | 1 | 1 | 1 | 1 | 1 | 1 | 1 | 1 | 1 | 1 | 2 | 2 | 2 | 2 | 2 | 2 | 2 | 3 | 3 | 3 | 4 | 5 | 6 | |
| Row 3 | 1 | 1 | 1 | 1 | 1 | 1 | 2 | 2 | 2 | 2 | 2 | 2 | 2 | 3 | 3 | 3 | 3 | 3 | 3 | 3 | 4 | 4 | 5 | 6 | |
| Row 4 | 1 | 1 | 1 | 2 | 2 | 2 | 2 | 2 | 2 | 2 | 3 | 3 | 3 | 3 | 3 | 3 | 3 | 4 | 4 | 4 | 5 | 5 | 5 | 6 | |
| Row 5 | 1 | 1 | 2 | 2 | 2 | 3 | 3 | 3 | 3 | 3 | 3 | 3 | 4 | 4 | 4 | 4 | 4 | 4 | 4 | 4 | 5 | 5 | 5 | 6 | |
| Row 6 | 1 | 2 | 2 | 2 | 3 | 3 | 3 | 3 | 4 | 4 | 4 | 4 | 4 | 4 | 4 | 4 | 5 | 5 | 5 | 5 | 5 | 5 | 6 | 6 | |
| Row 7 | 1 | 2 | 3 | 3 | 3 | 3 | 4 | 4 | 4 | 4 | 4 | 4 | 5 | 5 | 5 | 5 | 5 | 5 | 5 | 6 | 6 | 6 | 6 | 6 | |
| Row 8 | 1 | 2 | 3 | 3 | 4 | 4 | 4 | 5 | 5 | 5 | 5 | 5 | 5 | 5 | 5 | 6 | 6 | 6 | 6 | 6 | 6 | 6 | 6 | 6 | |

Starting with the second lap, each car begins the lap in its position (on the internal "Cribbage Board") where it ended the previous lap. Each car chooses a row from Table 1 independently from the following formula:

Table 1 Row number="Position in last lap"+1

The position number is the place that the car finished the last lap in. This position numbering uses the same position calculation that is used for determining place on the paytable. For example, at the end of the first lap in FIG. 7, there are two cars in position 1 (tied for first), a single car in position 2, a two-way tie for position 3, and a single car in position 4 (the player's car). From the equation above, the two cars that tied for position 1 would compute the row number as 1+1=2. The cars in position 1 would each get their weighted numbers from Row 2 of Table 1. The car in position 2 would compute row number 2+1=3. The two cars in position 3 in FIG. 7 would each get their weighted numbers from Row 4 of Table 1. The single car that finished in fourth position in FIG. 7 would compute row number 4+1=5. This car would use Row 5 of Table 1.

In Rows 2 through 8 of the Table 1 (which are the rows used after the first lap) the higher the row number, the higher the Expected Value (see Table 2). As can be seen from the above example, the higher the position (i.e., the farther behind), the higher the Expected Value of the number drawn from Table 1 (Expected Value has a common and well known connotation in the industry, but further explanation can be gleaned from the co-pending application of the inventors herein, referenced above). This strategy tends to keep the cars more tightly clustered, and gives the cars that are behind a reasonable chance to get back into the race. The clustering effect, in addition to making the races more exciting, makes it more likely that multiple cars will be eliminated as a result of finishing tied for last place. This makes it harder to get to the later (higher) stages, which allows for larger awards at these stages. While the use of the weighted table in the preferred embodiment makes the game more interesting than allowing every car to use the same advancing scheme, the game could be designed with cars using the same advancing scheme or other varied advancing schemes without departing from the invention.

Through experimental analysis, it was found that if the Expected Values of Rows 2 through 8 have a tighter spacing (giving the cars that are behind less of an advantage), the result is there are less multiple crashes, and it is thereby easier to reach and win the higher stages. Conversely, with a looser spacing of the Expected Values of Rows 2 to 8, the trailing cars have a better chance of catching up and there are more crashes, which makes it harder to reach and win the higher stages. It is the altering of the weighted numbers in Table 1 that is used to adjust the frequency of the highest awards in the game.

TABLE 2

| | Expected Value |
|---|---|
| Row 1 | 3.50 |
| Row 2 | 2.04 |
| Row 3 | 2.50 |
| Row 4 | 2.96 |
| Row 5 | 3.42 |
| Row 6 | 3.88 |
| Row 7 | 4.33 |
| Row 8 | 4.79 |

Given the rules or protocols presented so far, an issue is presented as to what the outcome should be when all cars left in a race finish in a tie. One embodiment would dictate that all of these cars are in last place and they all explode and no payment is made to the player. This is consistent with the behavior when the player's car finishes last in second or third place where the car explodes and no coins are awarded. Another alternative embodiment could rerun the lap with the cars starting in the tied position. In the preferred embodiment, an adjustment is made internal to the game logic before showing the results of a lap where all cars have tied. A random number is drawn, and 50% of the time (based on the draw of the random number) the player's car is moved back so that the player is eliminated after the animation runs the cars to the finish line. The other 50% of the time a different car is moved back. This is a fair resolution of a two-way tie for first and gives the player a disadvantage in a three-way or higher ties. This is offset by higher awards for winning. In the multi-player version of the game suggested above (different players betting on different cars) these ties would be resolved by a fair draw, since there is no longer a single "player" car. Other methods could be used to break this "all cars tie" situation.

The paytables for this game have been created by using experimental trials to determine the frequency of each pay. Using a computer simulation well within the skill of the art, the game was played three billion times while monitoring the number of times each of the paytable values is awarded and the number of times the game ends on each stage. These numbers so derived are shown in Table 3. The columns of Tables 3 through 6 headed by "1st" through "Winner" represent the paytable events that are being used for these calculations.

TABLE 3

| | Occurrences | | | | | | |
|---|---|---|---|---|---|---|---|
| Lap | 1st | 2nd | 3rd | Crash | Winner | Did Not Place | Laps Run at This Stage |
| 7 | 0 | 0 | 0 | 17645393 | 17651172 | 0 | 35,296,565 |
| 6 | 22951014 | 12345551 | 0 | 99229892 | 74679709 | 0 | 209,206,166 |
| 5 | 122273276 | 77560436 | 9372454 | 259711887 | 127364424 | 0 | 596,282,477 |
| 4 | 298275033 | 229833091 | 62717193 | 434180139 | 105475911 | 5457160 | 1,135,938,527 |
| 3 | 457302213 | 438155916 | 200510690 | 557229217 | 40020341 | 39969708 | 1,733,188,085 |
| 2 | 545693976 | 636436519 | 410155767 | 588852257 | 4986588 | 140901823 | 2,327,026,930 |
| 1 | 672899272 | 669532568 | 600509681 | 672945923 | 27147 | 384085409 | 3,000,000,000 |

Each of the occurrence counts from Table 3 is divided by the fixed three billion game count to result in the probability of that that particular result. Table 4 shows the probability of each of the events shown in Table 3.

TABLE 4

| | Probability | | | | | |
|---|---|---|---|---|---|---|
| Lap | 1st | 2nd | 3rd | Crash | Winner | Did Not Place |
| 7 | 0 | 0 | 0 | 0.0058818 | 0.005883724 | 0 |
| 6 | 0.00765034 | 0.00411518 | 0 | 0.03307663 | 0.024893236 | 0 |
| 5 | 0.04075776 | 0.02585348 | 0.00312415 | 0.08657063 | 0.042454808 | 0 |
| 4 | 0.09942501 | 0.07661103 | 0.02090573 | 0.14472671 | 0.035158637 | 0.00181905 |
| 3 | 0.15243407 | 0.14605197 | 0.0668369 | 0.18574307 | 0.013340114 | 0.01332324 |
| 2 | 0.18189799 | 0.21214551 | 0.13671859 | 0.19628409 | 0.001662196 | 0.04696727 |
| 1 | 0.22429976 | 0.22317752 | 0.20016989 | 0.22431531 | 0.000009049 | 0.12802847 |

Table 5 shows the paytable values for each event for which occurrences were counted in Table 3. In Table 5, the paytable has been modified to be in the same format as Tables 3 and 4. In Table 3, when a player wins a race, an occurrence is marked in the Winner column but not the first place column in order to better track the results. It should be noted that when the player wins the race, there is a pay for the first place award in addition to the Winner bonus. Therefore the Winner column of Table 5 combines the pay amounts for first place and winning on the given lap. By multiplying each of the event probabilities in Table 4 by its corresponding paytable value shown in Table 5, one arrives at the Expected Value Table 6.

In this multi-stage embodiment, the return is computed independently on each stage. As seen in Table 6, the Expected Value components on each stage are added up to provide the expected return for the stage. Specifically, in Table 6, the first column shows the stage (lap) number. The second though sixth columns show the Expected Value (EV) of the pay on that stage (using the corresponding pay from Table 5). The seventh column (EV of Lap) is the sum of the second through sixth columns and provides the expected return of the stage as a fraction of one coin. The eighth (rightmost) column (EV of Game) shows the Expected Return of an entire multi-stage game with a bet on the number of stages shown in the first column. It is the average of the seventh column numbers from the current and all previous stages. This shows that the expected return when all seven stages are played is 0.9293 or 92.93%. Given the frequencies of hits shown in Table 3, which are a direct result of the values in Table 1, the most straightforward way to modify the payout percentage is to change values in the Table 5 paytable, as is well known in the art.

TABLE 5

| | Paytable | | | | |
|---|---|---|---|---|---|
| Lap | 1st | 2nd | 3rd | Crash | Winner |
| 7 | 50 | 0 | 0 | 0 | 160 |
| 6 | 15 | 10 | 0 | 0 | 31 |
| 5 | 7 | 4 | 2 | 0 | 13 |
| 4 | 5 | 1 | 1 | 0 | 10 |
| 3 | 4 | 1 | 1 | 0 | 8 |
| 2 | 3 | 1 | 1 | 0 | 28 |
| 1 | 2 | 1 | 1 | 0 | 102 |

TABLE 6

| | Expected Value | | | | | | |
|---|---|---|---|---|---|---|---|
| Lap | 1st | 2nd | 3rd | Crash | Winner | EV of Lap | EV of Game |
| 7 | 0 | 0 | 0 | 0 | 0.94139584 | 0.94139584 | 0.92934512 |
| 6 | 0.11475507 | 0.04115184 | 0 | 0 | 0.771690326 | 0.92759723 | 0.927336667 |
| 5 | 0.28530431 | 0.10341391 | 0.0062483 | 0 | 0.551912504 | 0.94687903 | 0.927284554 |
| 4 | 0.49712506 | 0.07661103 | 0.02090573 | 0 | 0.35158637 | 0.94622819 | 0.922385934 |
| 3 | 0.60973628 | 0.14605197 | 0.0668369 | 0 | 0.106720909 | 0.92934606 | 0.914438517 |
| 2 | 0.54569398 | 0.21214551 | 0.13671859 | 0 | 0.046541488 | 0.94109956 | 0.906984744 |
| 1 | 0.44859951 | 0.22317752 | 0.20016989 | 0 | 0.000922998 | 0.87286993 | 0.872869929 |

For the embodiment that provides the Trophy Bonus for winning, one looks at the way in which the values for the trophies are selected. For each of the four trophies on the screen shown in FIG. 14, a random number from zero to eleven is generated. This random number is used to identify a row in Table 7. The number that is stored in Table 7 at the column corresponding to the lap number in which the game was "won" (and thereby ended) is assigned to the trophy. The average of the twelve numbers in each column of Table 7 is shown at the bottom of the table. This is the Expected Value of the Trophy Bonus selected in the trophy round for games won in that particular lap.

TABLE 7

| Random | Lap Number | | | | | | |
|---|---|---|---|---|---|---|---|
| Number | 1 | 2 | 3 | 4 | 5 | 6 | 7 |
| 0 | 50 | 25 | 4 | 3 | 4 | 10 | 50 |
| 1 | 75 | 25 | 4 | 3 | 4 | 15 | 50 |
| 2 | 75 | 25 | 4 | 3 | 4 | 15 | 50 |
| 3 | 75 | 25 | 5 | 3 | 4 | 15 | 50 |
| 4 | 75 | 25 | 5 | 4 | 4 | 15 | 50 |
| 5 | 75 | 30 | 5 | 4 | 4 | 15 | 50 |
| 6 | 75 | 30 | 5 | 4 | 4 | 15 | 50 |
| 7 | 100 | 30 | 5 | 4 | 5 | 15 | 50 |
| 8 | 100 | 30 | 5 | 5 | 5 | 15 | 100 |
| 9 | 100 | 30 | 5 | 5 | 5 | 17 | 100 |
| 10 | 100 | 50 | 10 | 6 | 10 | 25 | 200 |
| 11 | 300 | 50 | 15 | 10 | 15 | 25 | 500 |
| Avg Trophy Value | 100 | 31.25 | 6 | 4.5 | 5.666667 | 16.41667 | 108.3333 |

To factor the Trophy Bonus into the evaluation of the payout of the game, the values at the bottom of Table 7 are substituted for the fixed "Winner" values in the sixth column of Table 5. For example, the 28 coin value for being a "Winner" in the second lap shown in Table 5 (3 for first place in the second lap and 25 for winning) is replaced by 34.25, which is arrived at by adding the 3 coins for finishing the second lap in first place to the 31.25 Expected Value for the Trophy Bonus that is awarded for winning in the second lap.

The embodiment just described relates primarily to a single player game, with that game being played on a single gaming machine. The game may be adapted for multiple players in a contest, and furthermore with all of the players engaged in wagering on that contest.

Figure 18:
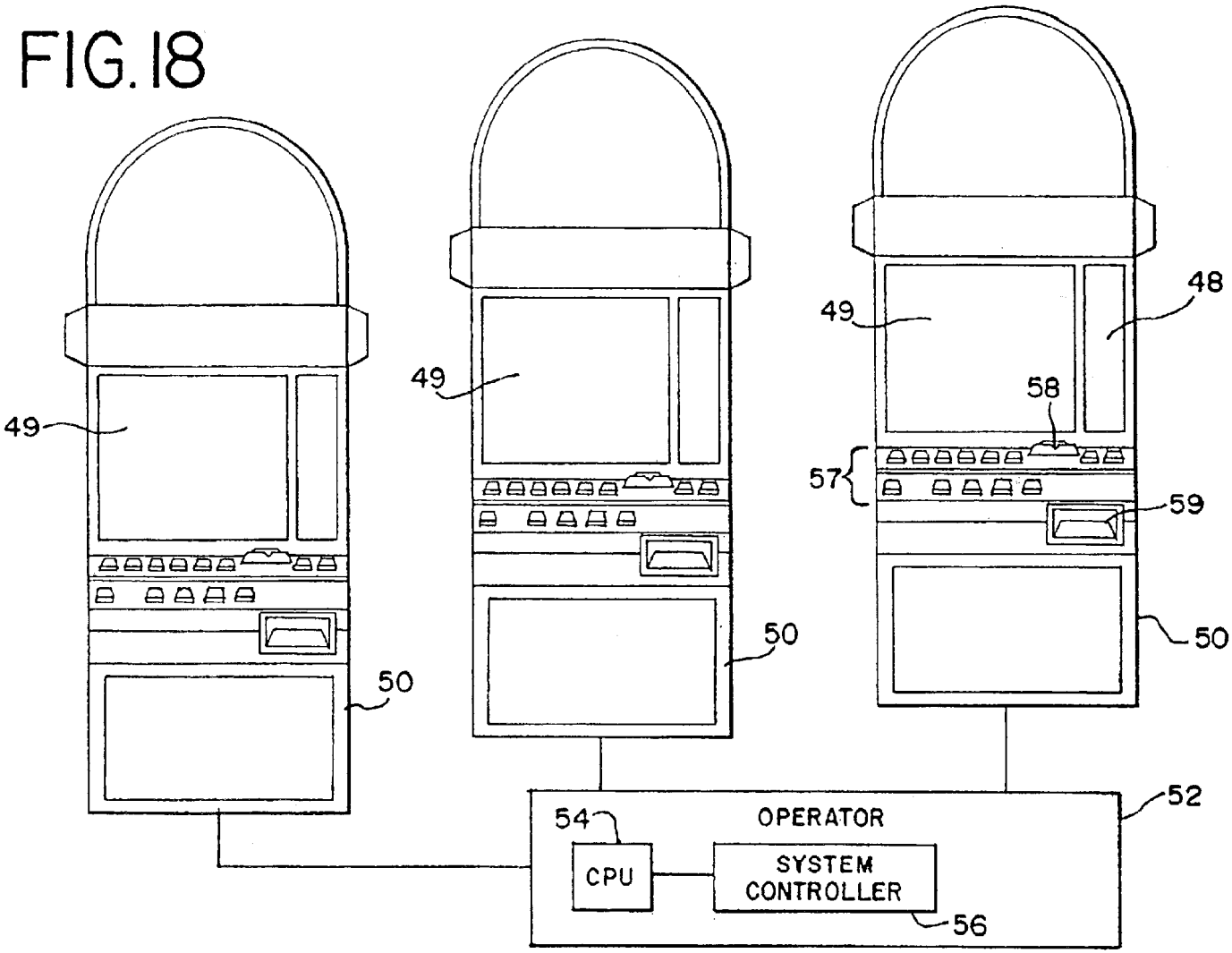
FIG. 18 is a schematic rendering of a first multi-player embodiment made in accordance with another aspect of the invention.

In this multiplayer scenario, a first variation has the players placing wagers and watching each race/level on a separate machine, preferably with its own operating mechanism (cpu, display, etc.). Referring to FIG. 18, these gaming machines 50 may be in close proximity to each other, or could be spread out over an area (such as a room of a casino), or could be anywhere (communicating through an Internet medium, for instance). The separate machines 50 can be in communication through any number of different ways, such as using any networking technology such as an ethernet, serial or parallel connections, USB, IEEE-1394, or similar intercommunicating means well known in the art, likewise using a standard modem, cable-modem, DSL, TI or other like manner of linkage.

In the embodiment of FIG. 18, each machine 50 is linked to a central operator 52, which would include a cpu 54 and an overall system controller 56. The cpu 54 and the system controller 56 coordinate the displays, operation and data transfer to and from the machines 50, so that the single race is simultaneously run on all linked machines 50. The general programming and other details of such an integrated array are considered to be well within the scope of the art, and are accordingly omitted herein for brevity. See, for instance, EP 0981119 A2, which discloses a system for linking a group of gaming machines with a central display.

The race being run in common for all participating players will be shown on each gaming machine 50 simultaneously (or substantially simultaneously). In this multiplayer variation, there will be a single machine that will be designated as the master (server), with the other participants (clients) slaved (controlled) by that master machine. Another way to do this is to have a separate master, such as the operator 52, controlling all of the machines 50 in the race being run in common.

Player input in this multiplayer version is the same as previously described; e.g., in an Internet-type environment, through use of a keyboard or mouse, in a casino environment, through use of a touchscreen, keyboard, mechanical buttons, etc. The machines 50 of FIG. 18 have mechanical buttons shown collectively in panel 57 which provide the interface for player input, including a wager input mechanism in the form of a coin receiver 58. A bill accepter is shown at 59. A video display 49 (CRT or the like) shows the game, attraction features, etc. A side video or other display 48 could have the paytable information, for example, rather than placing the same on the racecourse infield.

One modification can be some personalization provided for player input into the game. This may take the form of a player designator or "handle" input by the player for his or her car. An input screen would appear to a participant seeking a name or other designator, and the player could input the same (via touchscreen, keyboard, etc.). Alternatively, the game could read this information off of a slot club player tracking card.

Figure 19:
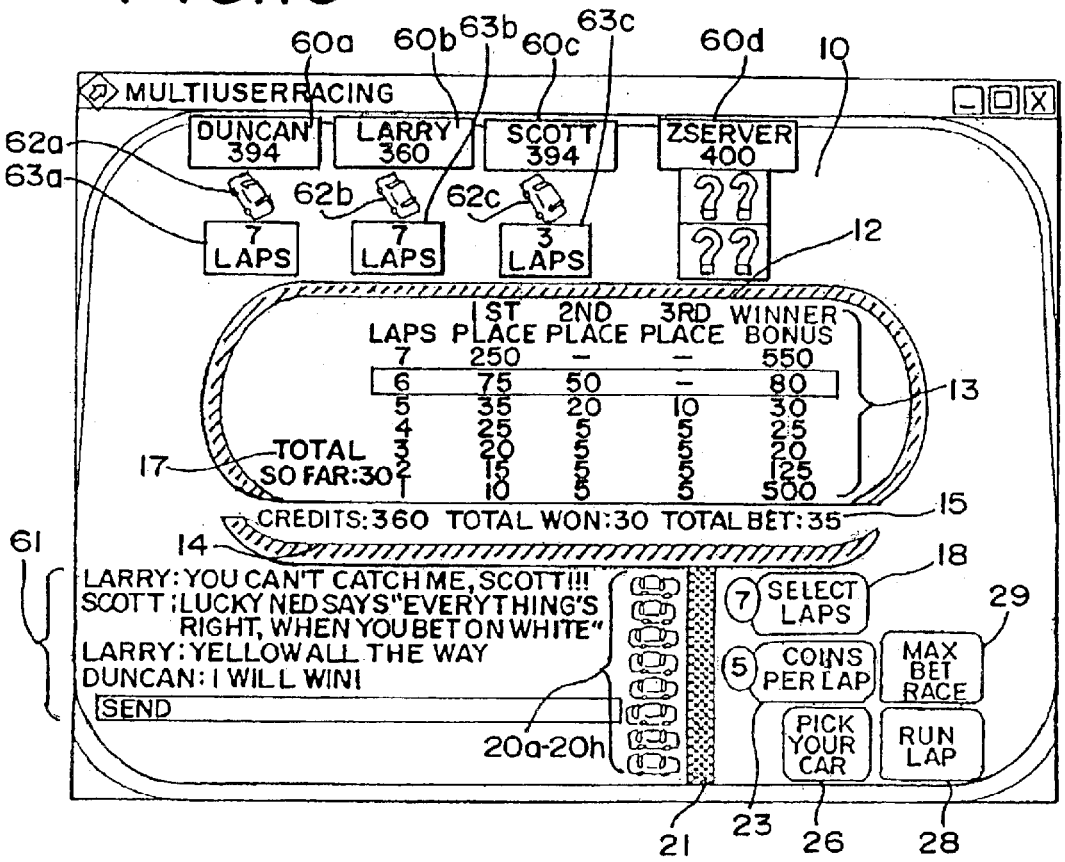
FIG. 19 is a screen from a video display of a multi-player version of the invention.

Referring to FIG. 19, an illustrative screen from a multiplayer race is shown. This variation uses touchscreen "buttons" for player input, rather than the mechanical buttons of FIG. 18. Any suitable player interface can be used, however, including combinations of mechanical, touchscreen and even other inputs.

At the upper left of the screen of FIG. 19 can be seen the participants' names 60*a* through 60*c* that have been input. At the bottom left of the screen is a "chat" window of player messages 61, again being provided via the same input mechanism as for the player-designating handle (and much like instant messaging as used on Internet systems). This "chat" window 61 will appear on the machines of all of the players, and is considered to be a nice addition to the game byplay.

The FIG. 19 machine display would appear on all machines 50 tied into the network and participating in the game. Here, three players 60*a* through 60*c* are involved. The machines 50 would have the various inputs and general operation as previously described above. In an Internet environment, wagering would typically be accomplished using a pre-established direct account, and/or use of a credit card.

Below each player's handle (e.g., 60*a*) appears an indication of the number of credits for the player, the car (62*a* through 62*c*) of the player, and the number of laps (63*a* through 63*c*) that the player has wagered upon. Since in this example only three players are participating, this embodiment has an informational window 60*d* designating the server. It will be understood that the information set forth in the foregoing windows and their arrangement is entirely discretionary with the designer, and can be entirely omitted if so desired in a particular application.

Each player will see the same, or essentially the same, display of the race being run. Differences that might be reflected could be in an individual window or meter of the credits, wager etc. of the player. The presentation shown in FIG. 19 is a "local" display tailored for a respective player. Each local display could reproduce the player's car with a stripe thereon on the local (client) machine (i.e., each player would see his/her car with a stripe, while other participants would be lacking a stripe on that local machine).

The operation of the game is generally identical to the single-player embodiment already described, with some variations. For instance, the handling of the situation where all cars in a lap finish tied is resolved differently in this multi-player version. In the single-player embodiment, it was considered acceptable to have the tiebreaker go against the player, balancing this result against a higher award for winning. With different players betting on potentially different cars, a method was considered desirable that resulted in something more symmetrically fair to all participants. The solution was to randomly choose one car to be set back a position, and the rest of the tied cars continue on to the next lap.

The start of the first race is also different in the multiplayer version. The start of the game is held up until all participants have submitted a wager, along with any other game input information required and/or permitted. A race triggering event can be the first player to hit the "Max Bet Race" button 29 or "Run Lap" button 28 upon completion of data input. A message then appears on all participants' screens that the first race is about to begin, with a timed sequence counting down to the race start. At the end of each lap, there will be a pause in this embodiment, with the next lap upon which there has been a wager being automatically run (rather than awaiting a player to press the "Run Lap" button 28).

The game ends when all of the players' cars have been eliminated, or where there has been a winner of the game, or when there is no further lap wagered upon by anyone, or some other game-ending criterion.

Figure 20:
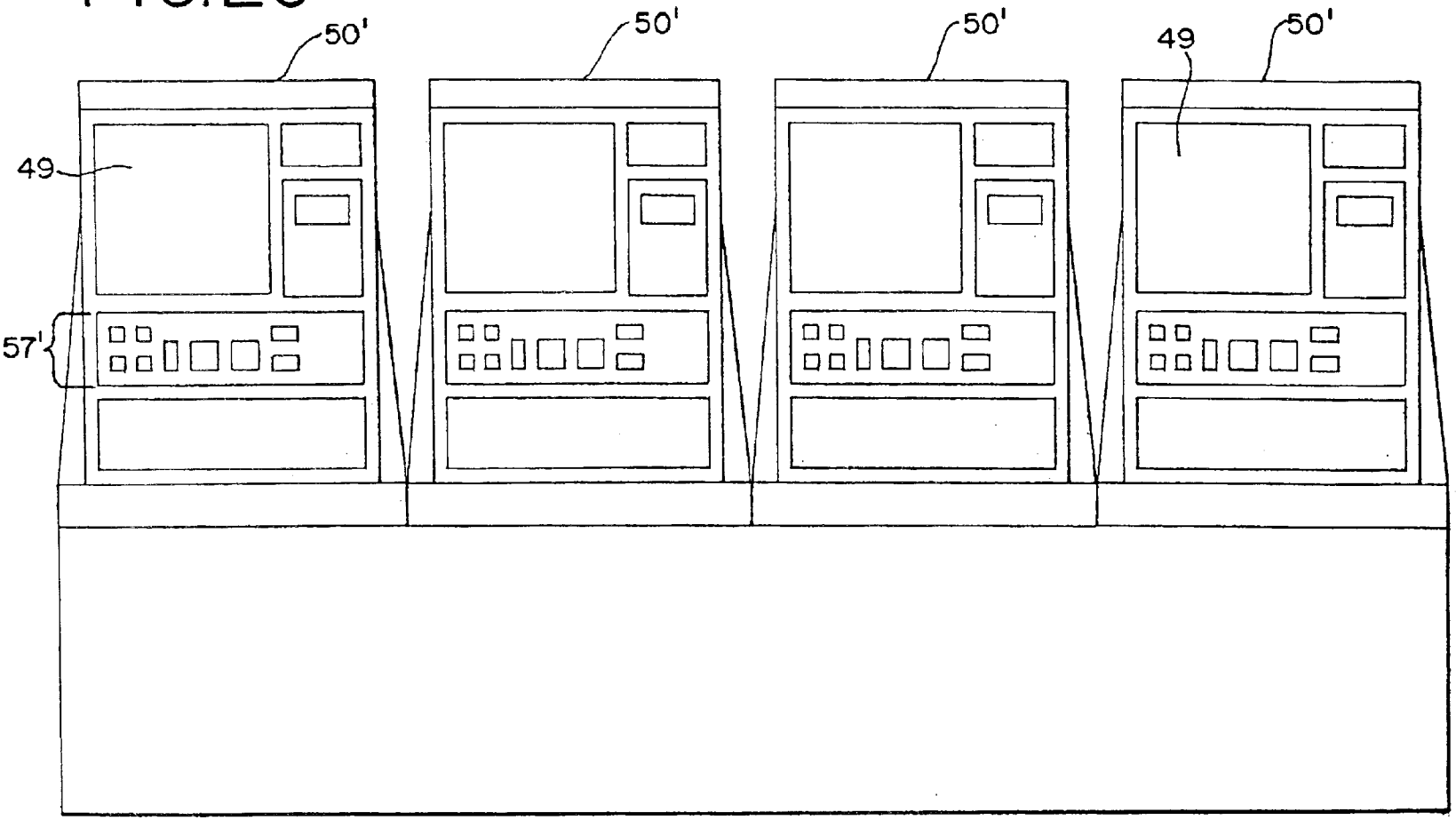
FIG. 20 is a bank of gaming machines in another multi-player embodiment.

The multi-player version (with illustrative screen display of FIG. 19) can take on a myriad of forms of machines and inter-communication systems. The FIG. 18 embodiment, for instance, can have the machines 50 scattered throughout a casino property, casino room or multiple locations. FIG. 20 shows an embodiment where the machines 50' (primed elements being similar to their unprimed counterparts) are located together in a bank of machines. Players are therefore adjacent to one another, enabling more personal interaction in the course of a race. Each has his/her own player input panel 57', with the race being shown in common on display 49.

Figure 21:
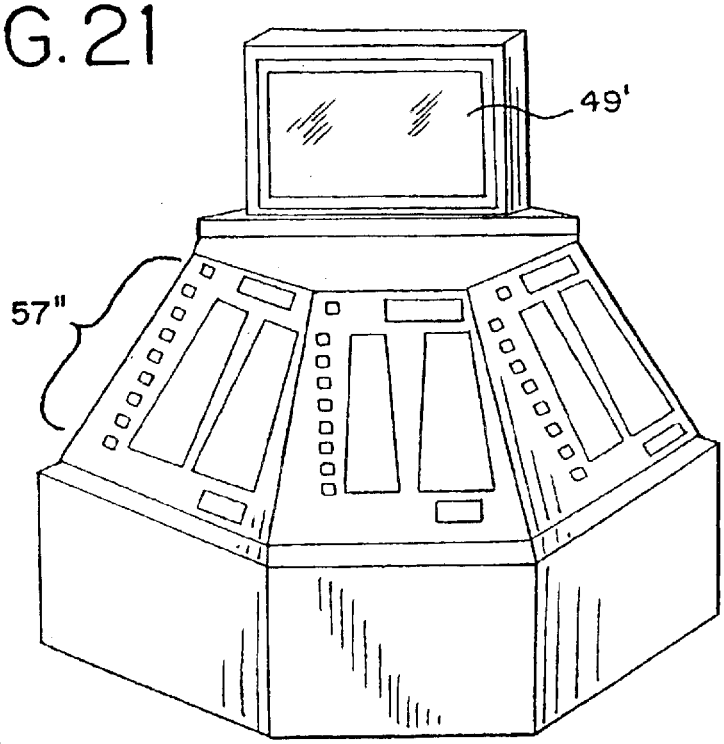
FIG. 21 is another multi-player embodiment using a kiosk-like apparatus.

FIG. 21 shows yet another embodiment for a multi-player version. In this embodiment, a single kiosk-like apparatus is employed. Each player has his/her own input panel 57", with a central video display monitor 49' provided for all to view the race upon. The embodiment of FIG. 21 would yield stations for three players on one side of display 49', and three players on the other side (obviously with a like display 49' on that side).

The multi-player version in any embodiment could be operated from a single operator 52 so as to drive all of the displays from that hub alone, and further thereby managing all of the linked machines in operation from a single cpu. It may be most preferred, however, to have each machine operated by its own cpu. This would be beneficial where the machines have the capability of either single or multi-player usage. A player could therefore select the mode of operation, choosing to play independently or with other racers.

Figure 22:
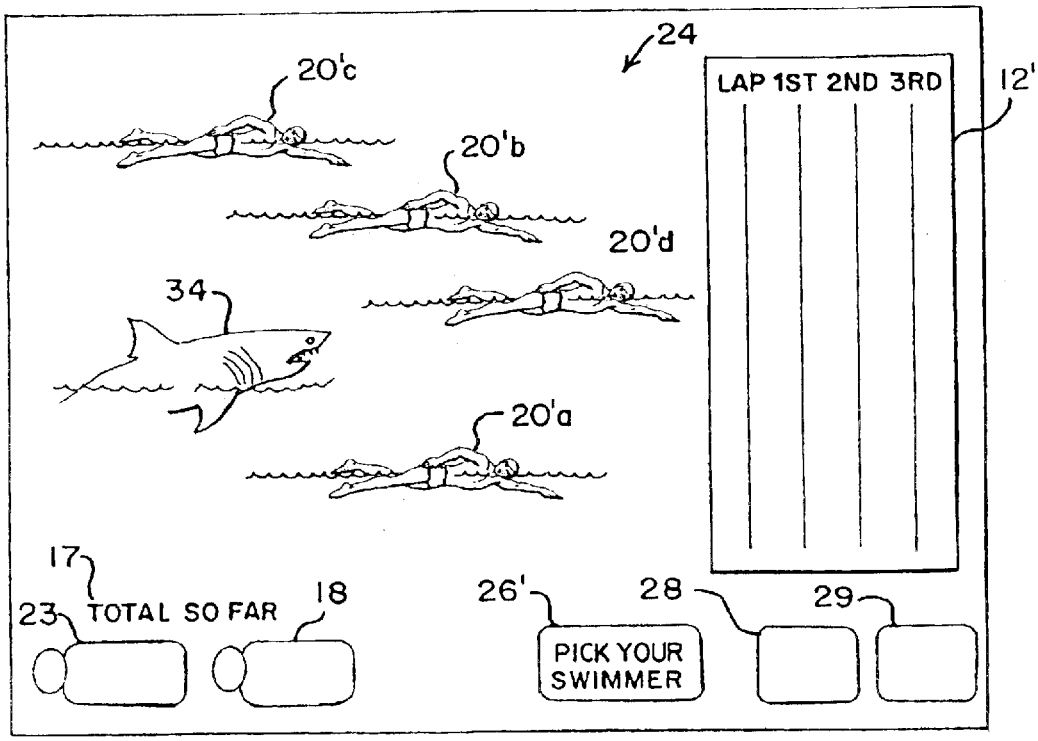
FIG. 22 is a representation of a screen for yet another embodiment of a game made in accordance with the invention employing a swimming theme.

As previously noted, the invention may take many different forms of presentation, a car race being but one. FIG. 22 shows an embodiment involving a swimming theme, as another example. Swimmers 20'*i* a through 20'*d* race in a pool 24 through laps that have been wagered upon. Instead of a "Pick Your Car" button, there is a "Pick Your Swimmer" button 26'. The player's swimmer 20'*a* would have a distinctive swim cap or swimsuit, for instance, or some other means to distinguish the player in the pool. Instead of an exploding elimination of the player as in the car theme, which could be rather messy and unduly gory in a pool theme, a shark or sea creature 34 may be advantageously employed to more fully and cleanly dispose of the unlucky swimmer holding up the rear. All other aspects of this embodiment would be as previously described, whether in single or multi-player mode. "Racer" as used herein will therefore be plainly understood to encompass any kind of theme of contest, unless otherwise specifically differentiated in the claims.

Figure 23A:
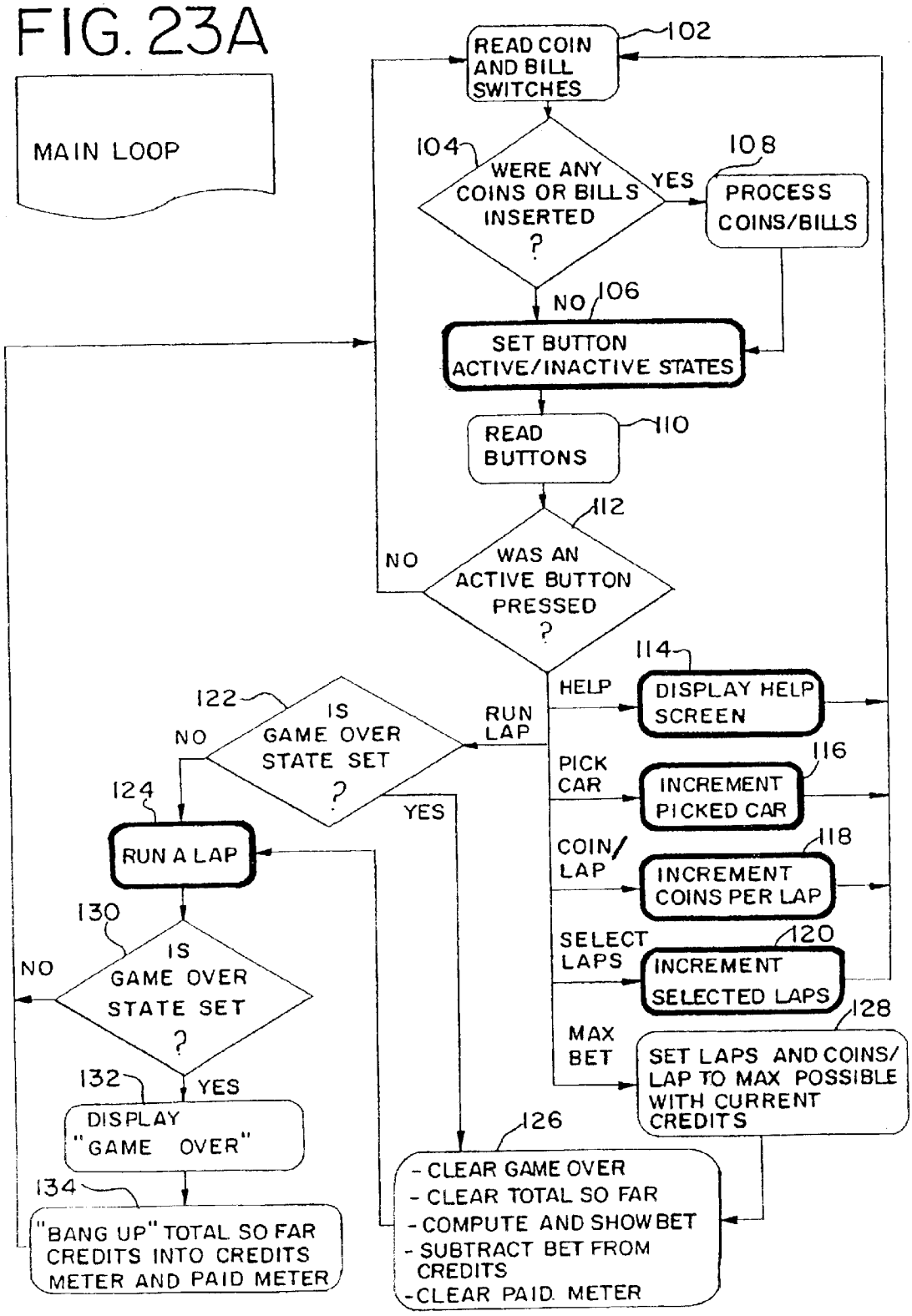

A form of the above-described embodiment of a car racing game for a single player to be used or operated on an independent computerized gambling machine with a display is operationally summarized in the flow charts of FIGS. 23A through 23L. FIG. 23A generally describes a Main Loop of the racing game. The first element of the Main Loop is a reading of a coin switch, a bill acceptor, a credit card reader, or the like at step 102 to detect a wager. Next, an assessment is made of whether a coin, a dollar bill, a credit card was inserted into the racing game by a player at step 104. If no coin, bill, or credit card is inserted, then the game proceeds to a "Set Button Active/Inactive States" subroutine, described hereinafter, at step 106. If a coin, a bill, a credit card were inserted, then the coin, bill, or credit card is processed at step 108 and registered as a credit(s) and displayed at a "Credits" meter 14 (e.g., FIG. 1).

After the game returns from the "Set Button Active/Inactive States" subroutine, described hereinafter, at step 106, the game proceeds to read a plurality of active player buttons at step 110. After the plurality of active player buttons have been read, a determination is made of whether any of the plurality of active player buttons have been actuated by the player at step 112. The game cycles through the Main Loop back through step 102 until the player actuates one of the plurality of active player buttons.

The player has many options to actuate active buttons. The player may choose to actuate a "Help" button 25 (e.g., FIG. 1). If the "Help" button 25 is actuated, then the program initiates a "Help" subroutine, described hereinafter, at step 114 to display a Help Display (e.g., FIG. 3). After the program has completed the "Help" subroutine, described hereinafter, the program returns to the Main Loop at step 102 and continues.

The player may also choose to actuate a "Pick Your Car" button 26 (e.g., FIG. 1). If the "Pick Your Car" button 26 is actuated, then the program proceeds to an "Increment Picked Car" subroutine, described hereinafter, at step 116 to allow the player to select a car to use in the racing game. After the program has completed the "Increment Picked Car" subroutine, described hereinafter, the program returns to the Main Loop at step 102 and continues on from there.

The player may also choose to actuate a "Coins Per Lap" button 23 (e.g., FIG. 1), if active. If the "Coins Per Lap" button 23 is actuated, the program proceeds to an "Increment Coins Per Lap" subroutine, described hereinafter, at step 118 to allow the player to increase a number of credits wagered on each lap of the racing game. After the program has completed the "Increment Coins Per Lap" subroutine, described hereinafter, the program returns to the Main Loop at step 102 and continues on as previously described.

The player may also choose to actuate a "Select Laps" button 18 (e.g., FIG. 1), if active. If the "Select Laps" button 18 is actuated, the program proceeds to an "Increment Selected Laps" subroutine, described hereinafter, at step 120 to allow the player to select a number of laps in which to potentially participate in the racing game. After the program has completed the "Increment Selected Laps" subroutine, described hereinafter, the program is returned to the Main Loop at step 102 and continues on as previously described.

In preferred practice of this embodiment, the player will actually operate at least one of the "Pick Your Car" button 26, the "Coins Per Lap" button 23 or the "Select Laps" button 18 (unless the player chooses the "Max Bet Race" button 29, described hereinafter). This will typically occur upon the first play of the game (e.g., machine) by that player. The program will thereafter maintain those initial settings, so upon conclusion of the game the player may simply continue with a new game without need to re-enter these commands. The program could also have default settings for the next player to use.

With selections made, the player then actuates a "Run Lap" button 28 (e.g., FIG. 1). If the "Run Lap" button 28 is actuated, the program ascertains if a "Game Over" state is set in step 122. If the "Game Over" state is not set (i.e., a multi-stage game is underway), then the program initiates a "Run A Lap" subroutine, described hereinafter, at step 124. One of the functions of the "Run A Lap" subroutine is to set the "Game Over" state if the game ends for any of the previously discussed reasons.

If the "Game Over" state is set (a new multi-stage game is beginning), then the program proceeds to step 126 where the "Game Over" indicator is cleared, the "Total So Far" meter 17 (e.g., FIG. 1) is cleared, a bet or wager of the game is computed and displayed in the "Total Bet" meter 15 (e.g., FIG. 1), the bet is subtracted from the credits and shown on the "Credits" meter 14 (e.g., FIG. 1), and the "Paid" meter 16 is cleared. After these functions are completed in step 126, the program initiates the "Run A Lap" subroutine, described hereinafter, at step 124.

The player has the option of skipping the "Coins Per Lap" button 23 (e.g., FIG. 1), and the "Select Laps" button 18 (e.g., FIG. 1) using a "Max Bet Race" button 29 (e.g., FIG. 1). If the "Max Bet Race" button 29 is actuated, the program proceeds to step 128 and assesses the total credits the player has provided, determines a maximum number of laps and a maximum number of coins per lap (per an embedded look-up table) which can be played for the credits shown in the "Credits" meter 14 (e.g., FIG. 1) up to a fixed maximum for the game. The program then proceeds to complete step 126 as previously described and then initiates the "Run A Lap" subroutine, described hereinafter, at step 124.

After the program has completed the "Run A Lap" subroutine, described hereinafter, the program returns and initiates step 130 that determines if the "Game Over" state is set. If the "Game Over" state is not set, then the program returns to step 102 and continues as previously described.

If the "Game Over" state is set, the program displays a "Game Over" indicator in step 132 (e.g., FIG. 2). A number of credits won on the wager or bet are displayed in the "Total So Far" meter 17 (e.g., FIG. 1) and transferred to the credit meter 14 in a visual and/or audio "Bang up" fashion, and the "Paid" meter 16 is updated in step 134. At this point the game is over and the program proceeds back to step 102.

Figure 23B:
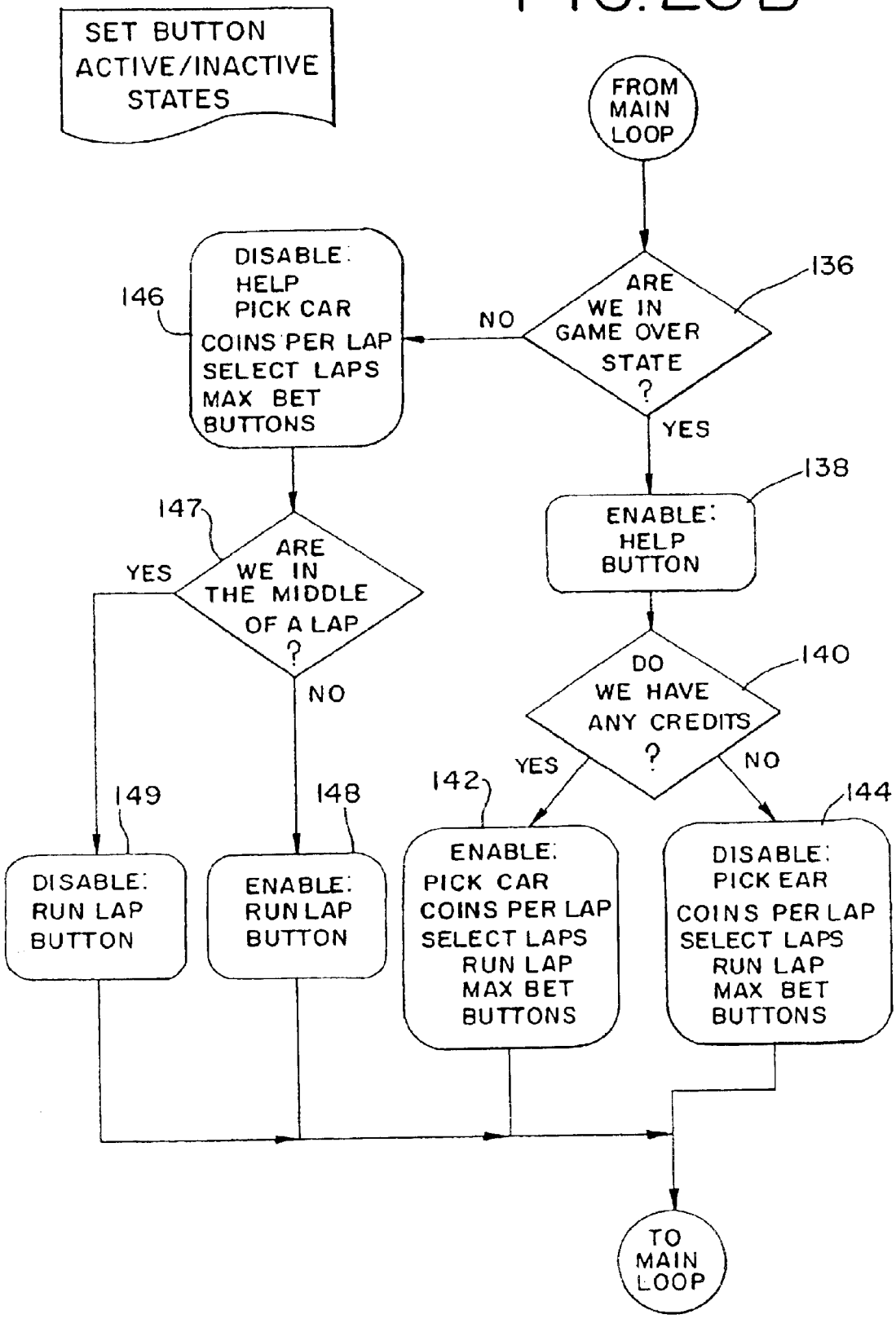

FIG. 23B depicts the "Set Button Active/Inactive States" subroutine of step 106 of FIG. 23A. The "Set Button Active/Inactive States" subroutine begins at step 136 from the Main Loop of the game, and determines whether the game is in the "Game Over" state.

If the game is in the "Game Over" state, the program proceeds to step 138 and enables the "Help" button 25 (e.g., FIG. 1). A determination is then made in step 140 of whether the player has any credits for playing the game. If the player does have sufficient credits, then the "Pick Your Car" button 26 (e.g., FIG. 1), the "Coins Per Lap" button 23, the "Select Laps" button 18, the "Run Lap" button 28, and the "Max Bet Race" button 29 are enabled in step 142. If the player does not have sufficient credit, then the foregoing buttons are disabled in step 144.

Referring back to step 136, if the game is not in the "Game Over" state, the program proceeds to step 146 and disables the "Help" button 25 (e.g., FIG. 1), the "Pick Your Car" button 26, the "Coins Per Lap" button 23, the "Select Laps" button 18, and the "Max Bet Race" button 29. The program then determines if the game is currently in the middle of a lap in step 147. If the game is not in the middle of a lap, then the "Run Lap" button 28 is enabled in step 148. If the game is in the middle of a lap at step 147, then the program disables the "Run Lap" button 28 in step 149.

After completion of step 142, step 144, step 148, or step 149, the program returns to the Main Loop at step 110.

FIG. 23C depicts the "Help" subroutine at step 114 of FIG. 23A. When the "Help" subroutine is initiated, the program suspends the game, fades out the game on the display or screen and fades in the Help Display (FIG. 3) in step 150. Next, the program proceeds to read an "Exit" button 27 (FIG. 3) at step 152. A determination is made of whether the "Exit" button 27 has been actuated by the player at step 154. If the "Exit" button 27 has not been actuated, the program returns to step 152 and cycles through a loop 156 until the player actuates the "Exit" button 27.

If the "Exit" button 27 has been actuated, the program fades out the Help Display, fades in the game display and resumes the game in step 158. Once step 158 is completed, the program returns to the Main Loop at step 102.

FIG. 23D depicts the "Increment Picked Car" subroutine at step 116 of FIG. 23A. When the "Increment Picked Car" subroutine is initiated, the graphic display of a car denoted by (the former) "Player's Car Number" is displayed on the display in a "Normal" (non-highlighted) state in step 160. The program then adds one increment to the car number denoted by the "Player's Car Number" in step 162. At step 164, a determination is made of whether the "Player's Car Number" is greater than eight. If the "Player's Car Number" is not greater than eight, then a graphic display of a car denoted by the (new) "Player's Car Number" is highlighted on the display in step 166. If the "Player's Car Number" is greater than eight, then the "Player's Car Number" is set to one in step 168, and the program displays a graphic display with the (new) car denoted by the "Player's Car Number" highlighted on the display in step 166.

Next, the program sets the graphic display of a car denoted by the "Player's Car Number" to visually spin one revolution on the display in step 170. Once step 170 is completed, the program returns to the Main Loop at step 102.

Figure 23E:
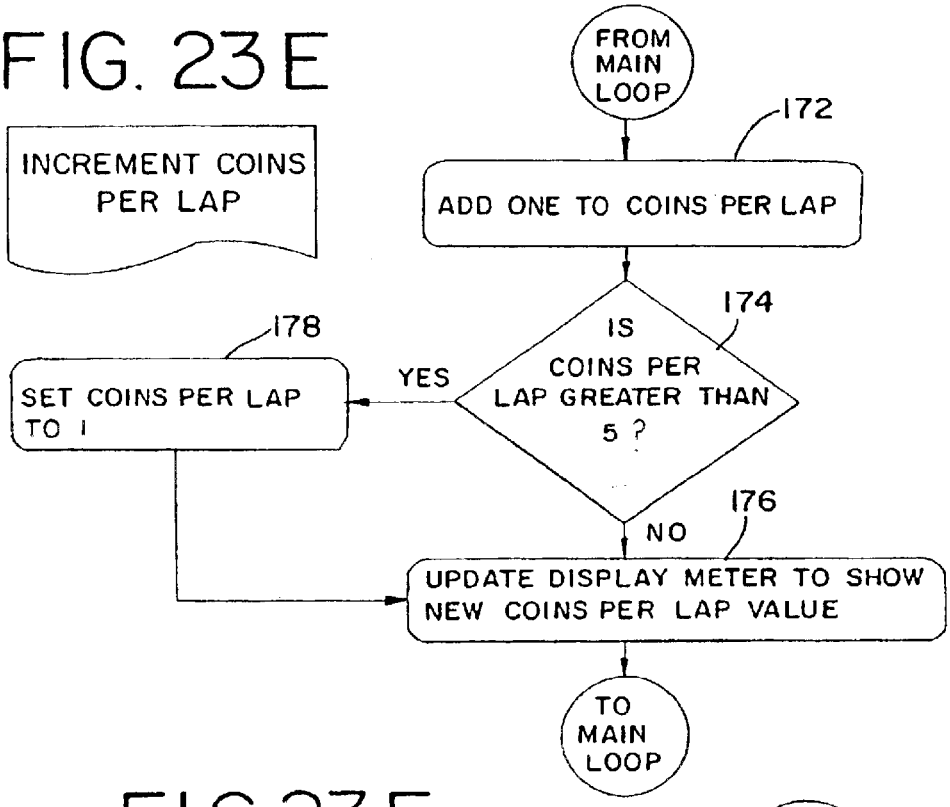

FIG. 23E illustrates the steps of the "Increment Coins Per Lap" subroutine at step 118 of FIG. 23A. First, the program increments or increases the number of "Coins Per Lap" wager amount by one credit in step 172. A determination is then made in step 174 of whether the "Coins Per Lap" wager amount is greater than five. If the "Coins Per Lap" wager amount is not greater than five, then the "Coins Per Lap" meter is updated to reflect the value of the "Coins Per Lap" wager amount in step 176. If the "Coins Per Lap" wager amount is greater than five, then the "Coins Per Lap" wager amount is set to one in step 178, and the "Coins Per Lap" meter is updated to reflect the value of "1" in step 176. Once step 176 is completed, the program returns to the Main Loop at step 102.

Figure 23F:
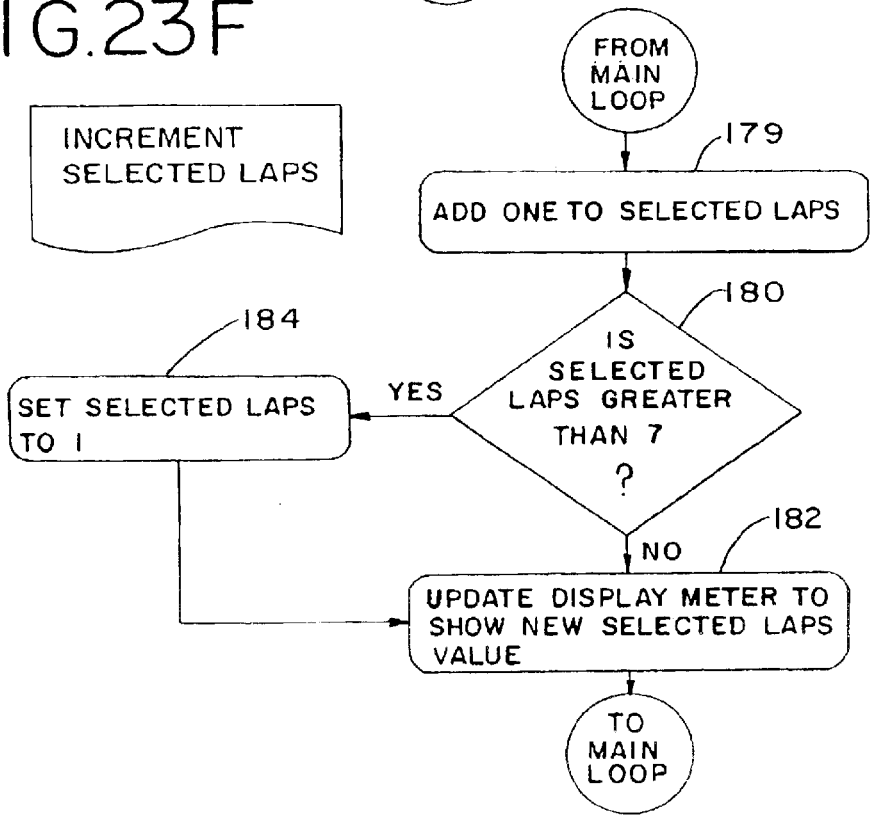

FIG. 23F shows the steps completed in the "Increment Selected Laps" subroutine at step 120 of FIG. 23A. When the "Increment Selected Laps" subroutine is initiated, the "Selected Laps" amount is incremented or increased by one lap in step 179. A determination is then made in step 180 of whether the "Selected Laps" amount is greater than seven. If the "Selected Laps" amount is not greater than seven, then the "Selected Laps" meter is updated to reflect the value of the "Selected Laps" amount in step 182. If the "Selected Laps" amount is greater than seven, then the "Selected Laps" amount is set to one in step 184, and the "Selected Laps" meter is updated to reflect the value of "1" in step 182. Once step 182 is completed, the program returns to the Main Loop at step 102.

Figure 23G:
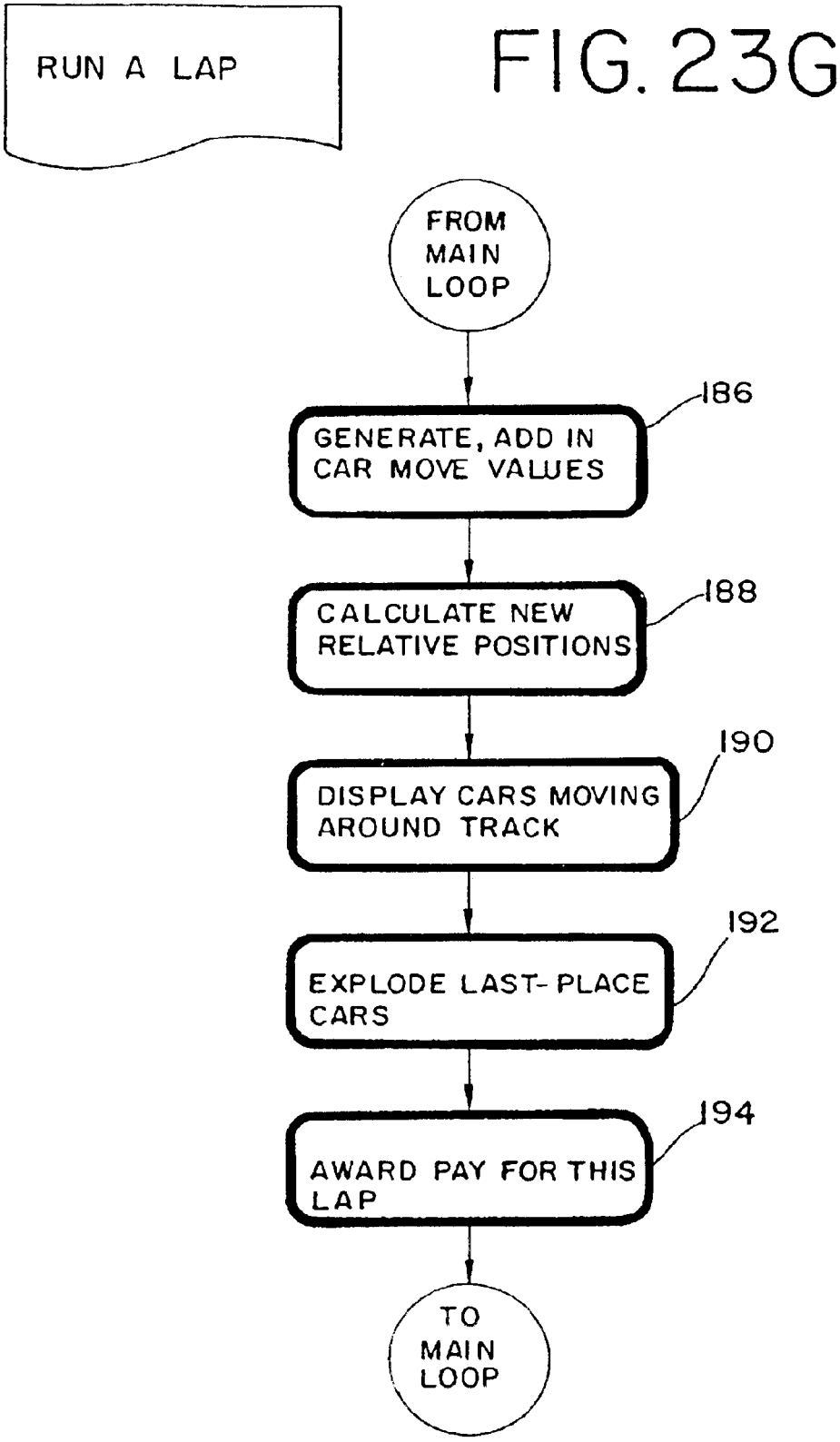

FIG. 23G reveals the steps in the "Run A Lap" subroutine at step 124 of FIG. 23A. When the "Run A Lap" subroutine in initiated, then the program initiates a "Generate, Add In Car Move Values" subroutine, described hereinafter, at step 186 to generate a set of car race positions for each car in the racing game.

At step 188, the program initiates a "Calculate New Relative Positions" subroutine, described hereinafter, to generate a set of relative positions for each car in the racing game.

At step 190, the program initiates a "Display Cars Moving Around Track" subroutine, described hereinafter, to display the cars moving around the oval track in such a manner that at the end of the lap the cars are displayed in the new relative positions as calculated in step 188.

At step 192, the program initiates an "Explode Last-Place Cars" subroutine, described hereinafter, to generate and display a visual effect of the car (or cars) in the last place as calculated in step 188 to explode, and is thereafter removed from the display of the racing game.

At step 194, the program initiates an "Award Pay For This Lap" subroutine, described hereinafter, to calculate and track the credits won (if any) in the racing game for the current lap of the race. After the program has completed the "Award Pay For This Lap" subroutine, described hereinafter, the program returns to the Main Loop at step 130.

Figure 23H:
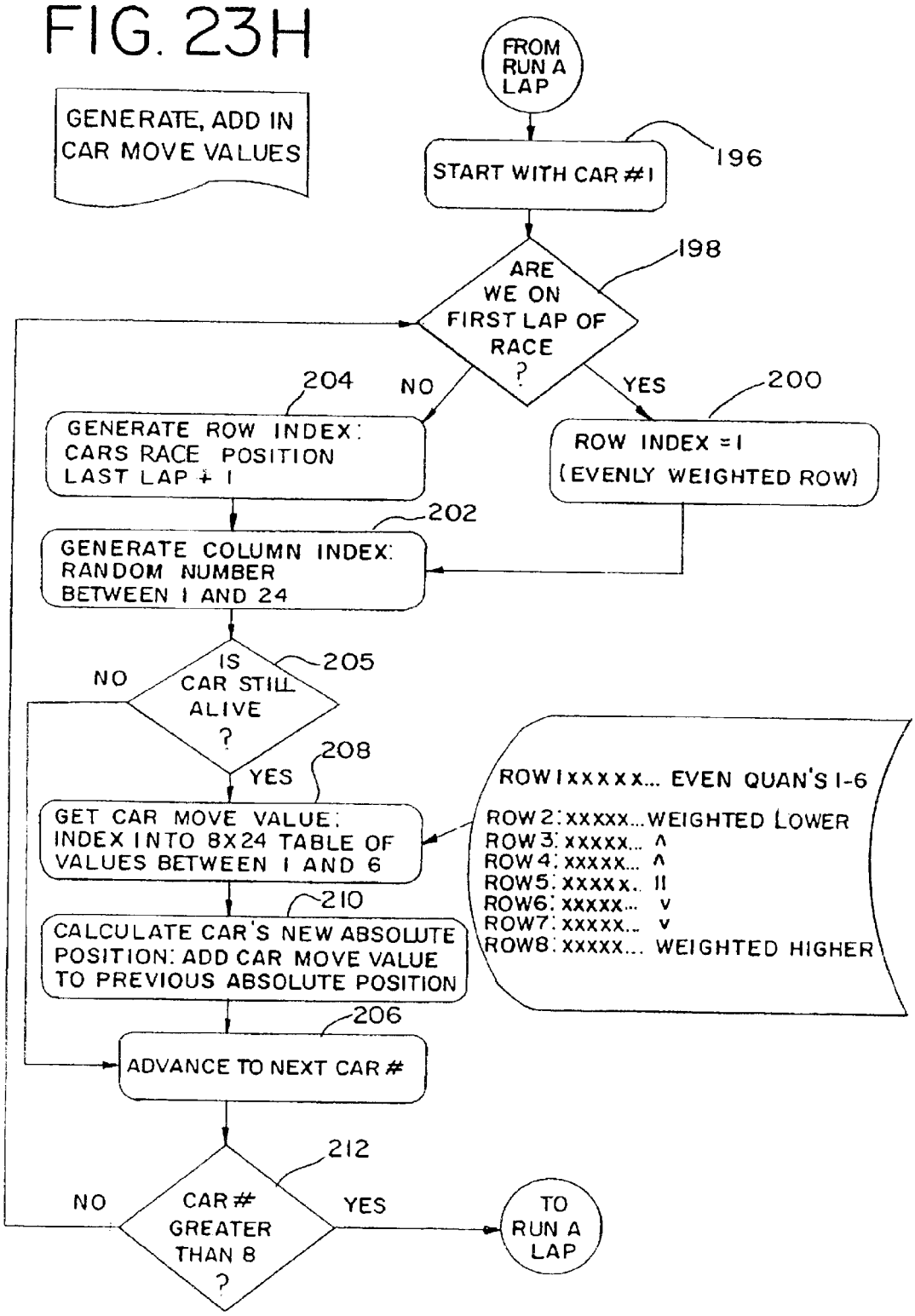

FIG. 23H illustrates the steps of the "Generate, Add In Car Move Values" subroutine at step 186 of FIG. 23G. In step 196, the program initiates a loop to calculate the car move value for each of the eight cars. The program then determines if the game is in the first or subsequent laps of the racing game in step 198. If the game is in the first lap, a row index for the specific car is set to one in step 200. This is completed so that the row used for each car is the evenly weighted first row in the first lap of the racing game. The program then generates a column index for the specific car in step 202. The column index is a random number between 1 and 24.

If the game is in a subsequent lap of the racing game at step 198, the program calculates the row index for the specific car in step 204. The row index is the specific car's position of the last lap plus one. Once the row index is calculated, the program proceeds to complete step 202, described above.

After step 202 is completed, the program verifies if the car is still alive in step 205. If the car is not still alive, the program indexes to the next car in step 206. If the car is still alive, in step 208, the program retrieves the car move value from the 8×24 table using the row index and column index computed above. In step 210, the program then calculates a car's new absolute position that is the "Car Move Value" added to the car's previous absolute position. Once the car's new absolute position is determined, the program proceeds to index to the next car as described above in step 206. After step 206 is completed, the program then determines if the car number has indexed to greater than eight at step 212. If the car number is greater than eight, the program returns to the "Run A Lap" subroutine to complete step 188. If the car number is not greater than eight, the program returns to the beginning of the loop (step 198).

Figure 23I:
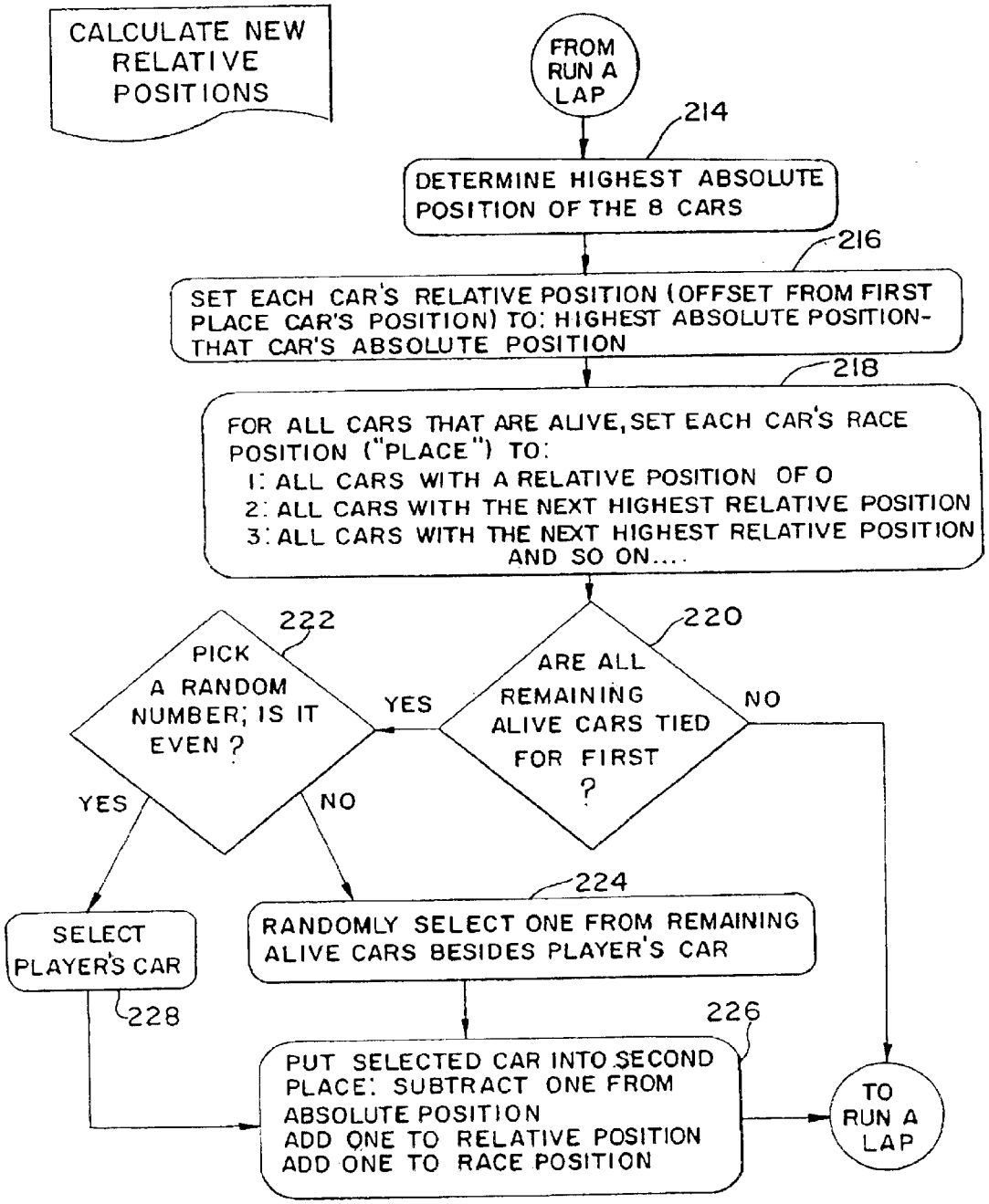

FIG. 23I illustrates the steps of the "Calculate New Relative Positions" subroutine at step 188 of FIG. 23G. In step 214, the program determines which of the eight cars is in the highest absolute position. Next, the program calculates a relative position of each car by subtracting the car's absolute position from the highest absolute position, in step 216. The program then sets the race position for each car that is still alive in the game in step 218. The race position is determined by each car's relative position. Cars with a relative position of zero are placed first and the remaining cars are placed according to the next highest relative position.

In step 220, the program determines if all remaining alive cars are tied for first place. If all of the remaining cars are not tied for first place, then the program returns to the "Run A Lap" subroutine to complete step 190. If all of the remaining alive cars are tied for first place, then the program picks a random number and determines if the random number is odd or even in step 222. If the random number is odd, the program then randomly selects one of the remaining alive cars besides the player's car in step 224. The program repositions the selected car into second place in the racing game, by subtracting one from the absolute position, adding one to the relative position, and adding one to the race position in step 226.

If the program selected an even random number is step 222, the program selects the player's car in step 228 and repositions the player's car into second place in the racing game by subtracting one from the absolute position, adding one to the relative position, and adding one to the race position in step 226. After step 226 is completed the program returns to the "Run A Lap" subroutine to complete step 190.

Figure 23J:
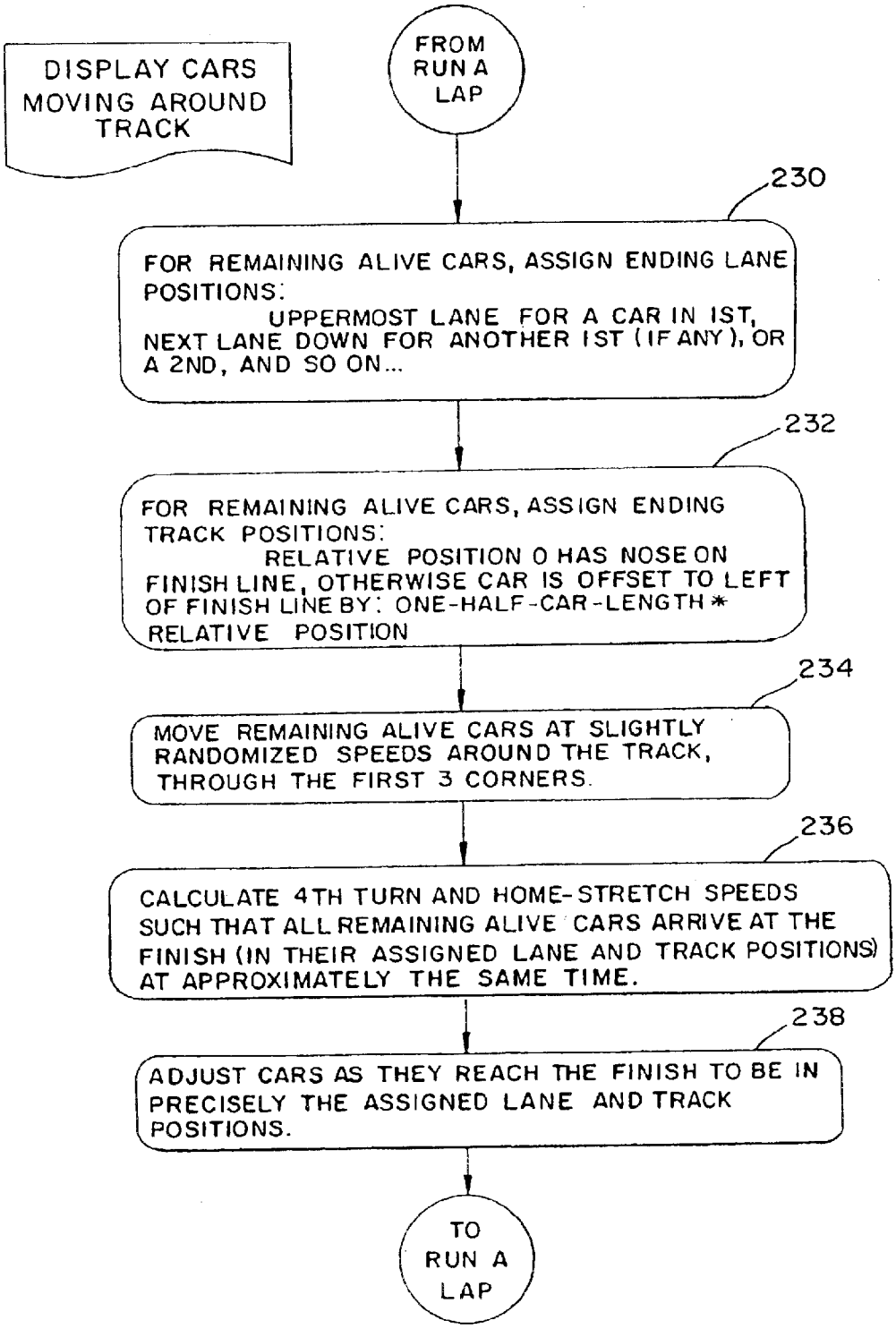

FIG. 23J illustrates the steps of the "Display Cars Moving Around Track" subroutine at step 190 of FIG. 23G. In step 230, the program assigns each alive car an ending lane position for completing the lap. The lanes are assigned such that the innermost lane is assigned to the car in first place. The next innermost lane is assigned to the car in next place. This manner of lane assignments is continued for all alive cars.

The program then assigns ending track positions for all remaining alive cars in step 232. The car with a relative position of zero is assigned an ending track position of the front tip or nose of the car to be on the finish line of the racetrack. Each of the remaining alive cars is assigned an ending track position that is offset to the left of the finish. The offset of each of the remaining cars is determined by the relative position of the car multiplied by one half-car length.

In step 234, the program then displays the remaining alive cars moving around the oval racetrack image at slightly randomized speeds through the first three corners of the lap. The program calculates the fourth turn of the lap and homestretch speeds such that all remaining alive cars arrive in their respective assigned lane and ending track positions at approximately the same time in step 236. This subroutine concludes in step 238 by continuing to display the remaining alive cars and adjusts each of the cars in speed and position to arrive at its respective ending lane position and ending track position at the same time, with the final (stopped) position being the precise position previously calculated. After step 238 is completed the program returns to the "Run A Lap" subroutine to complete step 192.

Figure 23K:
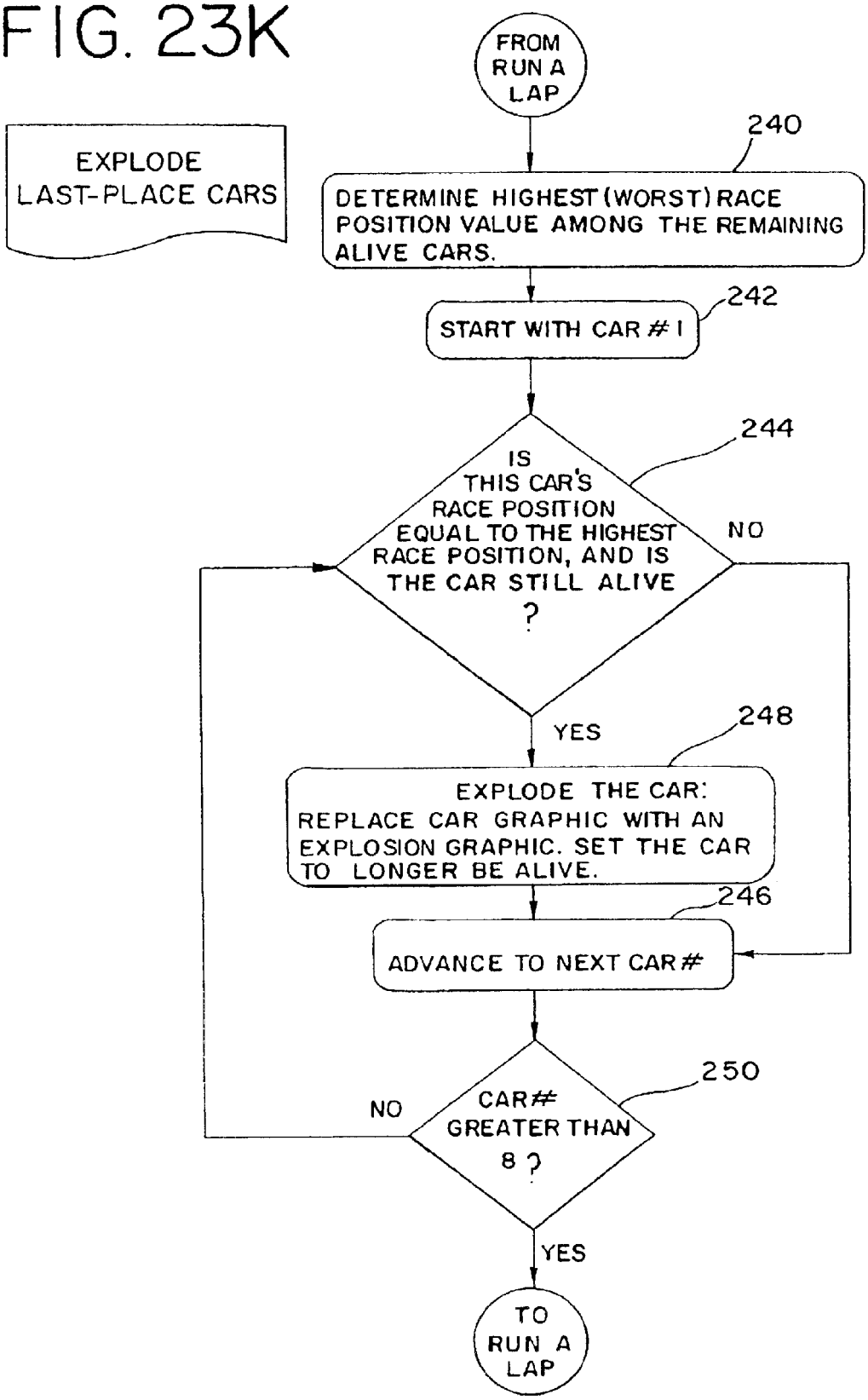

FIG. 23K illustrates the steps of the "Explode Last-Place Cars" subroutine at step 192 of FIG. 23G. In step 240, the program determines the highest or worst race position value among the remaining cars. In steps 242 and 244, the program starts with the number one car (not necessarily the car in first place) and determines if the car's race position is equal to the highest or worst race position. If the car's race position is not the highest or worst race position, then the program indexes to the next car in step 246.

If the car's race position is the highest or worst race position in step 244, then the program replaces the car graphic with an explosion graphic and the car is out of the game in step 248. The program then indexes to the next car in step 246.

Once step 264 is complete, the program determines if the indexed car number is greater than eight in step 250. If the indexed car number is not greater than eight, the program returns to step 244. If the indexed car number is greater than eight, the program returns to "Run A Lap" subroutine just before step 194.

Figure 23L:
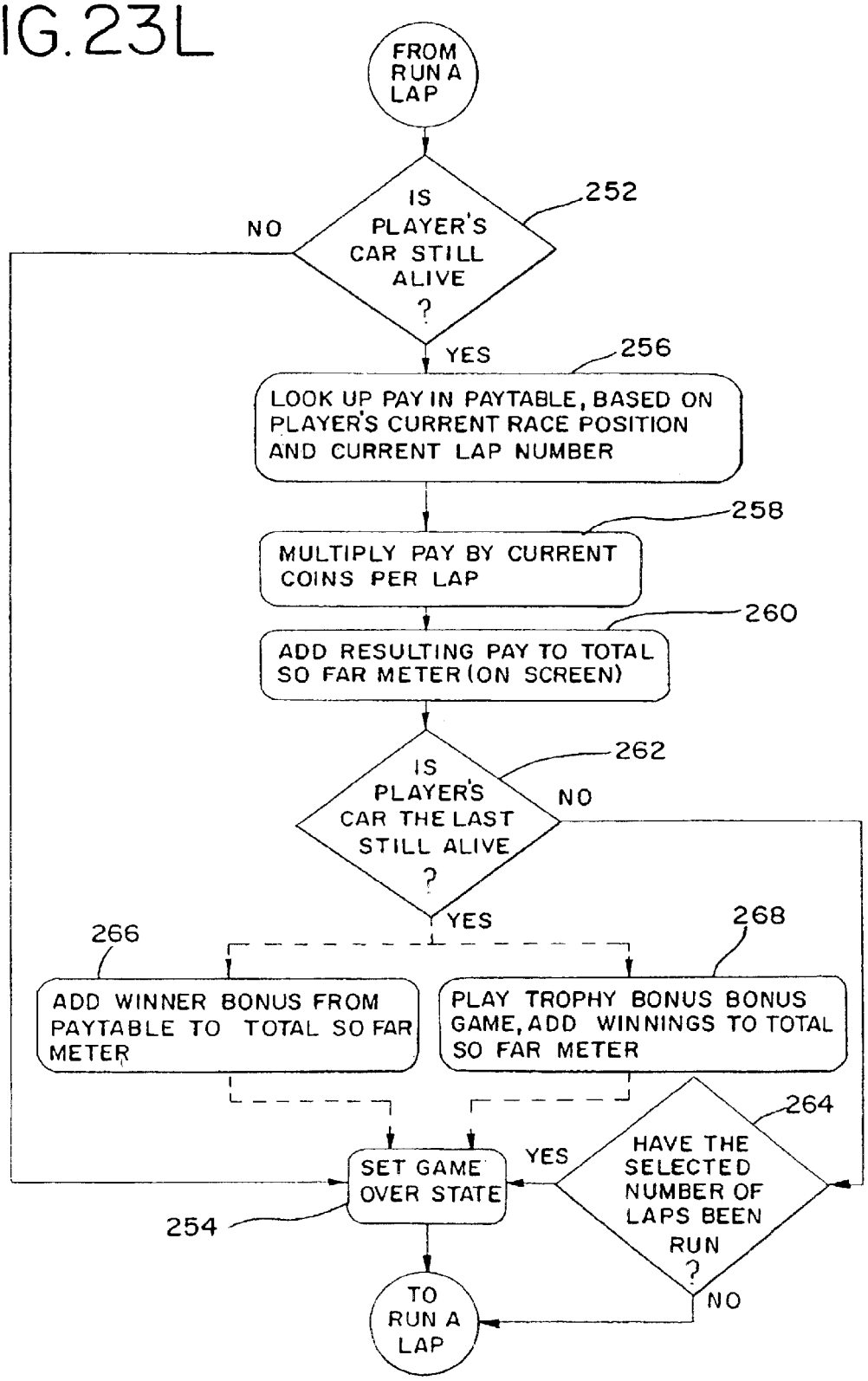

FIG. 23L illustrates the steps of the "Award Pay For This Lap" subroutine at step 194 of FIG. 23G. In step 252, the program determines if the player's car is still alive. If the player's car is not alive, the program sets the "Game Over" state in step 254. If the player's car is still alive, the program obtains a pay award from a predetermined paytable 13 (e.g., FIG. 1) for current race position and lap number of the player's car in step 256. In step 258, the program multiplies the pay award by the value of the "Coins Per Lap" meter 22 (adjacent button 23). The resulting pay award value is then added to the value of the "Total So Far" meter 17 and displayed, in step 260.

The program then determines if the player's car is the last car alive in step 262. If the player's car is not the last car alive, then the program proceeds to step 264 and determines if the selected number of laps have been completed. If the selected number of laps have not been completed, the program returns to the "Run A Lap" subroutine. If the selected number of laps have been completed, the program proceeds to step 254 and sets the "Game Over" state.

Back in step 262, if the player's car is the last car alive, the program determines the appropriate winner bonus from the paytable 13 (e.g., FIG. 1) and adds the value to the "Total So Far" meter 17 in step 266. The program could instead allow the player to play a "Trophy Bonus" game and add the winnings to the "Total So Far" meter 17 in step 268. After steps 266 or 268 are complete, the program sets the "Game Over" state in step 254.

After step 254 is completed, the program returns to the "Run A Lap" subroutine and back to the Main Loop ready at step 130.

Figure 24A:
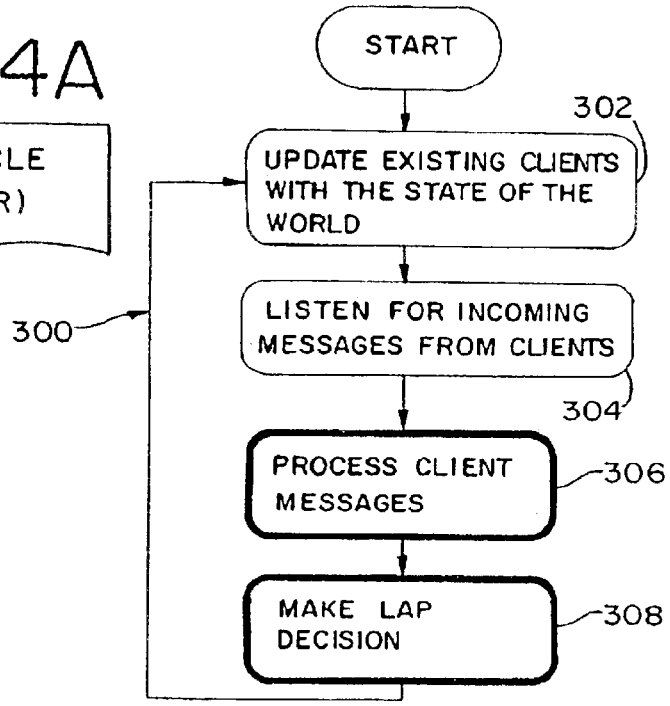

Another form of the above-described embodiment of a car racing game uses a multiplayer (server) program operated on a server of a network of computerized gambling machines with displays, and is operationally summarized in the flow charts of FIGS. 24A through 24K. FIG. 24A generally describes a Game Cycle and a Main Loop 300 of the multi-player server program. In the Game Cycle at step 302 the multiplayer program updates any existing clients (players) as needed. Next in step 304, the multiplayer program checks for any incoming messages from the existing players. The "Process Client Messages" subroutine, described hereafter, is called to process any messages that may have been received from the clients at step 306. Once the program has returned from the "Process Client Messages" subroutine, the program initiates a "Make Lap Decision" subroutine, described hereinafter, in step 308 to make any decisions needed for the game.

Figure 24B:
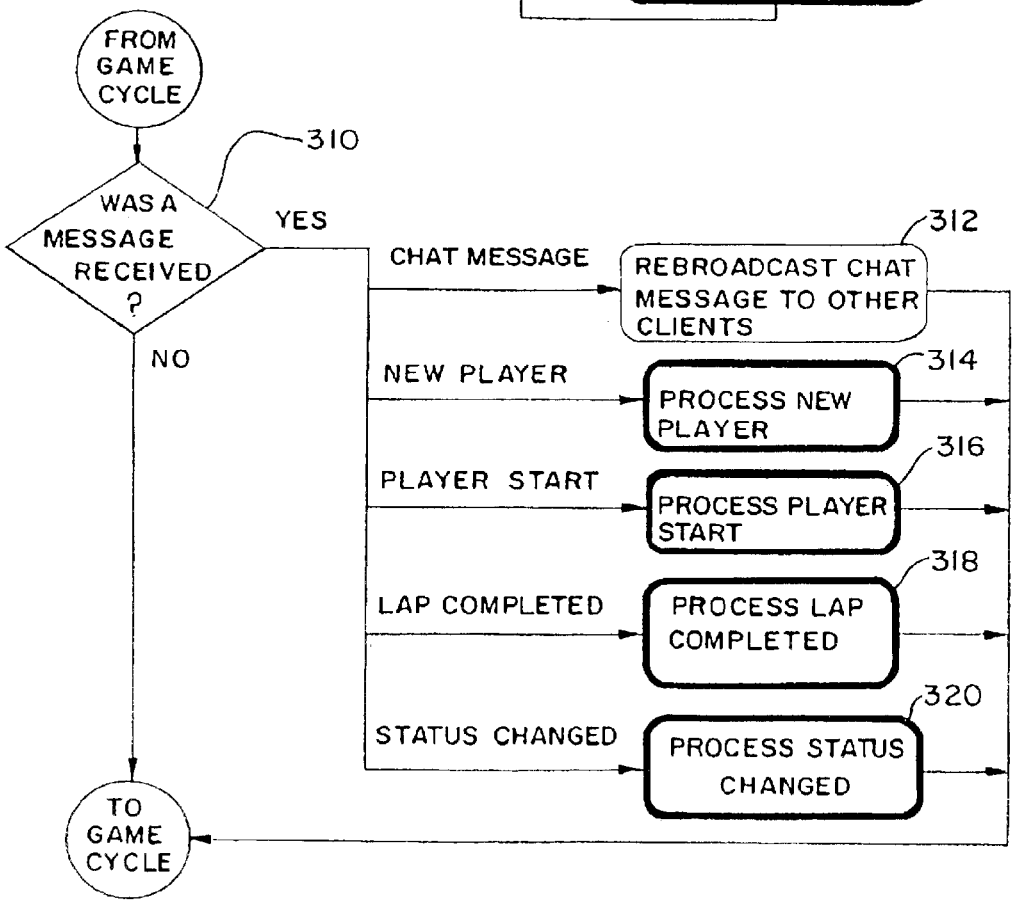

FIG. 24B depicts the "Process Client Messages" subroutine at step 306 of FIG. 24A. The "Process Client Messages" subroutine first verifies that a message was received from one of the existing players in step 310. If no message was received, then the program returns to the Main Loop 300 of the Game Cycle at step 308. If a message was received then the program directs the message to be processed based on the type of the message. If the message is a "Chat Message" then the program rebroadcasts the message to any other existing players in step 312 (see, e.g., window 61 of FIG. 19). After the message is rebroadcast, the program returns to the Main Loop 300 of the Game Cycle at step 308.

If the message is a "New Player Message", then the program initiates the "Process New Player" subroutine, described hereinafter, to register and process a new player in step 314. After the program returns from the "Process New Player" subroutine, the program returns to the Main Loop 300 of the Game Cycle at step 308.

If the message is a "Player Start Message", then the program initiates the "Process Player Start" subroutine, described hereinafter, in step 316 to lock in a player's game specifications and start a countdown clock to show the time remaining before the game starts. After the program returns from the "Process Player Start" subroutine, the program returns to the Main Loop 300 of the Game Cycle at step 308.

If the message is a "Lap Completed Message", then the program initiates a "Process Lap Completed" subroutine, described hereinafter, in step 318 to process a "Lap Complete" state for each existing player of the game. After the program returns from the "Process Lap Completed" subroutine, the program returns to the Main Loop 300 of the Game Cycle at step 308.

If the message is a "Status Changed Message", then the program initiates the "Process Status Changed" subroutine, described hereinafter, in step 320 to note a specific change to a player in the game and inform any other players of the change to the player's status. After the program returns from the "Process Status Changed" subroutine, the program returns to the Main Loop 300 of the Game Cycle at step 308.

FIG. 24C depicts the "Process New Player" subroutine at step 314 in FIG. 24B. The "Process New Player" subroutine first determines if the game is in a "Server Game Over" state in step 322. If the game is not in the "Server Game Over" state, then the program will re-queue the message in step 324 for processing later. If the server game is in the "Server Game Over" state, then the server game will create a record for a new client in step 326 (e.g., windows 60*a* through 60*c*). The game will then inform all existing clients of the new player in step 328 and return to the "Process Client Messages" subroutine.

FIG. 24D depicts the "Process Player Start" subroutine at step 316 in FIG. 24B. The "Process Player Start" subroutine first locks in a player's game specifications in step 330. The server program informs all existing clients of this player's lock in and this player's game specifications in step 332. In step 334, the server program then determines if this player is the first player of existing players to start. If this player is the first player to start, then the game proceeds to step 336 and starts the countdown clock to show the time remaining before the game starts, then continues onto step 338. If this player is not the first player to start, then the server program continues on to step 338 and determines if all the players have locked in. If all players have not locked in, then the server program returns to the "Process Client Messages" subroutine. If all players have locked in, then the server program initiates a "Calculate A Lap" subroutine, described hereinafter, in step 340 to generate car movements and relative positions for the next lap to be completed. After the server program has returned from the "Calculate A Lap" subroutine, the server program returns to the "Process Clients Messages" subroutine.

Figure 24E:
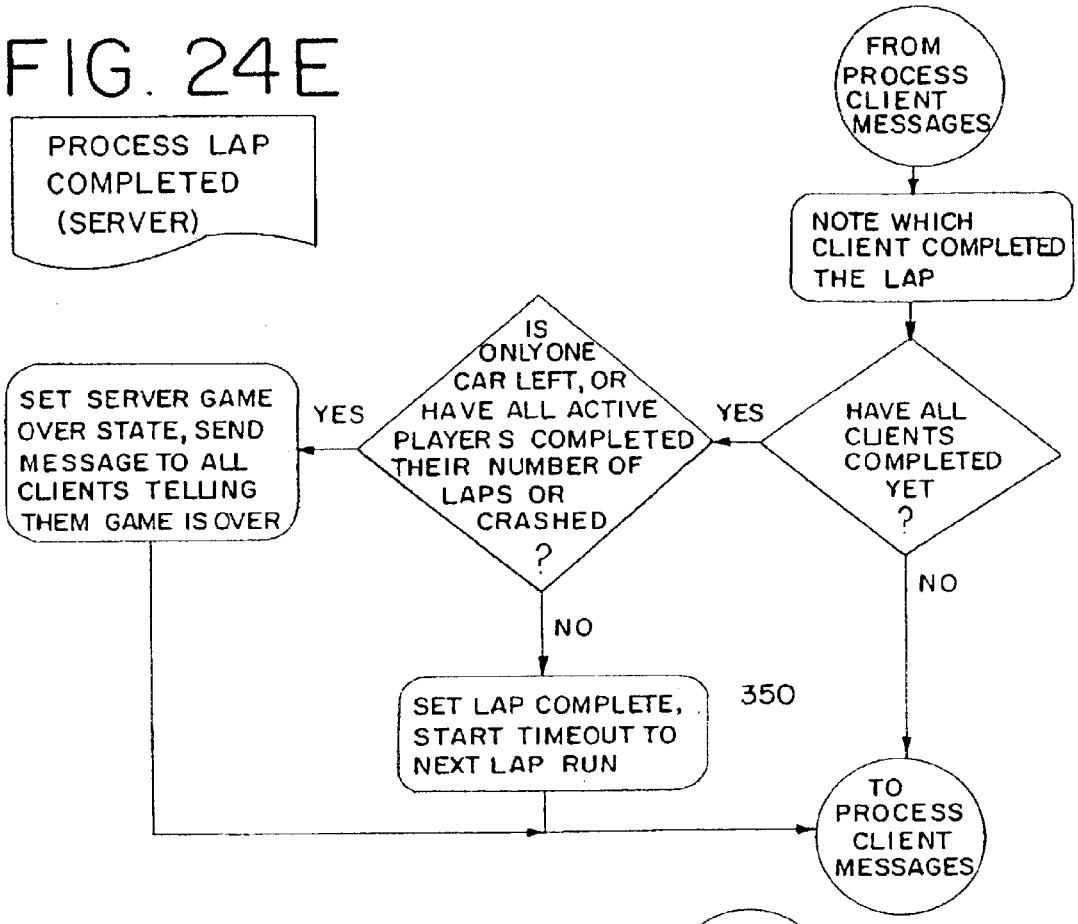

FIG. 24E depicts the "Process Lap Completed" subroutine at step 318 in FIG. 24B. The "Process Lap Completed" subroutine first clarifies which player completed the lap of this game in step 342. In step 344, the server program then determines if all existing players have completed the lap. If not all of the players have completed the lap, then the server program returns back to the "Process Client Messages" subroutine. If all of the players have completed the lap, then the server program proceeds to step 346 and determines if only one car is left, or if all active players completed their number of laps.

If only one car is left or if all active players have completed their number of laps, then the server program proceeds to step 348 and sets the "Server Game Over" state, notifies all players that the game is over, and returns the server program to the "Process Clients Messages" subroutine. Otherwise, the server program proceeds to step 350, sets the "Lap Complete" state, starts a lap-run timeout that counts down time until the next lap, and returns the server program to the "Process Client Messages" subroutine.

Figure 24F:
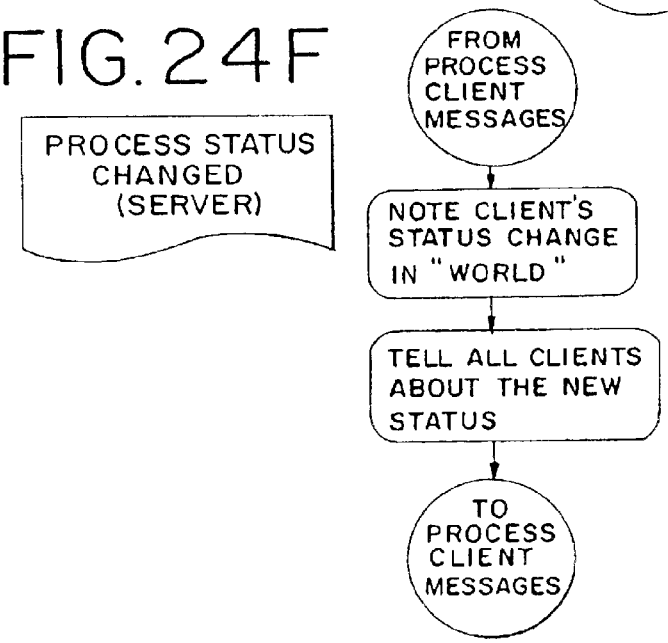

FIG. 24F depicts the "Process Status Changed" subroutine at step 320 in FIG. 24B. The "Process Status Changed" subroutine first clarifies a change of status for one of the existing players in step 352. The server program informs all existing players of this change of status in step 354 and returns the server program to the "Process Client Messages" subroutine.

FIG. 24G depicts the "Make Lap Decision" subroutine at step 308 of FIG. 24A. The "Make Lap Decision" subroutine first determines in step 356 if the "Server Game Over" state is set. If the "Server Game Over" state is not set, then the server program proceeds to step 358 and determines if the server program is in the "Lap Complete" state. If the game is not in the "Lap Complete" state, then the server program returns to the Main Loop of the Game Cycle. If the game is in the "Lap Complete" state, then the server program proceeds to step 360 and determines if the lap-run timeout has been completed. If the lap-run timeout has not been completed, then the program continues to count down or decrement the lap-run timeout in step 362, and then returns the server program to the Main Loop of the Game Cycle. If the lap-run timeout has been completed, the program then initiates the "Calculate A Lap" subroutine, described hereinafter, in step 364. After the server program has returned from the "Calculate A Lap" subroutine, the server program returns to the Main Loop of the Game Cycle.

Revisiting step 356, if the "Server Game Over" state is set, the program proceeds to step 366 and determines if the server program is timing out a game-start window. If the server program is not timing out the game-start window, then the server program returns to the Main Loop of the Game Cycle. If the server program is timing out the game-start window, then it continues to count down or decrement a game-start timeout counter in step 368.

Next, the program then determines if the game-start timeout has been completed in step 370. If the game-start timeout has not completed, the server program returns to the Main Loop of the Game Cycle. If the game-start timeout has completed, all existing players are informed that the game has started, and a lock-out of all non-participating players occurs in step 372. After completion of step 372, the program initiates the "Calculate A Lap" subroutine, described hereinafter, to run the first lap of the game. After the server program returns from the "Calculate A Lap" subroutine, the server program returns to the Main Loop of the Game Cycle.

Figure 24H:
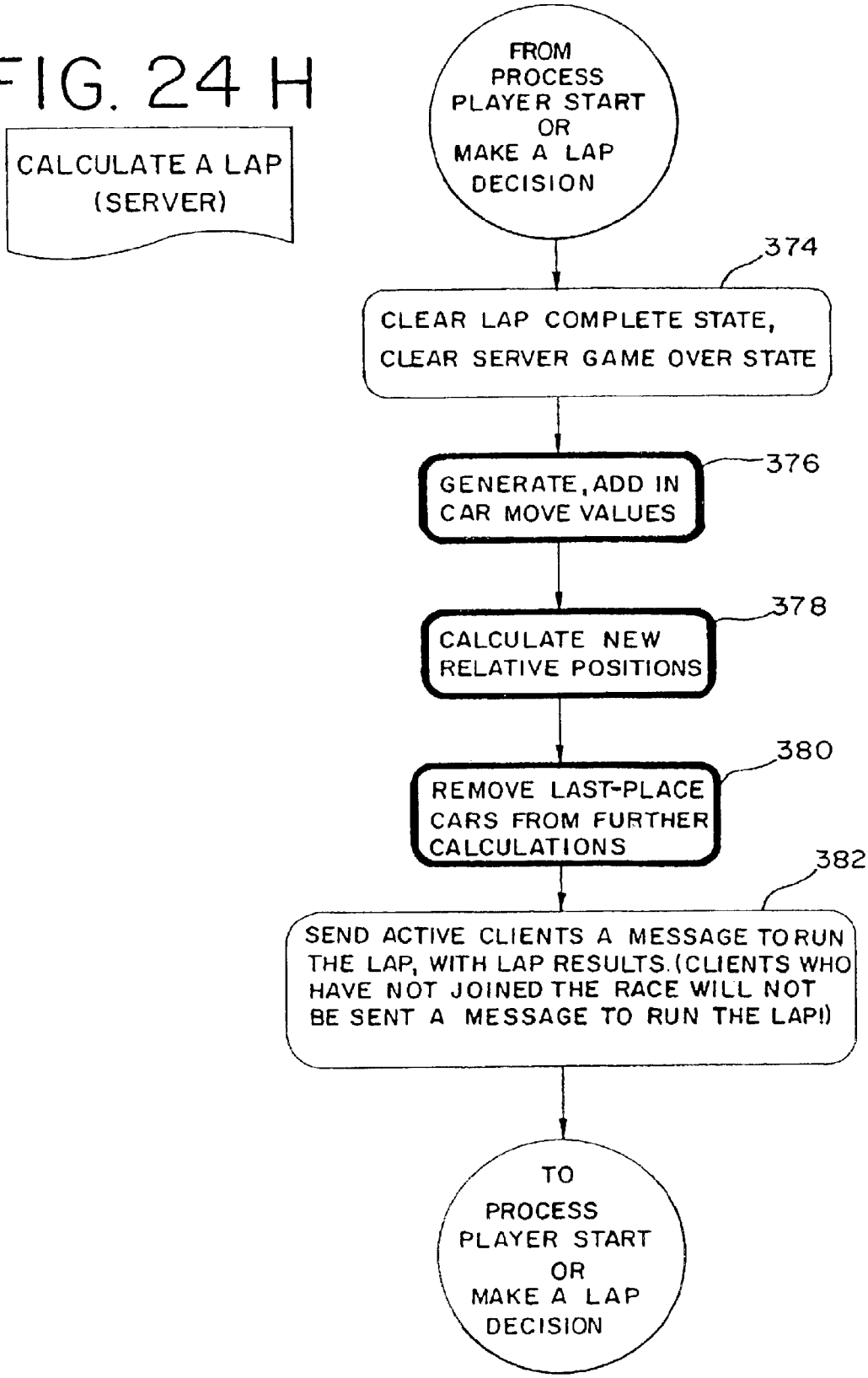

FIG. 24H depicts the "Calculate A Lap" subroutine at step 340 of FIG. 24D and step 364 of FIG. 24G. The "Calculate A Lap" subroutine first clears the "Lap Complete" state and the "Server Game Over" state in step 374. In step 376, the server program initiates a "Generate, Add In Car Move Values" subroutine, described hereinafter, to calculate the car movement values for the lap. After the server program has returned from the "Generate, Add In Car Move Values" subroutine, the server program initiates a "Calculate New Relative Positions" subroutine, described hereinafter, in step 378 to generate a set of relative positions for each car in the racing game. After the server program has completed the "Calculate New Relative Positions" subroutine, the server program initiates a "Remove Last-Place Cars From Further Calculations" subroutine at step 380. When the server program has returned from the "Remove Last-Place Cars From Further Calculations" subroutine, the server program informs the active clients or players to run the lap with lap results in step 382. After step 382 is complete, the server program returns from the "Calculate A Lap" subroutine to the subroutine that initiated the "Calculate A Lap" subroutine (either the "Process Player Start" subroutine or the "Make Lap Decision" subroutine).

Figure 24I:
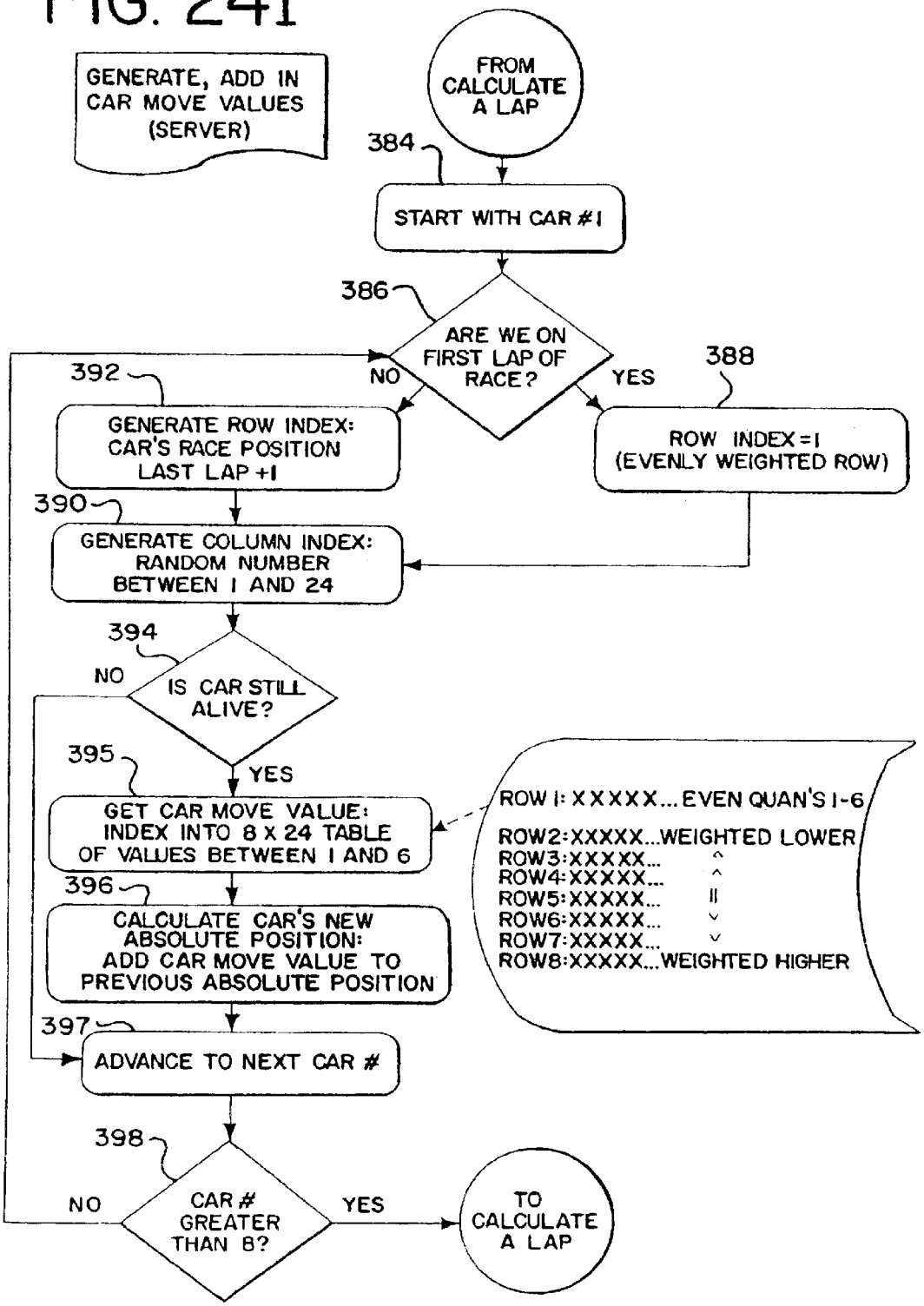

FIG. 24I illustrates the steps of the "Generate, Add In Car Move Values" subroutine at step 376 of FIG. 24H. In step 384, the server program initiates a loop to calculate the car move value for each of the eight cars. The server program then determines if the race game is in the first or subsequent laps of the racing game in step 386. If the race is in the first lap, a row index for the specific car is set to one in step 388. This is completed so that the row used for each car is the evenly weighted first row in the first lap of the racing game. The server program then generates a column index for the specific car in step 390. The column index is a random number between 1 and 24.

If the game is in a subsequent lap of the racing game, the program calculates the row index for the specific car in step 392. The row index is the specific car's "race position" of the last lap plus one. This gives cars that are further back a higher expected result. Once the row index is calculated, the server program proceeds to complete step 390, described above.

After step 390 is completed, the server program verifies if the car is still alive and in the race in step 394. If the car is not alive, the server program indexes to the next car in step 397. If the car is still alive, the server program obtains the car move value from the 8×24 table using the row index and column index computed above. Then in step 396, the server program calculates the car's new absolute position which is the "Car Move Value" added to the car's previous absolute position. Once the car's new absolute position is determined, the server program proceeds to index to the next car as described above in step 397. The server program then determines if the car number has indexed to greater than eight in step 398. If the car number is greater than eight, the server program returns to the "Calculate A Lap" subroutine. If the car number is not greater than eight, the server program returns to the beginning of the loop (step 386) to calculate the car move value for the next car.

Figure 24J:
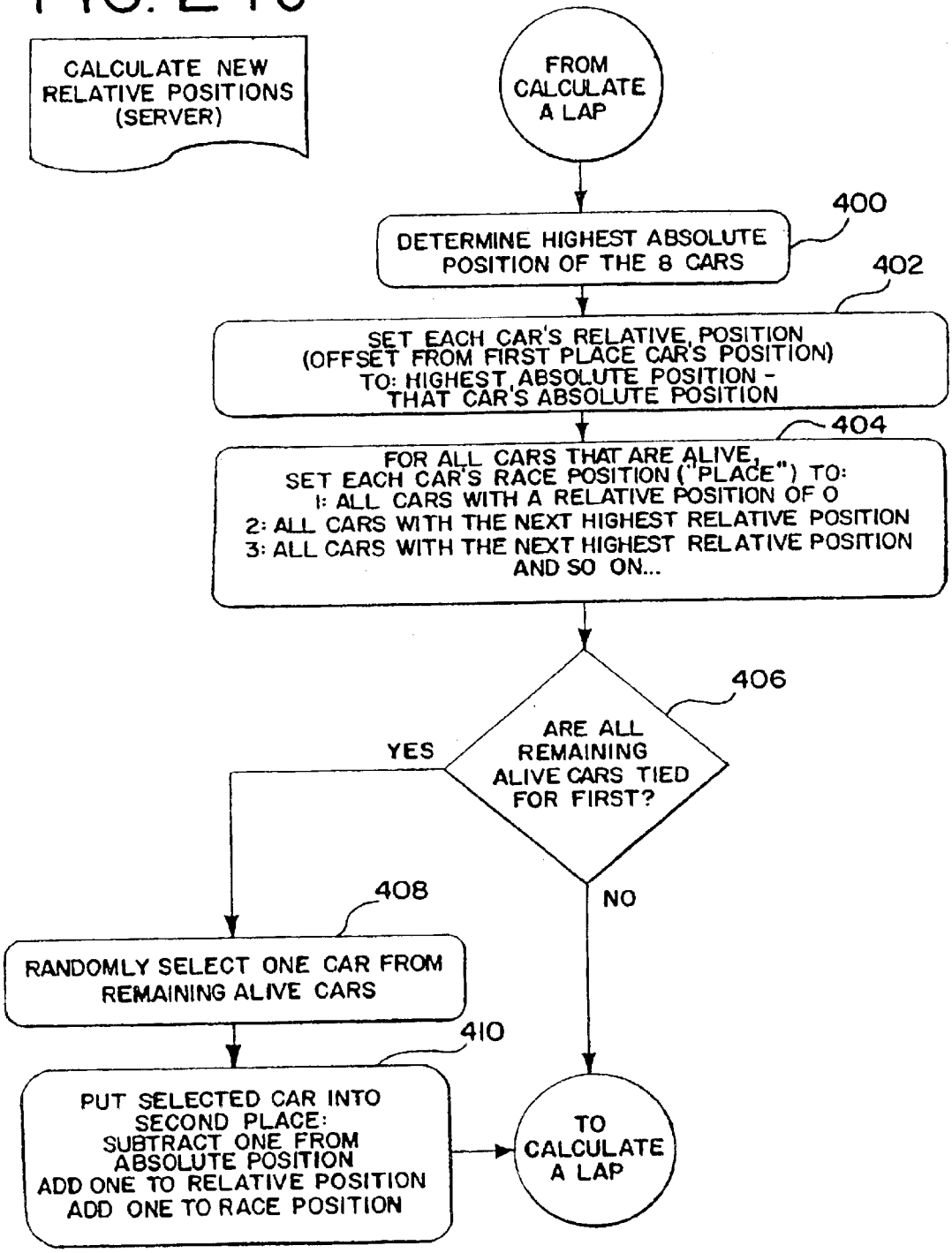

FIG. 24J illustrates the steps of the "Calculate New Relative Positions" subroutine at step 378 of FIG. 24H. In step 400, the server program determines which of the eight cars is in the highest absolute position. Next, the server program calculates the relative position of each car by subtracting the car's absolute position from the highest absolute position in step 402. The program then sets the race position for each car that is still alive in the game in step 404. The race position is determined by each car's relative position. Cars with a relative position of zero are placed first and the remaining cars are placed according to the next highest relative position.

In step 406, the program determines if all remaining alive cars are tied for first place. If all of the remaining cars are not tied for first place, then the program returns to the "Calculate A Lap" subroutine. If all of the remaining alive cars are tied for first place, then the program randomly selects one of the remaining alive cars in step 408. The server program then repositions the randomly selected car into second place in the racing game by subtracting one from the absolute position, adding one to the relative position, and adding one to the race position in step 410. After step 410 is completed, the server program returns to the "Calculate A Lap" subroutine of FIG. 24H.

Figure 24K:
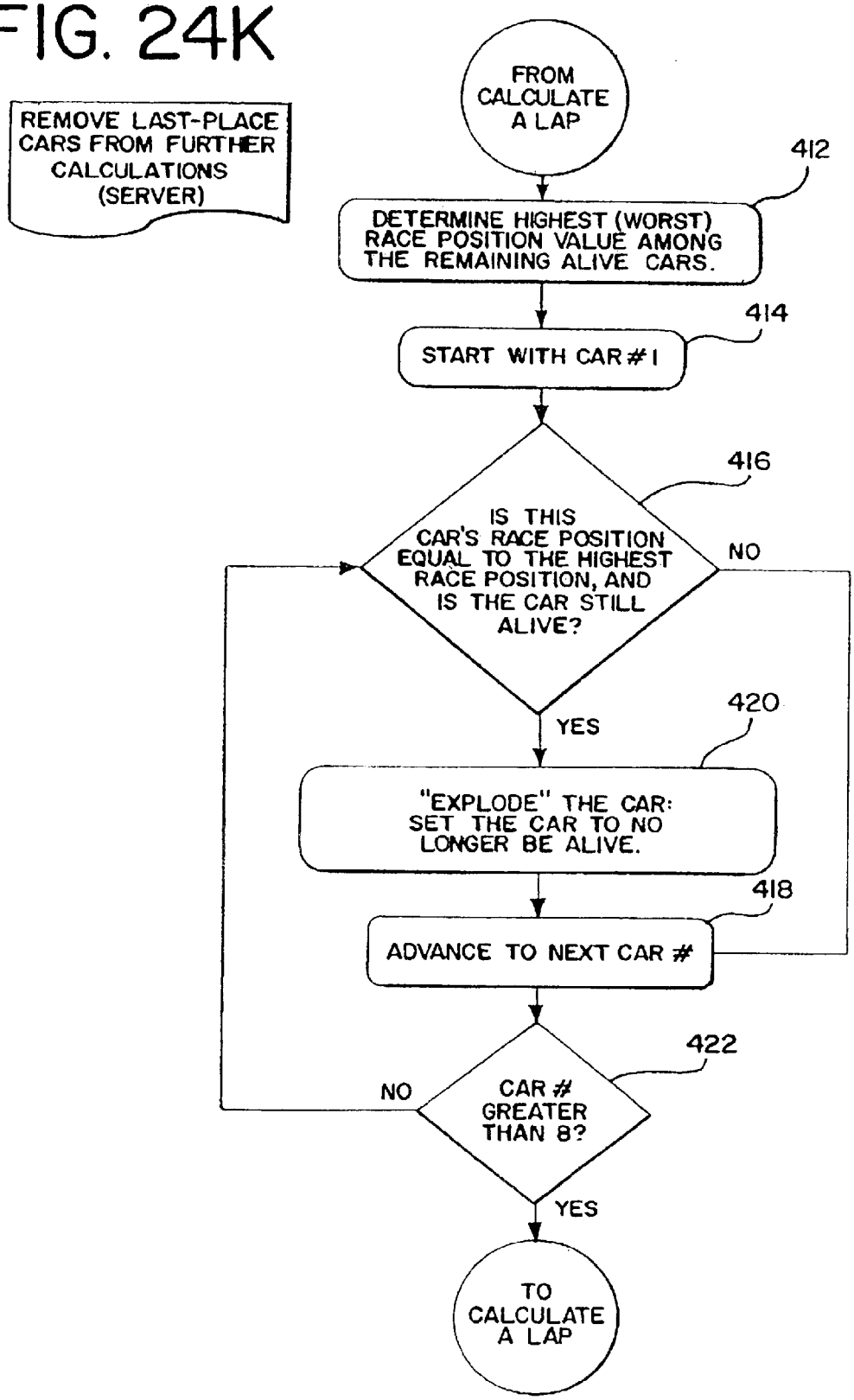

FIG. 24K illustrates the steps of the "Remove Last-Place Cars From Further Calculations" subroutine at step 380 of FIG. 24H. In step 412, the server program determines the highest or worst race position value among the remaining cars. In steps 414 and 416, the program starts with the number one car (not necessarily the car in first place), determines if the car's race position is equal to the highest or worst race position, and determines if the car is still alive (active in the race). If the car's race position is not the highest or worst race position, or if the car is no longer active, then the program indexes to the next car in step 418.

If the car's race position is the highest or worst race position in step 416, then the car is set to no longer be alive in step 420. The program then indexes to the next car in step 418.

The program then determines if the indexed car number is greater than eight in step 422. If the indexed car number is not greater than eight, the program returns to step 416 to look at the next car. If the indexed car number is greater than eight, the program returns to the "Calculate A Lap" subroutine.

Figure 25C:
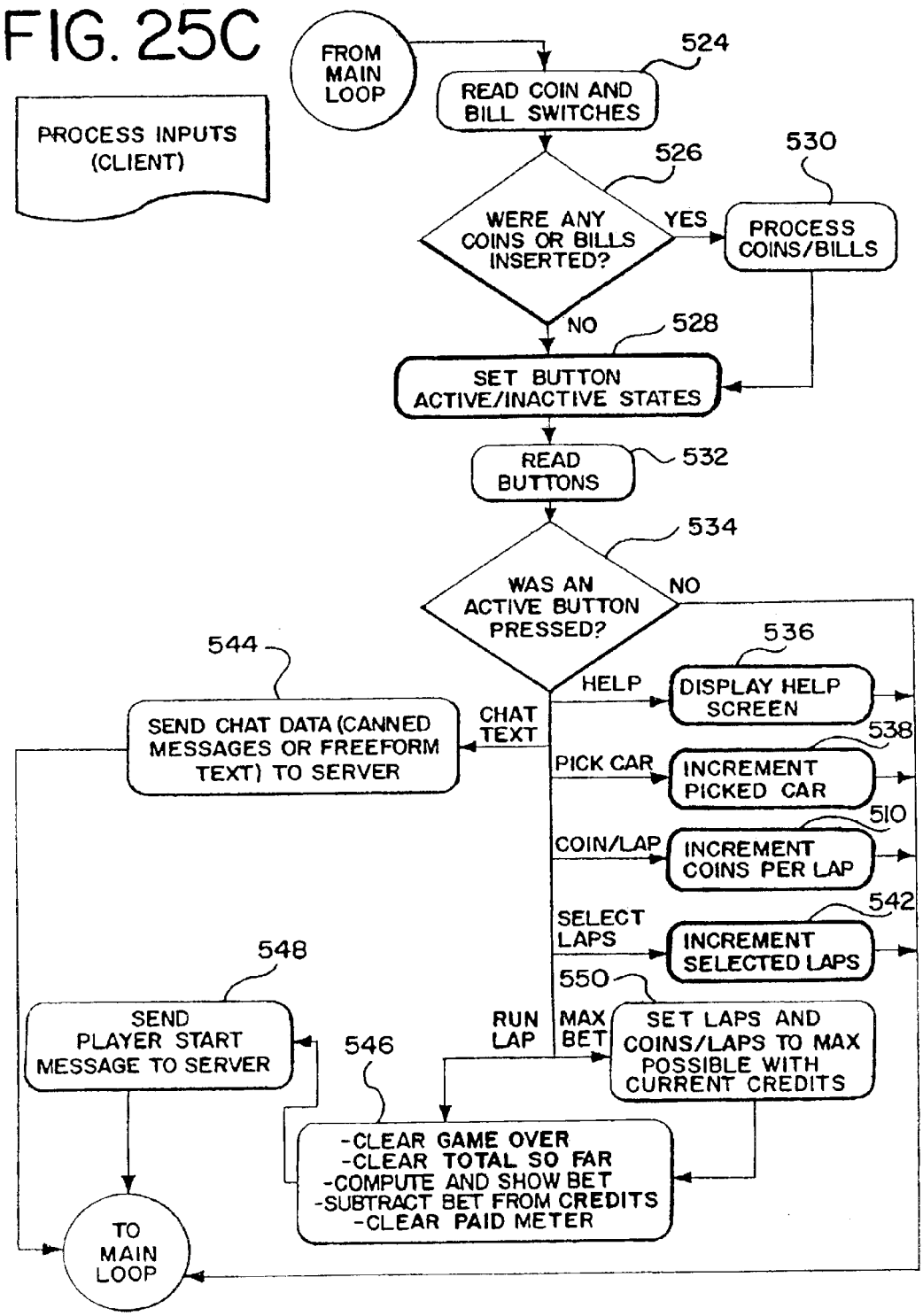

The "client" program to be used or operated on a computerized gambling machine linked to a server of a network of computerized gambling machines described above is operationally summarized in the flow charts of FIGS. 25A through 25K. FIG. 25A generally describes a startup program of the multiplayer client (player) program. From the start of the program 500, step 502 prompts a new player to enter a name, sign or handle (e.g., 60*a*, 60*b*, 60*c* of FIG. 19) on a computerized gambling machine for registration and recognition by other players of the networked racing game. After the new player is signed on, the machine (i.e., client program) attempts to establish a connection to the server, notify the server of the new player, and in turn, the server notifies any current or future players the names of the new player in step 504.

In step 506, the client program verifies if the attempt to establish a connection to the server was successful. If the connection was not successful, the client program returns to step 504 to try the connection again. If the connection was successful, the program proceeds to step 508 in a Main Loop 510 of the networked racing game.

FIG. 25B generally describes the Main Loop 510 of the client side of the racing game. The first element of the Main Loop is step 508 which initiates a "Process Inputs" subroutine, described hereinafter, to process any actuation of a plurality of active buttons which include a "Help" button 25 (e.g., FIG. 1), a "Pick Your Car" button 26 (e.g., FIG. 19), a "Coins Per Lap" button 23, a "Select Laps" button 18, a "Run Lap" button 28, a "Max Bet Race" button 29, or the input of chat text 61 from a physical (or virtual) keyboard as shown in FIG. 19.

After returning from the "Process Inputs" subroutine, described hereinafter, the client program determines if a timing window is to be displayed on the machine to notify the player that a race is about to start in step 512. If a timing window is not needed, the program proceeds to step 514 which initiates a "Try to Run A Lap" subroutine, described hereinafter, to attempt to complete one lap of the race. If a timing window is needed, the program displays a timing window in step 516 to display a countdown of the time remaining before the race. After completing step 516, the client program proceeds to step 514 which initiates the "Try to Run A Lap" subroutine, described hereinafter, to attempt to complete one lap of the race.

After returning from the "Try to Run A Lap" subroutine, described hereinafter, the client program determines if a "Game Over" state was set by a server message in step 518. If the "Game Over" state is not set, then the program loops back to complete step 508 again. This "Game Over" is local (to that client/machine), and may be set while "Server Game Over" is still clear and other cars (players) are still racing.

If the "Game Over" state is set, the client program illuminates a "Game Over" indicator in step 520 for that particular player. Any credits won on a wager or bet are displayed in a "Total So Far" credit meter 17 (e.g., FIG. 19) and transferred to the credits meter 14 in a visual and audio "Bang Up" fashion, and a "Paid" meter 16 is illuminated in step 522 and the game for that player is over. After step 522 is completed, the client program returns to step 508 and continues any processing.

FIG. 25C illustrates the steps of the "Process Inputs" subroutine at step 508 of FIG. 25B. The first element is a reading of a coin switch, a dollar bill acceptor, and a credit card reader at step 524. Next at step 526, an assessment of whether a coin, a dollar bill, or a credit card were inserted into the racing game. If no coin, bill, or credit card was inserted, then the program initiates a "Set Button Active/Inactive States" subroutine, described hereinafter, at step 528. If a coin, dollar bill, or credit card were inserted, it is processed at step 530 and a credit(s) is registered and displayed at the "Credits" meter 14 (e.g., FIG. 19). After step 530 is completed, the program initiates the "Set Button Active/Inactive States" subroutine at step 528, described hereinafter.

After the game returns from the "Set Button Active/Inactive States" subroutine at step 528, the client program proceeds to read all of the active player buttons at step 532. After the active player buttons have been read, a determination is made at step 534 of whether any of the active player buttons have been actuated by the player.

At this point, the player has many options on active buttons. The player may choose to actuate the "Help" button 25. If the "Help" button 25 is actuated, then the program initiates a "Display Help Screen" subroutine, described hereinafter, at step 536, to display a Help Display (e.g., FIG. 3). After the program has completed the "Display Help Screen" subroutine, described hereinafter, the program returns to the Main Loop of FIG. 25B at step 512.

The player may also choose to actuate the "Pick Your Car" button 26 (e.g., FIG. 19). If the "Pick Your Car" button 26 is actuated, then the program proceeds to an "Increment Picked Car" subroutine, described hereinafter, at step 538 to allow the player to select the car to use in the racing game. After the program has completed the "Increment Picked Car" subroutine, the program returns to the Main Loop at step 512.

The player may also choose to actuate the "Coins Per Lap" button 23. If the "Coins Per Lap" button 23 is actuated, the program proceeds to an "Increment Coins Per Lap" subroutine, described hereinafter, at step 540 to allow the player to increase or otherwise change a number of credits wagered on each lap of the racing game. After the program has completed the "Increment Coins Per Lap" subroutine, the program returns to the Main Loop at step 512.

The player may also choose to actuate the "Select Laps" button 18. If the "Select Laps" button 18 is actuated, the program proceeds to an "Increment Selected Laps" subroutine, described hereinafter, at step 542 to allow the player to increase or otherwise change the number of laps of the racing game. After the program has completed the "Increment Selected Laps" subroutine, the program is returned to the Main Loop at step 512. As noted above, for "Pick Your Car", "Coins Per Lap" and "Select Laps" buttons, the system preferably defaults to the last player settings.

The player may also choose to send a "chat" message at step 544, which then returns the player to the Main Loop at step 512.

Having made various selections as to car and wager, the player then may choose to actuate the "Run Lap" button 28 (e.g., FIG. 19). If the "Run Lap" button 28 is actuated, the program proceeds to step 546 where any "Game Over" indicator is cleared, the "Total So Far" meter 17 (e.g., FIG. 19) is cleared, the bet or wager of the game is computed and displayed in the "Bet" meter 15, the bet is subtracted from the credits and shown on the "Credits" meter 14 and the "Paid" meter 16 is cleared. After these functions are completed, the program sends a "Player Start" message to the server in step 548 and the multiplayer client program returns to the Main Loop of the client program.

If the "Max Bet Race" button 29 is actuated, the program proceeds to step 550 and assesses the total credits the player has provided, determines the maximum number of laps and the maximum number of credits per lap (per an embedded look-up table) which can be played for the credits shown in the "Credits" meter 14, up to a fixed maximum for the game. The program then proceeds to step 546.

Figure 25D:
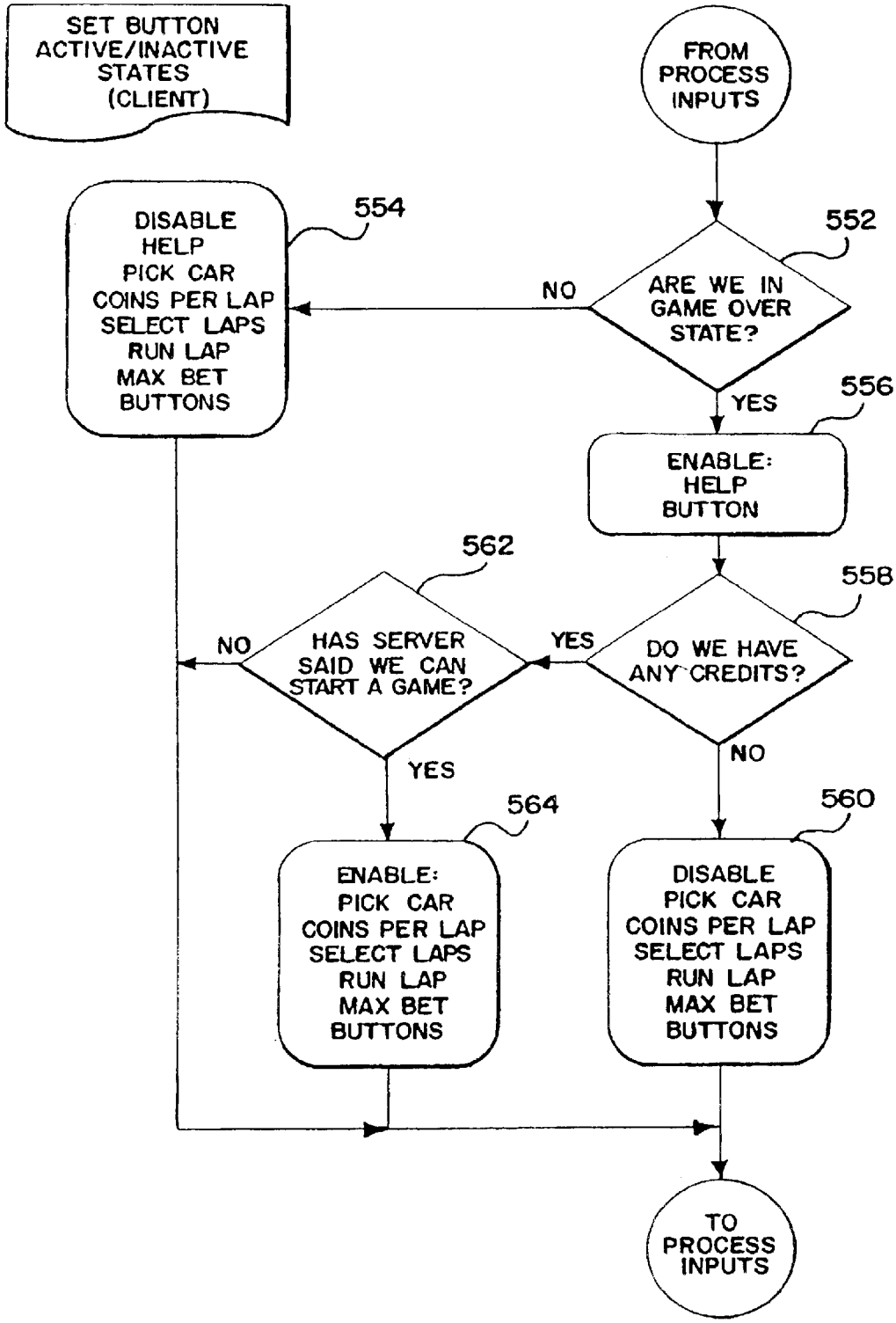

FIG. 25D depicts the "Set Button Active/Inactive States" subroutine at step 528 of FIG. 25C. The "Set button Active/Inactive States" subroutine begins at step 552 with a determination of whether the local game is in the "Game Over" state.

If the game is in the "Game Over" state, the client program proceeds to step 556 and enables the "Help" button 25. A determination is then made in step 558 of whether the player has any credits for playing the game. If the player does have one or more credits, then the program determines if the server will allow a new game to start in step 562. If the server will allow a new game to start, then the "Pick Your Car" button 26 (e.g., FIG. 19), the "Coins Per Lap" button 23, the "Select Laps" button 18, the "Run Lap" button 28, and the "Max Bet Race" button 29 are enabled in step 564, and the program returns to step 532 of the "Process Inputs" subroutine. If the server will not allow a new game to start, then the client program returns to step 532 of the "Process Inputs" subroutine without enabling any other buttons.

Referring back to step 558, if the player does not have sufficient credits, then the foregoing buttons are disabled in step 560, and the program returns to step 532 of the "Process Inputs" subroutine.

Referring back to step 552, if the local game is not in the "Game Over" state, the game proceeds to step 554 and disables the "Help" button 25, the "Pick Your Car" button 26, the "Coins Per Lap" button 23, the "Select Laps" button 18, and the "Max Bet Race" button 29, and the program returns to step 532 of the "Process Inputs" subroutine.

FIG. 25E depicts the "Display Help Screen" subroutine at step 536 of FIG. 25C. When the "Display Help Screen" subroutine is initiated, the program suspends the game, fades out the game on the display and fades in the Help Display (FIG. 3) in step 566. Next, the program proceeds to read an "Exit" button 27 (FIG. 3) at step 568. A determination is made of whether the "Exit" button 27 has been actuated by a player at step 570. If the "Exit" button 27 has not been actuated, the program returns to step 568 and cycles through to step 570 until the player actuates the "Exit" button 27.

If the "Exit" button 27 has been actuated, the program resumes the game, fades out the Help Display and fades in the game on the display in step 572. Once step 572 is completed, the program returns to the "Process Inputs" subroutine and back to the Main Loop 510 at step 512.

Figure 25F:
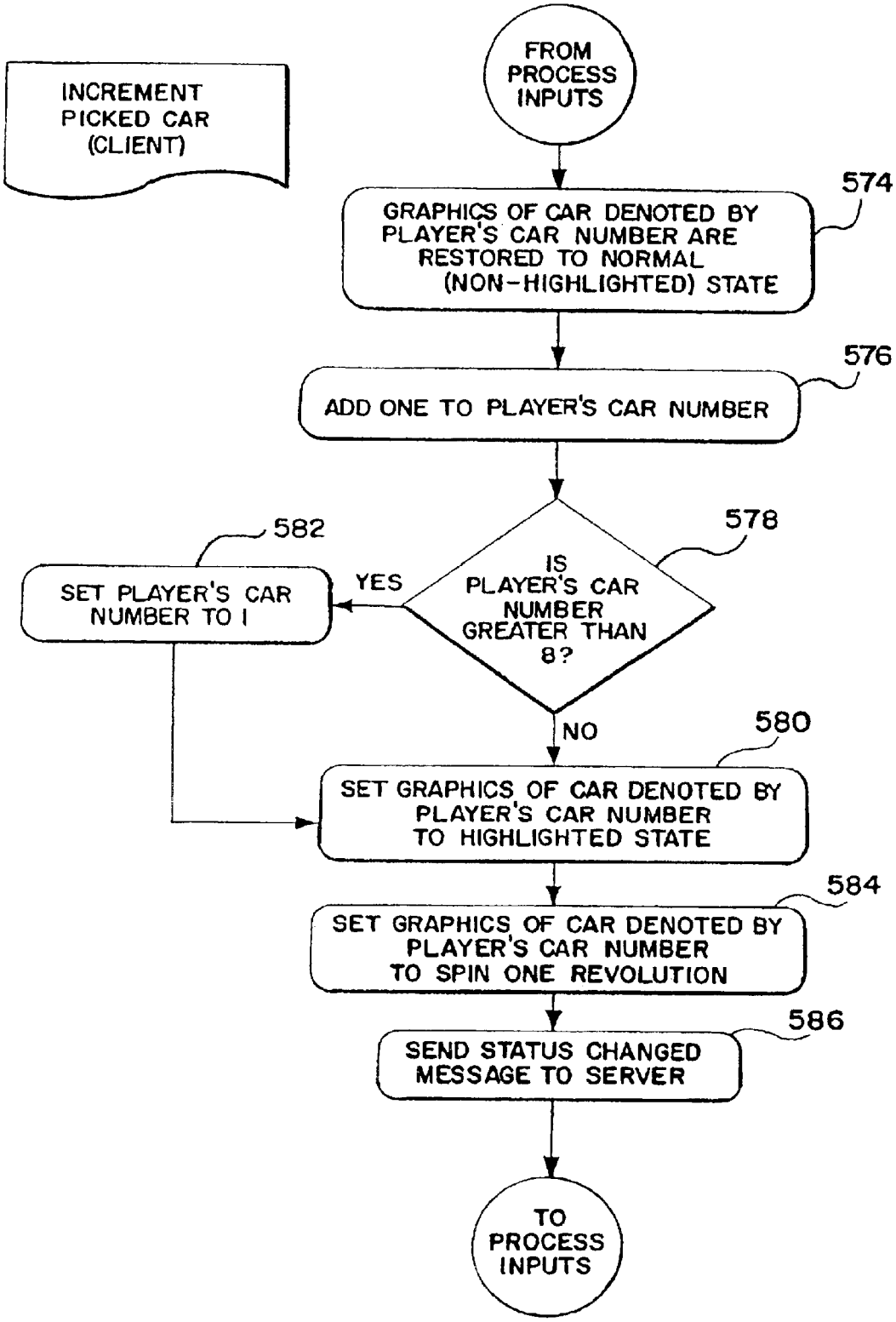

FIG. 25F depicts the "Increment Picked Car" subroutine at step 538 of FIG. 25C. When the "Increment Picked Car" subroutine is initiated, the graphic display of a car denoted by (the former) "Player's Car Number" is displayed on the display in a "Normal" (non-highlighted) state in step 574. The program then adds one increment to the car number denoted by the "Player's Car Number" in step 576. Next at step 578, a determination is made of whether the "Player's Car Number" is greater than eight. If the "Player's Car Number" is not greater than eight, then a graphic display of a car denoted by the (new) "Player's Car Number" is highlighted on the display in step 580. If the "Player's Car Number" is greater than eight, then the "Player's Car Number" is set to one in step 582, and the program displays a graphic display with the (new) car denoted by the "Player's Car Number" highlighted on the display in step 580.

Next, the program sets the graphic display of a car denoted by the "Player's Car Number" to visually spin one revolution on the display in step 584. The program sends a "Status Changed" message to the server in step 586. Once step 586 is completed, the program returns to the "Process Inputs" subroutine and back to the Main Loop at step 512.

Figures 25G, 25H:
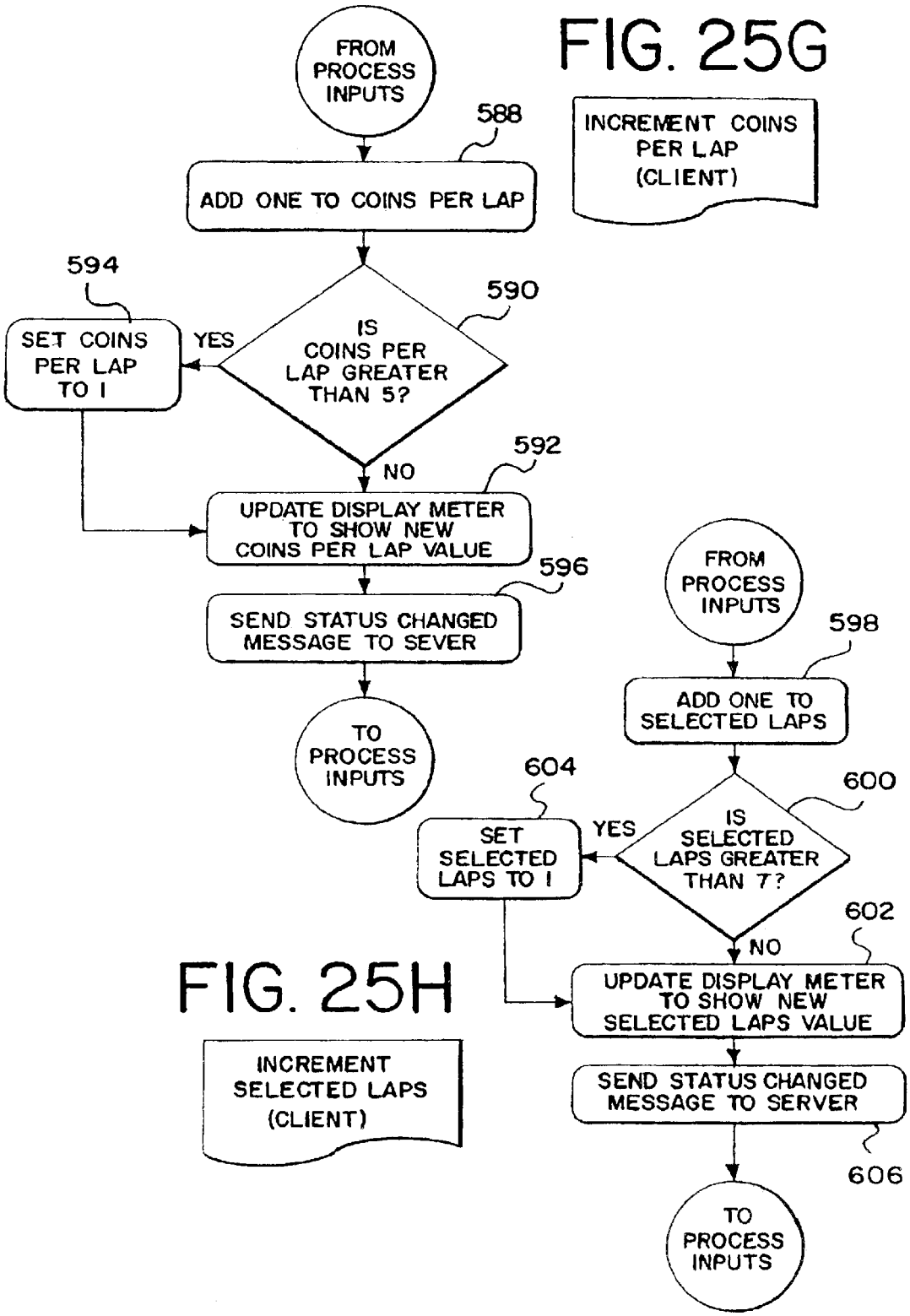

FIG. 25G illustrates the steps of the "Increment Coins Per Lap" subroutine at step 540 of FIG. 25C. First, the program increments or increases the number of "Coins Per Lap" wager amount by one credit in step 588. A determination is then made in step 590 of whether the "Coins Per Lap" wager amount is greater than five. If the "Coins Per Lap" wager amount is not greater than five, then the "Coins Per Lap" meter 23 is updated to reflect the value of the "Coins Per Lap" wager amount in step 592. If the "Coins Per Lap" wager amount is greater than five, then the "Coins Per Lap" wager amount is set to one in step 594, and the "Coins Per Lap" meter 23 is updated to reflect the value of "1" in step 592. Once step 592 is completed, the program sends a "Status Changed" message to the server in step 596 and the returns to the "Process Inputs" subroutine and back to the Main Loop at step 512.

FIG. 25H shows the steps completed in the "Increment Selected Laps" subroutine at step 542 of FIG. 25C. When the "Increment Selected Laps" subroutine is initiated, the "Selected Laps" wager amount is incremented or increased by one lap in step 598. A determination is then made in step 600 of whether the "Selected Laps" wager amount is greater than seven. If the "Selected Laps" wager amount is not greater than seven, then the "Selected Laps" meter 18 is updated to reflect the value of the "Selected Laps" wager amount in step 602. If the "Selected Laps" wager amount is greater than seven, then the "Selected Laps" wager amount is set to one in step 604, and the "Selected Laps" meter 18 is updated to reflect the value of "1" in step 602. Once step 602 is completed, the program sends a "Status Changed" message to the server in step 606 and the program returns to the "Process Inputs" subroutine and back to the Main Loop at step 512.

Figure 25I:
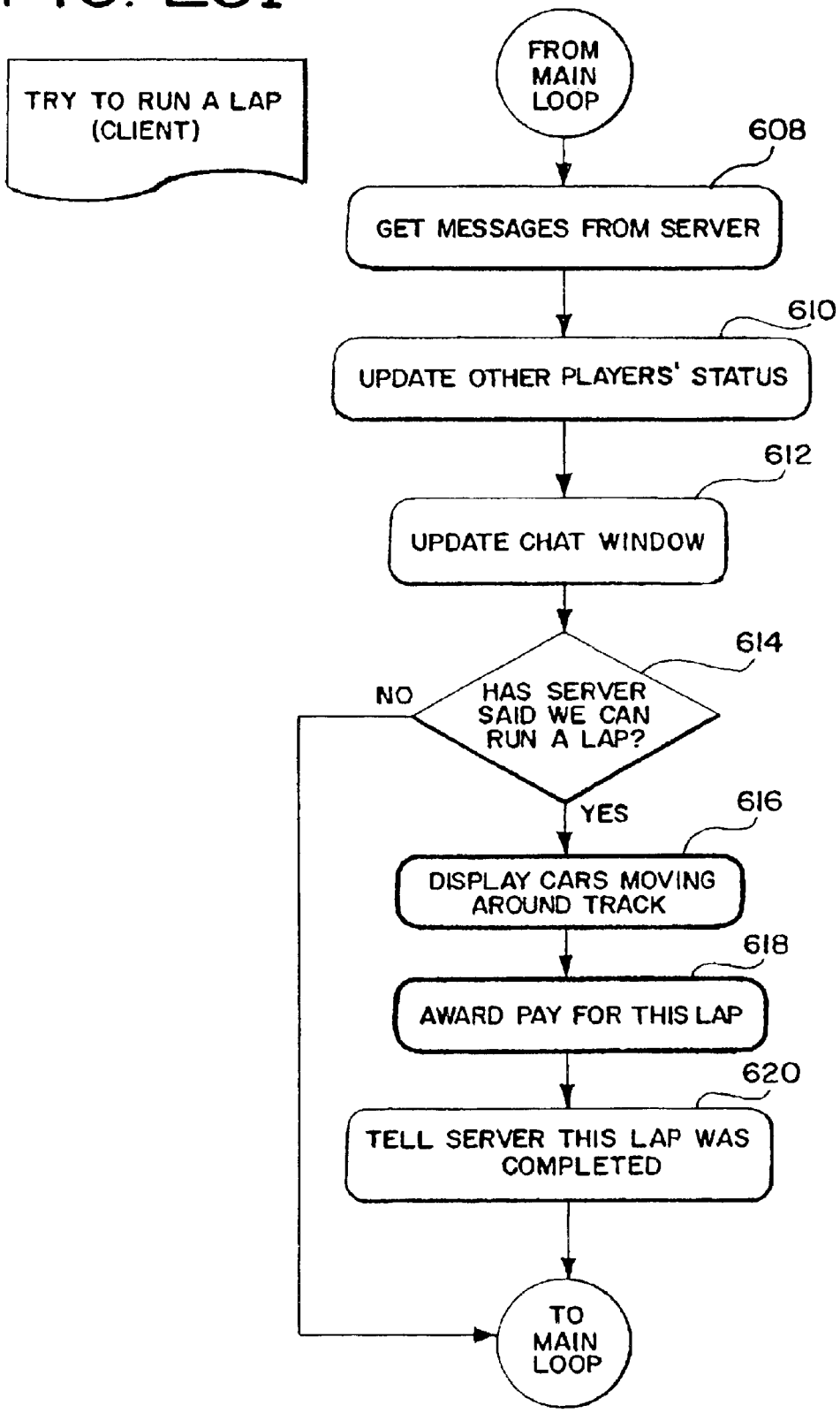

FIG. 25I depicts the "Try To Run A Lap" subroutine at step 514 of FIG. 25B. First the program checks and acquires any messages from the server in step 608. The client program updates the other players' data, if any, in step 610. Next, the client program updates the Chat Window in step 612 with any relevant information from the server. In step 614, the program verifies with the server if a lap can be run at this time. If a lap cannot be run at this time, the program returns to the Main Loop at step 518.

If a lap can be run, the program initiates a "Display Cars Moving Around Track" subroutine, described hereinafter, in step 616 to display the cars moving around the oval track in such a manner that at the end of the lap the cars are displayed in the new relative positions. After the program has completed the "Display Cars Moving Around Track" subroutine, the program returns to the "Try To Run A Lap" subroutine. At step 618, the program initiates an "Award Pay For This Lap" subroutine, described hereinafter. After the program returns from the "Award Pay For This Lap" subroutine, the program informs the server that this lap has been completed, at step 620, and the program returns to the Main Loop at step 518.

Figure 25J:
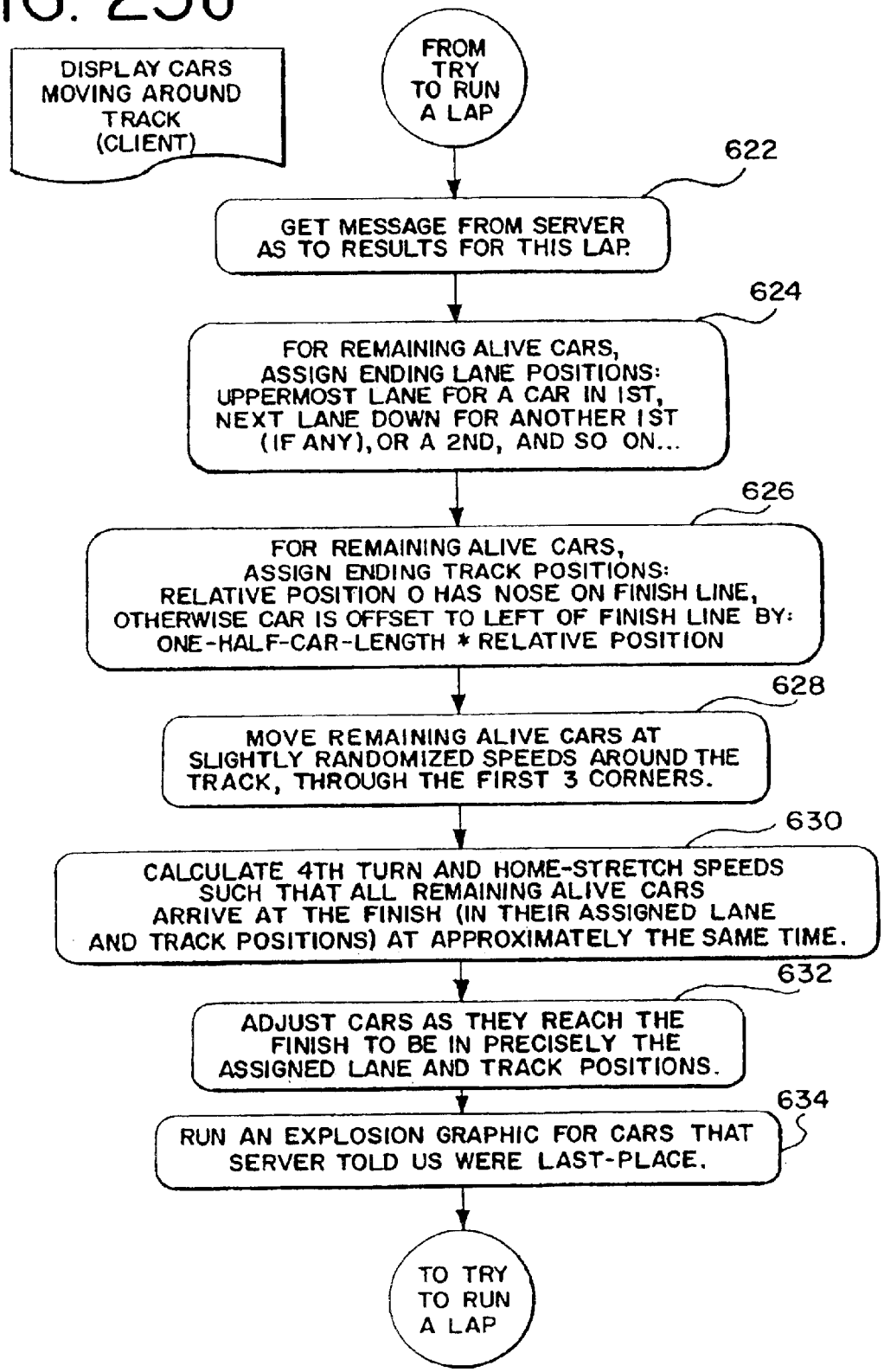

FIG. 25J illustrates the steps of the "Display Cars Moving Around Track" subroutine at step 616 of the "Try To Run A Lap" subroutine. In step 622, the program acquires a message from the server regarding the results for this lap. The program assigns each alive car an ending lane position for completing the lap in step 624. The lanes are assigned such that the innermost lane is assigned to the car in first place. The next innermost lane is assigned to the car in next place. This manner of lane assignments is continued for all alive cars.

The program then assigns ending track positions for all remaining alive cars in step 626. The car with a relative position of zero is assigned an ending track position of the front tip or nose of the car to be on the finish line of the racetrack. Then each of the remaining alive cars is assigned an ending track position that is offset to the left of the finish. The offset of each of the remaining cars is determined by the relative position of the car multiplied by one half-car length.

In step 628, the program then displays the remaining alive cars to be moving around the oval racetrack image at slightly randomized speeds through the first three corners of the lap. The program then calculates the fourth turn of the lap and homestretch speeds such that all remaining alive cars arrive in their assigned lane and ending track positions at approximately the same time in step 630. The program then continues to display the remaining alive cars and adjusts each of the cars in speed and position to arrive at its respective ending lane position and ending track position at approximately the same time in step 632, with the final (stopped) position being the precise position previously calculated. At step 634, the program replaces a car graphic with an explosion graphic according to the message from the server as to which car or cars are in last place in the game and these cars are set to no longer be alive. The program then returns to the "Try To Run A Lap" subroutine to complete step 618.

Figure 25K:
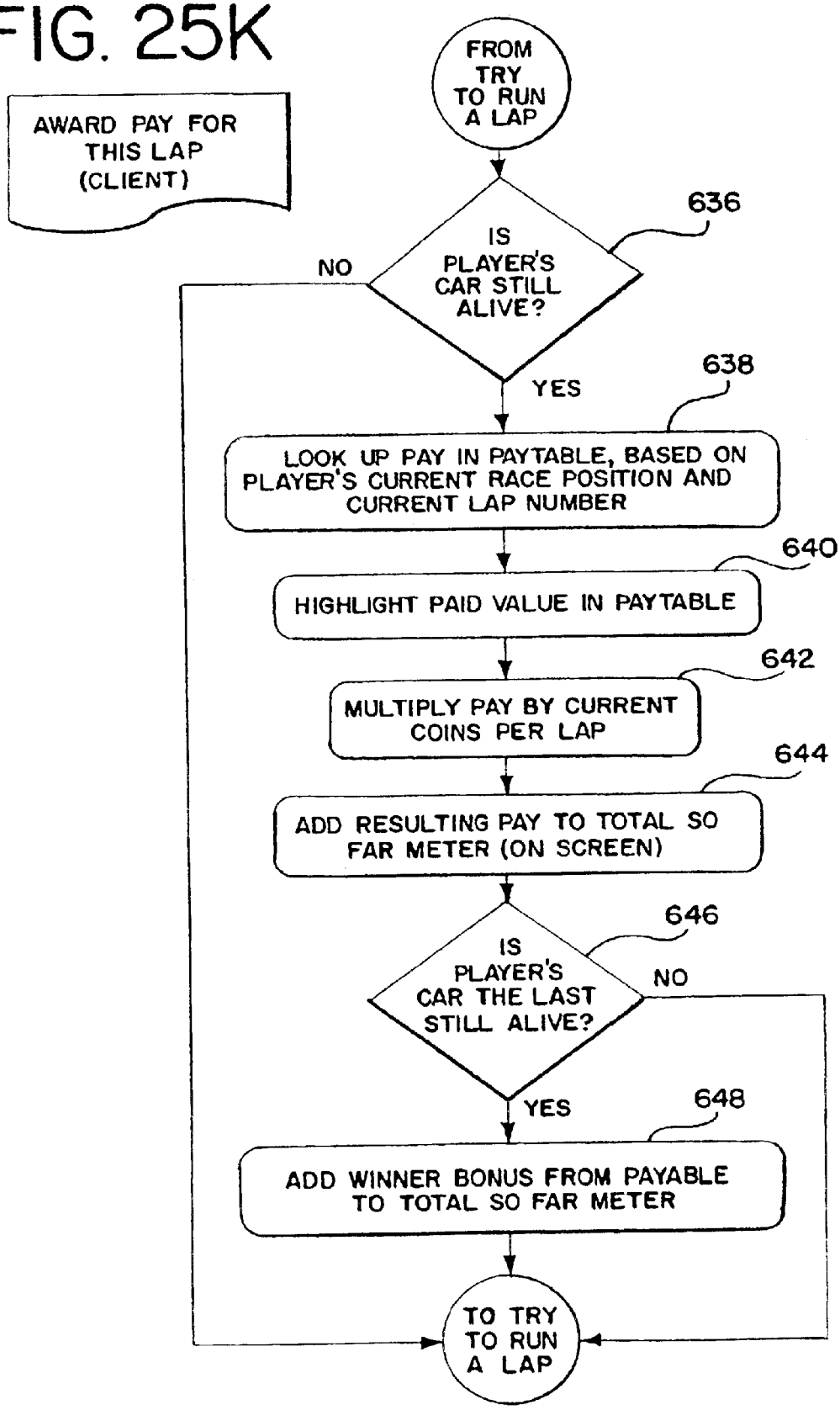

FIG. 25K illustrates the steps of the "Award Pay For This Lap" subroutine at step 618 of the "Try To Run A Lap" subroutine. In step 636, the client program determines if the player's car is still alive. If the player's car is not alive, the program returns to "Try To Run A Lap" subroutine. If the player's car is still alive, the client program obtains a pay award from a predetermined paytable 13 (e.g., FIG. 19) for current race position and lap number of the player's car in step 638. The program highlights the pay award in the paytable 13 in step 640. At step 642, the program multiplies the pay award by the value of the "Coins Per Lap" meter 23. A resulting pay award value is then added to the value of the "Total So Far" meter 17 and displayed in step 644.

The program then determines if the player's car is the only car still alive in step 646. If the player's car is not the only car that is still alive, then the program returns to the "Try To Run A Lap" subroutine. If the player's car is the only car that is still alive, the program determines the appropriate winner bonus from the paytable and adds the value to the "Total So Far" meter 17 in step 648. The program returns to the "Try To Run A Lap" subroutine ready to complete step 620.

Thus, while the present invention has been described with respect to a particular embodiment, those of skill in this art will recognize even more variations, applications and modifications which will still fall within the spirit and scope of the invention, all as intended to come within the ambit and reach of the following claims.

What is claimed is:

1. A race game comprising the steps of:

providing a racetrack;

providing a plurality of racers;

providing a program by which said racers are variously moved about said racetrack, said program including a function for randomly assigning a finishing position for racers at the end of a race;

providing a player interface with said program for player input commands;

selecting a racer as the player's racer;

initiating a first race;

(i) eliminating at least one racer as a result of a predetermined threshold finishing position required at the end of a race;

(ii) continuing play with another race provided said player's racer has not been eliminated and the player has previously placed a wager on said another race;

repeating steps (i) and (ii) until a predetermined game-ending condition occurs.

2. The race game of claim 1 wherein said game-ending condition is any of the following: said player's racer has been eliminated; a predetermined number of races have been run.

3. The race game of claim 1 wherein said game-ending condition can be each of the following: said player's racer has been eliminated; a predetermined number of races have been run.

4. The race game of claim 3 wherein said game-ending condition can further include: the number of racers, inclusive of the player's racer, is below a predetermined minimum number.

5. A race game comprising:

a racetrack;

a plurality of racers;

a methodology by which said racers are variously moved about said racetrack, said methodology including a function for randomly assigning a finishing position for racers at the end of a race;

selecting a racer as the player's racer;

initiating a first race;

(i) eliminating at least one racer as a result of a predetermined threshold finishing position required at the end of a race;

(ii) continuing play with another race provided said player's racer has not been eliminated and the player has previously placed a wager on said another race;

repeating steps (i) and (ii) until a predetermined game-ending condition occurs.

6. The race game of claim 5 wherein said game-ending condition is any of the following: said player's racer has been eliminated; a predetermined number of races have been run.

7. The race game of claim 5 wherein said game-ending condition can be each of the following: said player's racer has been eliminated; a predetermined number of races have been run.

8. The race game of claim 7 wherein said game-ending condition can further include: the number of racers, inclusive of the player's racer, is below a predetermined minimum number.

9. A race game for a video gaming machine, wherein said gaming machine includes a video display, a cpu including a program for driving the display and operating the game, and a player input mechanism interfacing with the cpu, comprising the steps of:

generating a racetrack and a plurality of racers;

said program including a function for randomly assigning a finishing position for racers at the end of a race;

selecting a racer as the player's racer;

inputting a wager by the player including the number of races desired to be completed up to a preset maximum number for the game;

initiating a first race;

(i) eliminating at least one racer as a result of a predetermined threshold finishing position required at the end of a race;

(ii) continuing play with another race provided said player's racer has not been eliminated and a wager was placed on a next race;

repeating steps (i) and (ii) until a predetermined game-ending condition occurs; and providing a payout based upon the number of races completed by the player's racer and the finishing position of the player's racer in each race.

10. The race game of claim 9 wherein any wager placed upon a race which is not run because of a game-ending event is lost.

11. The race game of claim 10 wherein the program includes a paytable, said paytable providing increasingly higher payouts for at least some races completed after said first race.

12. The race game of claim 11 wherein a bonus round is entered if a player's racer is the last remaining racer at the end of a race.

13. The race game of claim 12 wherein said bonus round comprises selection by the player of at least one of a plurality of bonus items, each bonus item having a bonus value associated therewith revealed upon selection of said bonus item.

14. The race game of claim 9 wherein said racers are vehicle representations, and a racer is eliminated through an explosive destruction sequence executed at the end of a race.

15. The race game of claim 9 wherein a game-ending condition occurs when a predetermined number of racers equals a predetermined number of finishing places for which a payout is provided.

16. The race game of claim 9, wherein said game-ending condition is any of the following: said player's racer has been eliminated; a predetermined number of races have been run.

17. The race game of claim 9 wherein said game-ending condition can be each of the following: said player's racer has been eliminated; a predetermined number of races have been run.

18. The race game of claim 17 wherein said game-ending condition can further include: the number of racers, inclusive of the player's racer, is below a predetermined minimum number.

19. A race game for play on a gaming machine, wherein said gaming machine includes a video display, a cpu including a program for driving the display and operating the game, and a player input mechanism interfacing with the cpu, comprising the steps of:

generating a raceway and a plurality of racers;

inputting a wager by the player;

selecting a racer as the player's racer;

initiating a race;

randomly assigning a finishing position for racers at the end of a race;

continuing play with another race provided said player's racer has not met a predetermined game-ending criterion and the player has previously placed a wager on said another race.

20. The race game of claim 19 further including providing a payout based upon the number of races completed by the player's racer and the finishing position of the player's racer in each race.

21. The race game of claim 19 further including providing a payout for each race based upon the finishing position of the player's racer in a respective race.

22. The race game of claim 21 wherein said wager includes player selection of a consecutive number of races desired to be run up to a preset maximum number of races to the game, and wherein any wager placed upon a race which is not run because of a game-ending criterion is lost.

23. The race game of claim 22 wherein the program includes a paytable, said paytable providing increasingly higher payouts for at least some races completed after a first race.

24. The race game of claim 23 wherein a bonus round is entered if a player's racer is the last remaining racer at the end of a race.

25. The race game of claim 24 wherein said bonus round comprises selection by the player of at least one of a plurality of bonus items, each bonus item having a bonus value associated therewith revealed upon selection of said bonus item.

26. The race game of claim 19 wherein a starting position for a player's racer in said another race is based upon the finishing position of said player's racer in the race just completed.

27. The race game of claim 26 wherein said starting position for a player's racer is the finishing position of said player's racer in the race just completed.

28. The race game of claim 27 further including the steps of eliminating at least one racer as a result of a predetermined threshold finishing position required at the end of a race; and continuing play with another race until one of the following occurs constituting a game-ending criterion: said player's racer has been eliminated; or a predetermined number of races have been completed.

29. The race game of claim 19 further including the steps of eliminating at least one racer as a result of a predetermined threshold finishing position required at the end of a race; and continuing play with another race until one of the following occurs constituting a game-ending criterion: said player's racer has been eliminated; or a predetermined number of races have been completed.

30. The race game of claim 29 further including providing a payout for each race based upon the finishing position of the player's racer in a respective race.

31. The race game of claim 30 wherein any wager placed upon a race which is not run because of a game-ending criterion is lost.

32. The race game of claim 31 wherein the program includes a paytable, said paytable providing increasingly higher payouts for at least some races completed afler a first race.

33. The race game of claim 32 wherein a starting position for a player's racer in said another race is based upon the finishing position of said player's racer in the race just completed.

34. The race game of claim 33 wherein said starting position for a player's racer is the finishing position of said player's racer in the race just completed.

35. The race game of claim 34 wherein a game-ending criterion further includes a predetermined number of racers remaining which equals the number of finishing places for which payout is provided.

36. The race game of claim 32 wherein a bonus round is entered if a player's racer is the last remaining racer at the end of a race.

37. The race game of claim 36 wherein said bonus round comprises selection by the player of at least one of a plurality of bonus items, each bonus item having a bonus value associated therewith revealed upon selection of said bonus item.

38. The race game of claim 29 wherein said raceway is a swimming area, said racer is a swimmer, and elimination of a swimmer comprises a sequence depicting a sea creature eating said swimmer.

39. The race game of claim 29 wherein said raceway is a vehicular race track, said racer is a motor vehicle, and elimination of a motor vehicle comprises a sequence depicting destruction of said vehicle.

40. The race game of claim 19 wherein said raceway is a swimming area, and said racer is a swimmer.

41. The race game of claim 19 wherein said raceway is a vehicular race track, and said racer is a motor vehicle.

42. A gaming machine, comprising:

a video display;

a cpu including a program for driving said display and operating a game;

a player input mechanism interfacing with said cpu;

a raceway formed on said display;

a plurality of racers generated by said program and depicted on said display;

said player input mechanism including an input for a wager by the player;

a racer designated as the player's racer;

a race run by said program, wherein a finishing position for racers at the end of a race is randomly assigned to said racers;

another race being provided in the event that said player's racer has not met a predetermined game-ending criterion at the end of a race and the player has previously placed a wager on said another race.

43. The gaming machine of claim 42 further including a payout based upon the number of races completed by the player's racer and the finishing position of the player's racer in each race.

44. The gaming machine of claim 42 further including a payout for each race based upon the finishing position of the player's racer in a respective race.

45. The gaming machine of claim 44 wherein said wager input includes player selection of a consecutive number of races desired to be run up to a preset maximum number of races to the game, with any wager placed upon a race which is not run because of a game-ending criterion being lost.

46. The gaming machine of claim 45 wherein said program includes a paytable, said paytable providing increasingly higher payouts for at least some races completed after a first race.

47. The gaming machine of claim 46 wherein a starting position for a player's racer in said another race is based upon the finishing position of said player's racer in the race just completed.

48. The gaming machine of claim 47 wherein said starting position for a player's racer is the finishing position of said player's racer in the race just completed.

49. The gaming machine of claim 48 wherein said program further eliminates at least one racer as a result of a predetermined threshold finishing position required at the end of a race, and continues play with another race until one of the following occurs constituting a game-ending criterion: said player's racer has been eliminated; a predetermined number of races have been completed.

50. The gaming machine of claim 49 wherein said predetermined threshold finishing position is a position other than last place.

51. The gaming machine of 49 wherein a bonus round is entered if a player's racer is the last remaining racer at the end of a race.

52. The gaming machine of claim 51 wherein said bonus round comprises selection by the player of at least one of a plurality of bonus items, each bonus item having a bonus value associated therewith revealed upon selection of said bonus item.

53. The gaming machine of claim 42 wherein said program further eliminates at least one racer as a result of a predetermined threshold finishing position required at the end of a race, and continuing play with another race until one of the following occurs constituting a game-ending criterion: said player's racer has been eliminated; a predetermined number of races have been completed.

54. The gaming machine of claim 53 further including providing a payout for each race based upon the finishing position of the player's racer in a respective race.

55. The gaming machine of claim 54 wherein any wager placed upon a race which is not run because of a game-ending criterion is lost.

56. The gaming machine of claim 55 wherein said program includes a paytable, said paytable providing increasingly higher payouts for at least some races completed after a first race.

57. The gaming machine of claim 56 wherein a starting position for a player's racer in said another race is the finishing position of said player's racer in the race just completed.

58. The gaming machine of claim 57 wherein a game-ending criterion further includes a number of racers remaining that equals a predetermined number of finishing places for which a payout is provided.

59. The gaming machine of claim 58 wherein said predetermined number of finishing places is first, second and third.

60. The gaming machine of claim 56 wherein a bonus round is entered if a player's racer is the last remaining racer at the end of a race.

61. The gaming machine of claim 60 wherein said bonus round comprises selection by the player of at least one of a plurality of bonus items, each bonus item having a bonus value associated therewith revealed upon selection of said bonus item.

62. A race game, comprising:

a raceway and a plurality of racers on said raceway;

placing a wager by a player;

selecting a racer as the player's racer;

initiating a race;

randomly assigning a finishing position for racers at the end of a race;

continuing play with another race provided said player's racer has not met a predetermined game-ending criterion and the player has previously placed a wager on said another race.

63. The race game of claim 62 further including:

a video display;

a cpu including a program for driving said display and operating the game;

a player input mechanism interfacing with said cpu;

said raceway formed on said display;

said plurality of racers generated by said program and depicted on said display.

64. The race game of claim 63 wherein said wager includes player selection of a consecutive number of races desired to be run up to a preset maximum number of races to the game, and any wager placed upon a race which is not run because of a game-ending criterion is lost.

65. The race game of claim 64 wherein a paytable is provided for said payout, said paytable providing increasingly higher payouts for at least some races completed after a first race.

66. The race game of claim 65 wherein a starting position for a player's racer in said another race is the finishing position of said player's racer in the race just completed.

67. The race game machine of 66 wherein at least one racer is eliminated as a result of a predetermined threshold finishing position required at the end of a race; and play continues with another race until one of the following occurs constituting a game-ending criterion: said player's racer has been eliminated; a predetermined number of races have been completed.

68. The race game of claim 67 wherein said predetermined threshold finishing position is a position other than last place.

69. The race game of claim 68 wherein there is more than one player in a game, each player placing a respective wager and selecting a racer as that player's respective racer.

70. The race game of claim 65 wherein a bonus round is entered if a player's racer is the last remaining racer at the end of a race.

71. The race game of claim 70 wherein said bonus round comprises selection by the player of at least one of a plurality of bonus items, each bonus item having a bonus value associated therewith revealed upon selection of said bonus item.

72. The race game of claim 62 further including a payout for each race based upon the finishing position of the player's racer in a respective race.

73. A method for operating a gaming machine, wherein said gaming machine includes a video display, a cpu including a program for driving the display and operating the game, and a player input mechanism interfacing with the cpu, comprising the steps of:

generating a raceway and a plurality of racers;

inputting a wager by the player, said wager including player selection of a consecutive number of races desired to be run up to a preset maximum number of races to the game;

selecting a racer as the player's racer;

initiating a race;

randomly assigning a finishing position for racers at the end of a race;

continuing play with another race provided said player's racer has not met a predetermined game-ending criterion and the player has previously placed a wager on said another race.

74. The method of claim 73 further including providing a payout based upon the number of races completed by the player's racer and the finishing position of the player's racer in each race.

75. The method of claim 73 further including providing a payout for each race based upon the finishing position of the player's racer in a respective race.

76. The method of claim 75 wherein any wager placed upon a race which is not run because of a game-ending criterion is lost.

77. The method of claim 76 wherein the program includes a paytable, said paytable providing increasingly higher payouts for at least some races completed after a first race.

78. The method of claim 73 wherein a starting position for a player's racer in said another race is based upon the finishing position of said player's racer in the race just completed.

79. The method of claim 78 wherein said starting position for a player's racer is the finishing position of said player's racer in the race just completed.

80. The method of claim 79 further including the steps of eliminating at least one racer as a result of a predetermined threshold finishing position required at the end of a race, and continuing play with another race until one of the following occurs constituting a game-ending criterion: said player's racer has been eliminated; a predetermined number of races have been completed.

81. The method of claim 80 wherein a bonus round is entered if a player's racer is the last remaining racer at the end of a race.

82. The method of claim 81 wherein said bonus round comprises selection by the player of at least one of a plurality of bonus items, each bonus item having a bonus value associated therewith revealed upon selection of said bonus item.

83. The method of claim 73 further including the steps of eliminating at least one racer as a result of a predetermined threshold finishing position required at the end of a race, and continuing play with another race until one of the following occurs constituting a game-ending criterion: said player's racer has been eliminated; a predetermined number of races have been completed.

84. The method of claim 83 further including providing a payout for each race based upon the finishing position of the player's racer in a respective race.

85. The method of claim 84 wherein any wager placed upon a race which is not run because of a game-ending criterion is lost.

86. The method of claim 85 wherein the program includes a paytable, said paytable providing increasingly higher payouts for at least some races completed after a first race.

87. The method of claim 86 wherein a starting position for a player's racer in said another race is based upon the finishing position of said player's racer in the race just completed.

88. The method of claim 87 wherein said starting position for a player's racer is the finishing position of said player's racer in the race just completed.

89. The method of claim 88 wherein a game-ending criterion further includes a number of racers remaining that equals a predetermined number of finishing places for which a payout is provided.

90. The method of claim 85 wherein a bonus round is entered if a player's racer is the last remaining racer at the end of a race.

91. The method of claim 90 wherein said bonus round comprises selection by the player of at least one of a plurality of bonus items, each bonus item having a bonus value associated therewith revealed upon selection of said bonus item.

92. A method of playing a race game with a plurality of players comprising the steps of:

providing a racecourse;

providing a plurality of racers;

providing a program by which said racers are variously moved about said racecourse, said program including a function for randomly assigning a finishing position for racers at the end of a race;

providing a player interface with said program for player input commands, said program accommodating input commands from a plurality of players who are jointly participating in a race;

each player selecting a racer as that player's racer;

initiating a first race;

(i) eliminating at least one racer as a result of a predetermined threshold finishing position required at the end of a race;

(ii) continuing play with another race provided at least one player's racer has not been eliminated and at least one player has previously placed a wager on said another race;

repeating steps (i) and (ii) until a predetermined game-ending condition occurs.

93. The method of claim 92 wherein said game-ending condition is any of the following: said player's racer has been eliminated; a predetermined number of races have been run.

94. The method of claim 92 wherein said game-ending condition can be each of the following: said player's racer has been eliminated; a predetermined number of races have been run.

95. The method game of claim 94 wherein said game-ending condition can further include: the number of racers, inclusive of the player's racer, is below a predetermined minimum number.

96. A race game with a plurality of players, comprising:

a racecourse;

a plurality of racers;

a methodology by which said racers are variously moved about said racecourse, said methodology including a function for randomly assigning a finishing position for racers at the end of a race;

designating a racer as a player's racer for each respective player who is participating in a race, said program accommodating input commands from a plurality of players;

initiating a first race;

(i) eliminating at least one racer as a result of a predetermined threshold finishing position required at the end of a race;

(ii) continuing play with another race provided at least one player's racer has not been eliminated and at least one player has previously placed a wager on said another race;

repeating steps (i) and (ii) until a predetermined game-ending condition occurs.

97. The race game of claim 96 wherein said game-ending condition is any of the following: said player's racer has been eliminated; a predetermined number of races have been run.

98. The race game of claim 96 wherein said game-ending condition can be each of the following: said player's racer has been eliminated; a predetermined number of races have been run.

99. The race game of claim 98 wherein said game-ending condition can further include: the number of racers, inclusive of the player's racer, is below a predetermined minimum number.

100. A race game for play on a plurality of linked gaming machines, wherein each said gaming machine includes a player input mechanism for interfacing with a cpu, comprising the steps of:

providing a cpu including a program for operating a race substantially simultaneously for all gaming machines having a player participating in a race;

generating a raceway and a plurality of racers on at least one visual display;

inputting a wager by each player;

selecting a racer as a player's racer for each player who is participating in a race;

initiating a race;

randomly assigning a finishing position for racers at the end of a race;

continuing play with another race provided that at least one player's racer has not met a predetermined game-ending criterion and that player has previously placed a wager on said another race.

101. The race game of claim 100 further including providing a payout based upon the number of races completed by each player's racer and the finishing position of a respective player's racer in each race.

102. The race game of claim 101 wherein said wager includes player selection of a consecutive number of races desired to be run up to a preset maximum number of races to the game, and any wager placed upon a race which is not run by a respective player because of a game-ending criterion being incurred by that player is thereby lost.

103. The race game of claim 101 wherein the program includes a paytable, said paytable providing increasingly higher payouts at least some races completed after a first race.

104. The race game of claim 100 wherein a starting position for a player's racer in said another race is based upon the finishing position of that player's racer in the race just completed.

105. The race game of claim 104 wherein said starting position for a player's racer is the finishing position of that player's racer in the race just completed.

106. The race game of claim 100 further including the steps of eliminating at least one racer as a result of a predetermined threshold finishing position required at the end of a race.

107. A system for operating a plurality of linked gaming machines, comprising:

a video display;

a cpu including a program for driving said display and operating a race game;

a player input mechanism for each player interfacing with said cpu;

a raceway formed on said display;

a plurality of racers generated by said program and depicted on said display;

said player input mechanism including an input for a wager by a respective player participating in a race, said wager input including player selection of a consecutive number of races desired to be run up to a preset maximum number of races to the game;

a racer designated as the player's racer for each respective player;

a race run by said program including all of said racers of respective players, said race being shown on said video display, with a finishing position for racers at the end of a race randomly assigned to said racers;

another race being provided in the event that at least one player's racer has not met a predetermined game-ending criterion at the end of a race and that player has previously placed a wager on said another race.

108. The system of claim 107 further including a payout based upon the number of races completed by a player's racer and the finishing position of that player's racer in each race.

109. The system of claim 108 wherein any wager placed by a respective player upon a race which is not run by that player because of a game-ending criterion is thereby lost.

110. The system of claim 108 wherein said program includes a paytable, said paytable providing increasingly higher payouts for at least some races completed after a first race.

111. The system of claim 107 wherein a starting position for a player's racer in said another race is based upon the finishing position of that player's racer in the race just completed.

112. The system of claim 111 wherein said program further eliminates at least one racer as a result of a predetermined threshold finishing position required at the end of a race.

113. A race game in which a plurality of players can participate, comprising:

a raceway and a plurality of racers on said raceway;

placement of a wager by each participating player;

selecting a racer as a respective player's racer;

initiating a race;

randomly assigning a finishing position for racers at the end of a race;

continuing play with another race provided at least one player's racer has not met a predetermined game-ending criterion and that player has previously placed a wager on said another race.

114. The race game of claim 113 further including a gaming machine for each player, said gaming machine having:

a video display;

a machine cpu including a machine program for driving said display and interacting with said game;

a player input mechanism interfacing with said machine cpu;

and further including a network interlinking each said gaming machine of all said players participating in a game, and a master program operating said game, such that each display has said raceway depicted on said display, and each race is run substantially simultaneously on each said display.

115. The race game of claim 114 wherein each said machine cpu includes said master program, and said master program of a first player's machine cpu operates all other machines' displays participating in a race.

116. The race game of claim 114 wherein said master program is embodied in a central cpu which is separate from said machine cpu.

117. The race game of claim 114 wherein said player input mechanism further includes a message input capability, and said master program reproduces said message on displays of other players participating in a race.

118. The race game of claim 114 wherein at least some of said machines that are interlinked on said network are within line of sight of each other.

119. The race game of claim 113 further including a gaming machine, said gaming machine having:

a video display with a display screen upon which the game is played that is visible to a plurality of players;

a cpu including a program for driving said display and operating said game;

a plurality of player command input mechanisms interfacing with said cpu.

120. The race game of claim 113 further including a central video display having a display screen upon which the game is played and which is visible to a plurality of players; a cpu including a program for driving said display and operating said game; a plurality of player command input mechanisms; and a network interlinking each said player command input mechanisms with said cpu.

121. The race game of claim 113 further including a payout for each race based upon the finishing position of a player's racer in a respective race.

122. The race game of claim 121 wherein a paytable is provided for said payout, said paytable providing increasingly higher payouts for at least some races completed after a first race.

123. The race game of claim 122 wherein a starting position for a player's racer in said another race is the finishing position of that player's racer in the race just completed.

124. The race game of claim 123 wherein at least one racer is eliminated as a result of a predetermined threshold finishing position required at the end of a race; and play continues with another race until one of the following occurs constituting a game-ending criterion: all players' racers have been eliminated; a predetermined number of races have been completed.

125. The race game of claim 124 wherein said raceway is a swimming area, said racer is a swimmer, and elimination of a swimmer comprises a sequence depicting a sea-creature eating said swimmer.

126. The race game of claim 113 wherein said wager includes player selection of a consecutive number of races desired to be run up to a preset maximum number of races to the game, and any wager placed by a player upon a race which is not run by that player because of a game-ending criterion is lost.

127. The race game of claim 113 wherein a bonus round is entered if a player's racer is the last remaining racer at the end of a race.

128. The race game of claim 127 wherein said bonus round comprises selection by the player of at least one of a plurality of bonus items, each bonus item having a bonus value associated therewith revealed upon selection of said bonus item.

129. The race game of claim 113 wherein said raceway is a swimming area, and said racer is a swimmer.

130. The race game of claim 113 wherein said raceway is a vehicular race track, and said racer is a motor vehicle.

131. The race game of claim 113 wherein said raceway is a vehicular race track, said racer is a motor vehicle, and elimination of a motor vehicle comprises a sequence depicting destruction of said vehicle.

132. A method for operating a plurality of linked gaming machines in a system, wherein each gaming machine includes a video display and a player input mechanism interfacing with a cpu, comprising the steps of:

providing a computer program for driving the displays and operating at least some aspects of the game in concert on the linked machines;

generating a raceway and a plurality of racers on each display;

registering an input wager by each player participating in a race, said wager including player selection of a consecutive number of races desired to be run up to a preset maximum number of races to the game;

registering the selection of a racer as a respective player's racer;

initiating a race and showing said race on each display;

randomly assigning a finishing position for racers at the end of a race;

continuing play with another race provided at least one player's racer has not met a predetermined game-ending criterion and that player has previously placed a wager on said another race.

133. The method of claim 132 further including providing a payout based upon the number of races completed by a respective player's racer and the finishing position of that player's racer in each race.

134. The method of claim 133 wherein any wager placed upon a race which is not run by a player because of a game-ending criterion is thereby lost.

135. The method of claim 134 wherein the program includes a paytable, said paytable providing increasingly higher payouts for at least some races completed after a first race.

136. The method of claim 135 wherein a starting position for a player's racer in said another race is based upon the finishing position of said player's racer in the race just completed.

137. The method of claim 132 further including the steps of eliminating at least one racer as a result of a predetermined threshold finishing position required at the end of a race, and continuing play with another race until one of the following occurs constituting a game-ending criterion: all players' racers have been eliminated; a predetermined number of races have been completed.

138. The method of claim 137 wherein a bonus round is entered if a player's racer is the last remaining racer at the end of a race.

139. The method of claim 138 wherein said bonus round comprises selection by the player of at least one of a plurality of bonus items, each bonus item having a bonus value associated therewith revealed upon selection of said bonus item.

140. The method of claim 137 wherein said raceway is a swimming area, said racer is a swimmer, and elimination of a swimmer comprises a sequence depicting a sea creature eating said swimmer.

141. The method of claim 137 wherein said raceway is a vehicular race track, said racer is a motor vehicle, and elimination of a motor vehicle comprises a sequence depicting destruction of said vehicle.

142. The method of claim 132 wherein said raceway is a swimming area, and said racer is a swimmer.

143. The method of claim 132 wherein said raceway is a vehicular race track, and said racer is a motor vehicle.

* * * * *